US008002572B2

(12) United States Patent
Lu et al.

(10) Patent No.: US 8,002,572 B2
(45) Date of Patent: Aug. 23, 2011

(54) HDMI DIY FIELD TERMINATION PRODUCTS

(75) Inventors: Xiaozheng Lu, Irvine, CA (US); Senhua Hu, Dongguan (CN)

(73) Assignee: Luxi Electronics Corp., Irvine, CA (US)

( * ) Notice: Subject to any disclaimer, the term of this patent is extended or adjusted under 35 U.S.C. 154(b) by 0 days.

(21) Appl. No.: 12/836,913

(22) Filed: Jul. 15, 2010

(65) Prior Publication Data

US 2011/0065308 A1 Mar. 17, 2011

Related U.S. Application Data

(60) Provisional application No. 61/225,912, filed on Jul. 15, 2009, provisional application No. 61/226,470, filed on Jul. 17, 2009, provisional application No. 61/226,354, filed on Jul. 17, 2009.

(51) Int. Cl.
*H01R 4/24* (2006.01)

(52) U.S. Cl. ..... 439/405; 439/449; 439/607.58; 439/607.49; 439/422; 439/904

(58) Field of Classification Search ..... 439/405, 439/422, 444, 449, 607.58, 607.49, 904
See application file for complete search history.

(56) References Cited

U.S. PATENT DOCUMENTS 4,006,961 A 2/1977 Langenbach
4,265,504 A 5/1981 Burns
4,322,120 A 3/1982 Rilling
4,335,931 A 6/1982 Kinnear
4,494,305 A 1/1985 Safai
4,721,483 A * 1/1988 Dickie ..... 439/607.49

(Continued)

FOREIGN PATENT DOCUMENTS

CN 20080046070.0 1/2009

OTHER PUBLICATIONS

Sinotek Solderless Connector Kit, Dec. 9, 2009.

*Primary Examiner* — James Harvey
(74) *Attorney, Agent, or Firm* — Jonathan A Claypool

(57) ABSTRACT

In some PCB connector embodiments the internal pins of the probe or wire terminal end could be set at between about 0.4 mm to about 2.0 mm provided that the contact point between the male probe end and the mating female connector is about 1.0 mm. Such embodiments would adjust for alternate connector configurations for connectors while maintaining the required HDMI specifications for the contact point. In other embodiments intermediate distances could be used of about 0.4 mm to about 0.5 mm; about 0.5 mm to about 0.6 mm; about 0.6 mm to about 0.7 mm; about 0.7 mm to about 0.8 mm; about 0.8 mm to about 0.9 mm; about 0.9 mm to about 1.0 mm; about 1.0 to about 1.1 mm; about 1.1 to about 1.2 mm; about 1.2 mm to about 1.3 mm; about 1.3 mm to about 1.4 mm; about 1.4 mm to about 1.5 mm; about 1.5 mm to 1.6 mm; about 1.6 mm to 1.7 mm; about 1.7 mm to 1.8 mm; about 1.8 mm to 19 mm and about 1.9 mm to 2.0 mm once again provided that the probe pins are finally configured to meet the about 1.0 mm requirement for the contact point.

18 Claims, 36 Drawing Sheets

U.S. PATENT DOCUMENTS 5,004,434 A 4/1991 Aielo et al.
5,118,310 A * 6/1992 Stroede et al. ..... 439/676
5,344,348 A 9/1994 Willis et al.
5,376,018 A * 12/1994 Davis et al. ..... 439/405
5,421,741 A * 6/1995 David et al. ..... 439/405
5,588,878 A 12/1996 Flinchbaugh
5,685,739 A 11/1997 Davis et al.
5,692,920 A 12/1997 Banakis et al.
6,062,907 A * 5/2000 Tan et al. ..... 439/607.41
6,149,468 A 11/2000 Meng
6,352,438 B1 3/2002 Wu
6,648,672 B1 * 11/2003 Meinke ..... 439/422
6,776,660 B1 8/2004 Kubota et al.
6,932,640 B1 * 8/2005 Sung ..... 439/405
6,935,896 B1 8/2005 Tsai
6,986,681 B2 1/2006 Tsai
6,991,487 B2 1/2006 Wu
7,059,914 B2 6/2006 Tsai
7,192,310 B1 3/2007 Chao et al.
7,210,945 B1 5/2007 Ying
7,252,548 B2 * 8/2007 Huang ..... 439/607.01
7,342,172 B1 3/2008 Wang et al.
7,387,542 B1 6/2008 Kero
D574,779 S 8/2008 Amidon
7,413,467 B1 8/2008 Lai et al.
D577,673 S 9/2008 Amidon
7,429,197 B2 9/2008 Weis et al.
D580,861 S 11/2008 Amidon
7,572,139 B2 8/2009 Montena
7,588,470 B2 9/2009 Li et al.
7,632,146 B2 12/2009 Murphy et al.
7,728,223 B2 6/2010 Shintani
7,729,874 B2 6/2010 Keady et al.
2005/0099812 A1 5/2005 Lee et al.
2005/0186843 A1 8/2005 Tsai
2005/0186850 A1 8/2005 Tsai
2005/0255752 A1 11/2005 Huang
2006/0040518 A1 2/2006 Ma et al.
2006/0110971 A1 5/2006 Wu
2006/0148319 A1 * 7/2006 Huang ..... 439/607
2006/0239310 A1 10/2006 Saiz
2007/0111564 A1 5/2007 Ying
2007/0218778 A1 9/2007 Lappoehn
2008/0045085 A1 2/2008 Zhang
2008/0106306 A1 5/2008 Keady et al.
2008/0106312 A1 5/2008 Keady et al.
2008/0106313 A1 5/2008 Keady et al.
2008/0106314 A1 5/2008 Keady et al.
2008/0109180 A1 5/2008 Keady et al.
2008/0305683 A1 12/2008 Li et al.
2008/0308294 A1 12/2008 Nair
2009/0013366 A1 1/2009 You et al.
2009/0017684 A1 * 1/2009 Lin ..... 439/610
2009/0030635 A1 1/2009 Horan et al.
2009/0052208 A1 2/2009 Li
2009/0081899 A1 3/2009 Montena
2009/0153209 A1 6/2009 Keady et al.
2009/0174450 A1 7/2009 Keady et al.
2009/0203261 A1 8/2009 Ikegami et al.
2009/0203266 A1 8/2009 Chuang
2009/0269943 A1 10/2009 Palli et al.
2009/0280674 A1 11/2009 Eppright et al.
2009/0280693 A1 11/2009 Eppright et al.
2009/0289681 A1 11/2009 Keady et al.
2009/0290026 A1 11/2009 Horan et al.
2009/0301755 A1 12/2009 Shintani
2010/0011143 A1 1/2010 Chang et al.
2010/0020179 A1 1/2010 Horan et al.
2010/0026790 A1 2/2010 Ohba et al.
2010/0066919 A1 3/2010 Nakajima et al.
2011/0017491 A1 * 1/2011 Lu et al. ..... 174/107
2011/0021059 A1 * 1/2011 Lu et al. ..... 439/345
2011/0065308 A1 * 3/2011 Lu et al. ..... 439/449

* cited by examiner

100

200

Prior Art

Front

Back

Side

1400

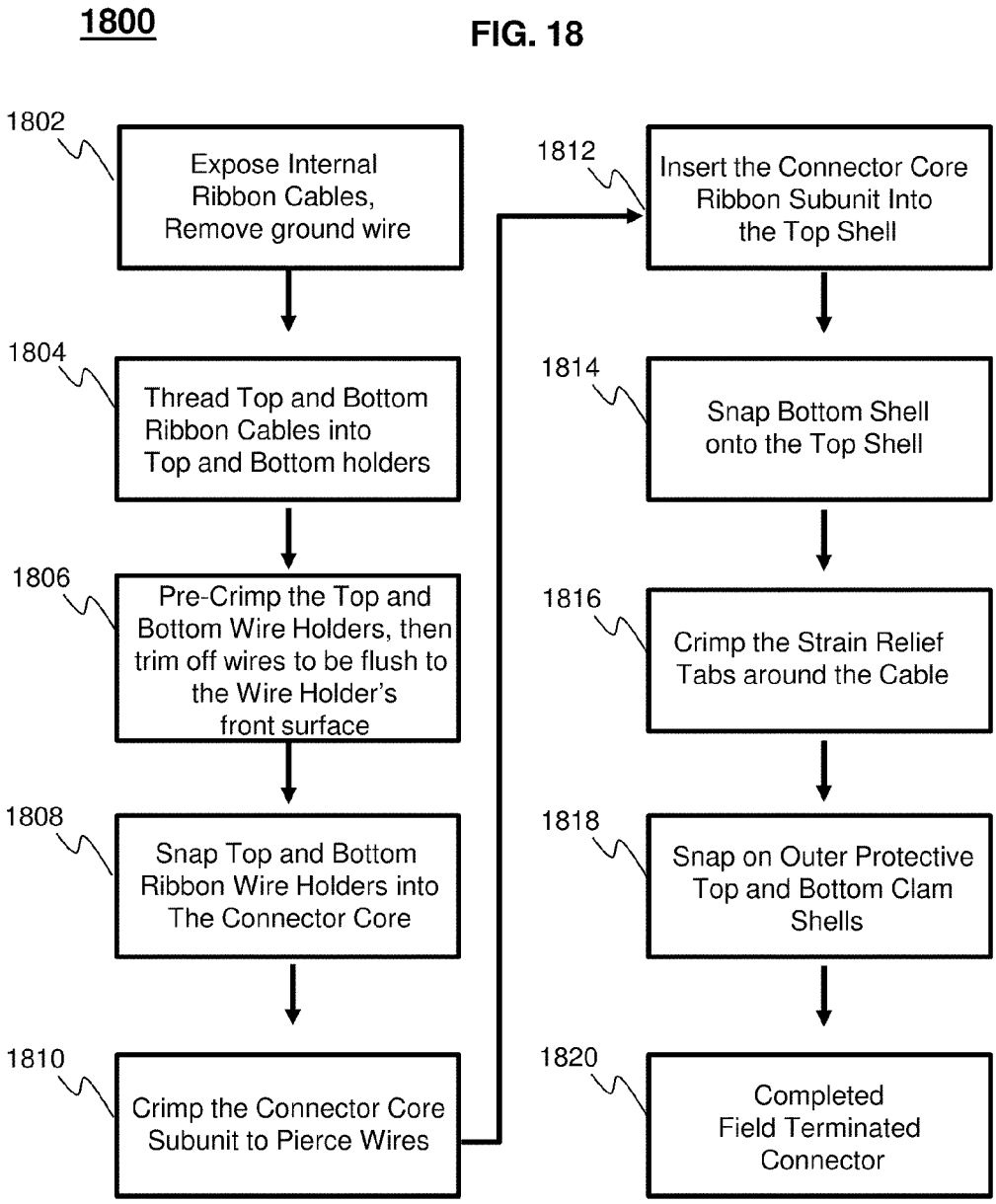
1800
FIG. 18
1802
Expose Internal Ribbon Cables, Remove ground wire
1804
Thread Top and Bottom Ribbon Cables into Top and Bottom holders
1806
Pre-Crimp the Top and Bottom Wire Holders, then trim off wires to be flush to the Wire Holder's front surface
1808
Snap Top and Bottom Ribbon Wire Holders into The Connector Core
1810
Crimp the Connector Core Subunit to Pierce Wires
1812
Insert the Connector Core Ribbon Subunit Into the Top Shell
1814
Snap Bottom Shell onto the Top Shell
1816
Crimp the Strain Relief Tabs around the Cable
1818
Snap on Outer Protective Top and Bottom Clam Shells
1820
Completed Field Terminated Connector

Parameter Name: HDMI Cat2 Transition Area Impedance

| | |
|---|---|
| Spc Max: 115 Ω:Ext: 125 Ω | Spc Min: 85 Ω: Ext: 25 Ω |
| Max: 106.56 .Ohms at 33.3166 ns | Min: 100.00 .Ohms at 33.5106 ns |
| ΔΩ: 6.56 | Avg: 103.38 Ohms |
| Duration: Max 250 ps | Result : Pass |

Parameter Name: HDMI Cat2 Transition Area Impedance

| | |
|---|---|
| Spc Max: 115 Ω:Ext: 125 Ω | Spc Min: 85 Ω: Ext: 25 Ω |
| Max: 107.87 .Ohms at 33.9940 ns | Min: 89.90 .Ohms at 39.2840 ns |
| ΔΩ: 17.87 | Avg: 38.83 Ohms |
| Duration: Max 250 ps | Result : Pass |

HDMI DIY FIELD TERMINATION PRODUCTS

CROSS-REFERENCE TO RELATED APPLICATIONS

This application claims priority to U.S. Patent Applications: Ser. No. 61/226,470, filed on Jul. 17, 2009; Ser. No. 61/225,912, filed Jul. 15, 2009; and Ser. No. 61/226,354, filed on Dec. 3, 2009 each of which is incorporated by reference in their entirety into this application.

FIELD OF THE INVENTION

The invention relates to a system of components and methods for making high definition multimedia interface (HDMI) connectors for field termination and factory termination for audio and visual signal transmission, switching and distribution. Included are modified cables, wire holders, insulated connector core units, and top and bottom shells, a hand specialized tool, methods for field termination assembly, and a locking plug design.

BACKGROUND

The development of advanced electronic devices that demand improved signal transmission has increased the need for custom installations of high definition multimedia interface (HDMI) audio video connections in the field. One major problem is the difficulty of adding (i.e. terminating) a male connector (i.e. plug) onto a standard HDMI cable in the field. Many installers prefer or are required to run the raw HDMI cables and terminate the HDMI plugs in the field instead of using the factory pre-terminated HDMI cables for many reasons including: a) In many buildings the cables are required to be run inside conduit to meet safety codes, however the HDMI plug of a factory made cable is too big to be pulled thru the conduit and the only workable solution is to pull the raw HDMI cable through the conduit and then to put on the HDMI plug afterwards in the field; b) Most electronic devices are mounted in standard racks where the wires connecting the devices in the rack are dressed neatly and cut to the proper length. Since the factory pre-terminated cables only come in several fixed lengths, the extra cable would have to be coiled up in the rack resulting in poor electrical performance and appearance. It is desirable to run raw HDMI cable which is cut to the proper length depending on the installation and then to put on the plugs on in the field; c) In many buildings the HDMI cables are installed and sealed inside the walls. If one plug is damaged then the wall has to be knocked open to replace the entire HDMI cable. There is a demand for the HDMI field termination system for the installers to cut off the damaged plug and put on a new one in the field; d) Safety codes typically require the cables running above tiled fake ceilings in classrooms and conference rooms to meet the plenum UL requirements. The plenum HDMI cables are only available in the form of raw cables as of now. These cables need to be terminated in the field with HDMI plugs.

Though solder free field termination connectors have been commercialized none has been successful for filed termination since they include short comings that affect durability and signal quality of the connectors. For example, no current solderless connector components are sufficiently interlocking for field termination applications resulting in reversibility of the components and loosening of the connection over time. In some cases factory machine heat sealing is employed to secure connector components together and within shells which is impractical in the field.

Further some of these connectors have thin plastic walls in the internal wire holders which crack under typical field pressure or temperature changes resulting in loosening or complete loss of connection over time. To date there are no overall metal shells which results in poor signal grounding and shielding. Also lack of an overall metal shells results in the front probe of the HDMI connector being easily snapped off the HDMI connector body under normal use.

One problem that has escaped workable a solution is that HDMI male connectors are somewhat loose when mated to their female receptacles and often are disconnected inadvertently causing field calls to correct disconnects from angry customers. Generally, HDMI cables are relatively thick and stiff applying constant torque and tension that can pull a connector plug loose from the mated female connector. In most cases it only takes about 3 lbs of pulling force to remove a HDMI cable connected to an electronic device. These problems are made worse by tight spaces common in installations like the space between the flat panel HDTV and the wall, coupled to tilting and panning features on flat panel HDTV wall mounts.

In professional settings there exists a desire and need to have every HDMI cable connection locked to avoid problems from loose and disconnected connectors at critical presentations and meetings. Though the HDMI specifications include square holes present on the bottom of the male probe that connect with friction springs in the female receptacle shell these are inadequate. The HDMI specifications optional friction hole and spring combination is designed primarily for the grounding of connections and fails to correct the common disconnect problems since they do not generate sufficient restraining force to adequately keep the male connector in place. Attempts to fix this problem include adding a thumb screw that requires the female connectors to have the compatible screw threads or active release button lock that requires one to squeeze the male connector body to open a lock tab; however these are cumbersome and have not been adopted due to their short comings. What is needed is a seamless universal male connector that is backwards compatible with existing female HDMI connectors in use and that has increased retention force that essentially locks the connector in place. Connectors that do not add such non-standard active means but are easily and simply disconnected when needed are in demand.

The increased number for custom installations has created needs for better cables that speed installations while at the same time maintain and also improving signal quality. Installers need to rout and dress the wires in cables for equipment racks requiring cutting the wires neatly to proper lengths before terminating the connectors. Current methods for termination of soldering or crimping 19-pins for Type A HDMI cable connectors are difficult to accomplish in the field but are also is labor intensive resulting in reduced productivity and reliability. Though various flat cables are commercially available most of these suffer draw backs. For example flat cables pose problems for pulling through conduit and often hang up due to their flat configuration. On the other hand the HDMI cable factories also face the need to increase the productivities for cable termination while the current methods involve separating 19 wires, preparing them one by one for soldering or crimping and thus these methods are labor intensive and low in productivity. Thus, improved cable designs are needed to address these problems both in the field and in production of cables with connectors in the factory.

SUMMARY

Provided are methods and a system including components, tools, and kits for field terminating a High Definition Multimedia Interface (HDMI), Do It Yourself (DIY) field termination connector. In one embodiment the HDMI DIY field termination connector system is provided that includes a top shell, bottom shell, and connector core, as well as top and bottom wire holders.

The top shell has a male plug member and open base with an extended portion serving as strain relief tabs. The top shell includes at least one tab for securing a connector core subunit within the base of the top shell by mating with at least one cognate receptacle on a connector core. The HDMI connector assembly system also includes a bottom shell that includes an open compartment base which is for mating with and encasing the top shell and the connector core subunit forming a connector assembly. The HDMI connector system further includes an insulating connector core that includes a first plug end for inserting within the top shell male plug member and is for contacting a female receptacle. The connector core also includes a second wire terminal end with an open body for receiving a cable and both a top and a bottom wire holder. The open body of the connector core contains an upper and lower set of flexible buckles each with a hook protrusion. Each of the hook protrusions is configured at an angle of less than 90 degrees and is for non-reversible mating with cognate clip receptacles positioned on the top and bottom wire holders. When the top and bottom wire holders are inserted into the top and bottom compartment of the connector core each of the flexible buckles can slip over the clips on the wire holders until the hook protrusion and clip receptacle are non-reversibly mated effectively locking the wire holders into the connector core as a subunit. The connector core also includes a set of top and bottom terminal pins that are positioned in the connector core for contacting wires in the wire holders. The sets of terminal pins contact the wires when the wire holders are compressed into the connector core providing contacts for signal transmission. The connector core also includes at least one receptacle for mating with the at least one of tab on the top shell for securing the connector core and wire holders as a subunit into the top shell. The at least one tab of the top shell slides mates with the at least one receptacle on the connector core when the connector core subunit is inserted into the top shell securing the subunit into the top shell.

The HDMI connector system further includes a top wire holder that includes an array of holes through the body of the wire holder that is for receiving a set of wires from a cable for contacting the top set of connector core terminal pins. Each of the array holes is grooved to match the outer dimensions of the wires of the cable. The top wire holder includes a clip with a receptacle configured at an angle of less than 90 degrees for mating with the hook protrusion of the flexible buckle of the connector core. The HDMI connector system further includes a bottom wire holder that includes an array of holes for receiving wires from a cable for contacting the bottom set of connector core terminal pins. Each of the array holes is also grooved to match the outer dimensions of the wires of the cable. The bottom wire holder includes a clip with a receptacle configured at an angle of less than 90 degrees for mating with the hook protrusion of the flexible buckle of the connector core. In other embodiments the HDMI connector system includes a HDMI cable. The cable can be a standard HDMI, about 19 wire, cable or modified ribbon HDMI cable.

Methods are provided for field terminating HDMI connectors onto standard HDMI, about 19 wire, cable as well as modified ribbon HDMI cables. The methods include threading a first and second set of internal wires exposed HDMI cables into the array of holes of a top and bottom wire holder. Each wire holder is pressed into the top and bottom compartment of a connector core. Top and bottom flexible buckles with hooking protrusions slide over and non-reversibly mate with cognate clips on the top and bottom wire holders. The connector includes a male probe end and a wire terminal end with a top and bottom set of terminal pins configured such that the wires in the wire holders are contacted by the pins when the wire holders are snapped into place forming a connector core subunit. The connector core subunit is pressed into a top shell such that the connector core snaps into place with the male end of the connector core subunit within the corresponding male probe compartment of the top shell. Tabs on the top shell mate with receptacles of the connector core such that the connector core subunit is secured within the top shell. A bottom shell is added to enclose the connector core subunit in the top shell forming a male connector assembly. The connector assembly is crimped with a hand compression tool to make contact between the pins and the wires of the HDMI cable. The hand tool is used to crimp the extended portion of the top shell serving as strain relief tabs around the HDMI cable jacket to secure the connector to the cable. In the final step protective exterior clam shell are added to form a finished male connector.

BRIEF DESCRIPTION OF THE DRAWINGS

FIG. 18 schematically shows a scheme for a method for field terminating a modified Ribbon HDMI cable with a male connector.

DETAILED DESCRIPTION

The system, components and methods disclosed in different example embodiments is described in this specification with reference to the accompanying drawings. In general it will be understood that the disclosed embodiments are not intended to limit the invention to these embodiments. Instead the invention is intended to cover all alternatives, modifications, and equivalents, which may be included within the spirit and scope of the invention as defined by the claims. In the following detailed description of the preferred embodiments details are set forth in order to provide a comprehensive understanding of the invention. It will be evident to one of ordinary skill in the art that the invention may be practiced without some of these specific details. In some instances known procedures and components have been described in only as much detail as necessary so as not to obscure specific aspects of the preferred embodiments.

A. Connector Assembly System for Field Termination and Factory Installation

A general description of connector assembly systems is provided immediately below with more detail for individual components following in sections B-G. A hand compression tool is described in section H which is used in the methods of section I and J for "Do It Yourself" (DIY) field termination methods. Methods of forming a DIY field terminated and factory installation connector systems follow in sections I and J, respectively. Improved signal characteristics are discussed for a DIY field terminated connector in section K. Kits of DIY components are disclosed in section L.

Figure 1:
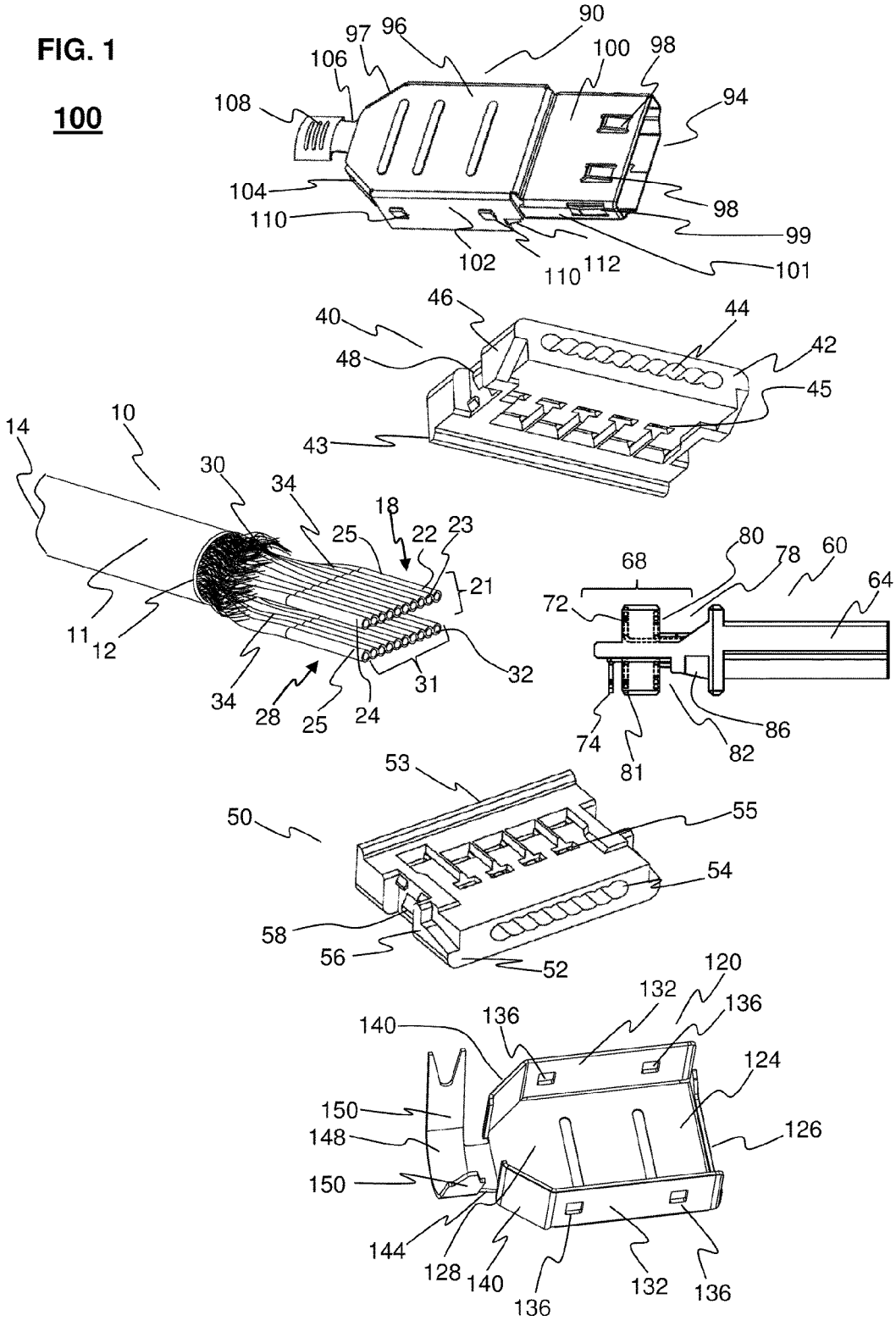
FIG. 1 schematically shows an example illustration of a HDMI system for assembling a male connector onto a modified cable.

Referring now to FIG. 1, an exemplary high definition multimedia interface (HDMI) connector system 100 is depicted including components aligned relative to how they would be assembled consisting of a modified HDMI cable 10, a top wire holder 40, a bottom wire holder 50, a connector core 60, and a top shell 90, and bottom shell 120.

In one embodiment a modified HDMI cable 10 is shown with the first end 12 uncovered and a second end 14 for connecting to another HDMI connector. The cable 10 comprises a round outer exterior insulating jacket 11 that contains two interior ribbon cables designated as the top ribbon 18 and the bottom ribbon 28, respectively.

The top and bottom ribbon cables 18, 28 are both shown covered in foil insulation 34 and unfolded from a compressed crescent like shaped configuration within the round jacket 11 of the outer cable 10. Each wire within the top 18 and bottom 28 ribbon cables are approximately equal in length and can be covered in the foil 34 while flat or alternately after being configured into a crescent like configuration. The foil covering 34 of each ribbon cable is surrounded by a wire braided sleeve 30 provided for support and protection from electromagnetic interference (EMI). Each of the ribbon cables 18, 28 in this embodiment are laid inside the cable 10 with overall twist. The top ribbon cable 18 is configured to be threaded into a top wire holder 40 through a array of holes (i.e. slot array) 44, from the back surface 43 to the front surface 42, while the bottom ribbon cable 28 is configured to be threaded into a bottom wire holder 50 through a similar array of holes (i.e. slot array) 54 from the back surface 53 to the front surface 52. Each of the array slots 44, 54 are a single contiguous opening with interior grooves configured to receive and guide a ribbon cable snugly through each of the wire holders.

In this embodiment the top ribbon cable 18 contains eleven identical conducting wires 21 within an insulating jacket 25 including an end wire 22 for grounding next to the adjacent first signal wire 23 together with the other identical signal wires 20 of the ribbon cable 18. The end wire 22 is positioned for separation from the first signal wire 23 and other wires 21 in the ribbon cable to serve as a grounding wire, for example by contacting the wire with the metal shell 90. The top ribbon cable 18 also has an end wire 24 that may be colored (e.g. red) on the ribbon jacket order to orient it for insertion into the top wire holder 40. The top ribbon cable 18 has ten wires configured to be threaded into the top wire holder 40 after the ground end wire 22 is separated from the ribbon. In this embodiment the bottom ribbon cable 28 contains a second set of nine identical conducting wires 31 positioned side by side within an insulating jacket 25. The bottom ribbon cable 28 contains a first end wire 32 for orienting the ribbon cable that may also be colored (e.g. red) on the ribbon insulating jacket 25 order to orient it for insertion into the bottom wire holder 50.

In some embodiments the top wire holder 40 and bottom wire holder 50 may themselves be colored coded to facilitate threading through with the top 18 and bottom 28 ribbon cables. For example, in one embodiment the top wire holder 40 is black in color while bottom wire holder 50 is white in color—though any suitable color combination is within the scope of this example.

Shown configured for assembly with the top 40 and bottom 50 wire holders and positioned to be threaded with the ribbon cables 18, 28 is a connector core 60. The connector core 60 consists of a main insulating body consisting of a probe member 64 for insertion into a top shell 90 and a back compartment 68 that contains a top set of V-shaped metal terminal pins 72 and a bottom set 74 of V-shaped terminal pins. Additionally the connector core 60 has an asymmetric receptacle including a top 78 and bottom 82 receptacle configured to receive a cognate set of clips 48 on both sides of the top wire holder 40 as well as a set of clips 58 on both sides of the bottom wire holder 50.

The top and bottom wire holders 40, 50 are configured to snap into place into the body of the connector core 60 such that the individual wires of the top and bottom ribbon cables 18, 28 are pierced by the top and bottom terminal pins 72, 74 which penetrate through the pin-slots 45, 55 on the interior surface of the wire holders through to the connected array of holes 44, 54, providing for contacts to mediate electrical transmission of signals. A flexible top 80 and bottom 81 hooking buckle is positioned on each of side of the connector core and is configured to mate with clip protrusions 48, 58 of the top 40 and bottom 50 wire holders locking them into the connector core as a connector core subunit (See FIG. 15, 1500). Each of the flexible buckles 80, 81 has a hook protrusion that is configured at less than ninety degrees to snap into place with the cognate clip 48, 58 creating a non-reversible connection when the buckles slide over the clip protrusion. These cognate buckle and clips are for locking the wire holders into the connector core without need for other securing means facilitating field termination.

Once the top 40 and bottom 50 wire holders are snapped into place in the connector core 60 a connector core subunit is formed which is ready for assembly into the top shell 90. Asymmetrical tabs of the top 46 and bottom 56 wire holders are guided into cognate receptacles 78, 82 on the connector core orienting each wire holder.

Shown configured to receive the connector core subunit is the top shell 90. The top shell includes a front probe member 94, a quadrilateral open base 96 enclosed by a first and second side 102 parallel to the base and a third and fourth side 104 on the trapezoidal portion 97 that has a terminal extension member 106 connected to a T-shaped strain relief member 108 for providing strain relief for the cable 10. Positioned on each of the first and second sides 102 are sets of two tabs 110 for locking with cognate receptacles 136 on the bottom shell 120. A set of tabs 112 are positioned for mating with cognate receptacles 86 on the connector core 60 to lock it into the top shell without need for other securing means such as adhesive (e.g. adhesive or glue).

In some embodiments the probe member 94 additionally has at least one retention spring 98 positioned on at least on surface of the shell. In a specific embodiment the at least one retention spring may be on the top 100 or side 101 surfaces of the male probe member 94 of the top shell 90. In a preferred embodiment the top surface 100 has two retention springs 98 and each side surface 101 of the male probe member of the shell has one retention spring 99. In another embodiment the top 98 and side 99 retention springs are dimensionally different to provide for different retention forces. In still other embodiments the top shell does not have any retention springs.

The bottom shell 120 is shown ready for assembly with the top shell 90 once the connector core subunit 60 is snapped into position within the top shell 90. The bottom shell 120 has an open compartment quadrilateral base that contains a main rectangular portion 124 positioned towards the probe end with a lip 126 positioned on the end and a second trapezoidal end 128 positioned towards the wire terminal end configured to receive the cable 10. A first and second side 132 positioned parallel to the rectangular portion of the base 124 is for mating with the first and second parallel sides 102 of the top shell 90. Each of the first and second sides 132 of the bottom shell 120 contains a cognate receptacle 136 configured for mating with a tab on a side 110 of the top shell 90.

A third and fourth 140 sides enclose the trapezoid end 128 of the bottom shell base 124 and are for mating with the trapezoidal portion 97 of the top shell 90. A connecting member 144 joins the bottom base to a strain relief tab base 148 for positioning cognate strain relief tabs 150. The strain relief tabs 150 are for wrapping around the cable 10 to protect it from strain.

Figure 2:
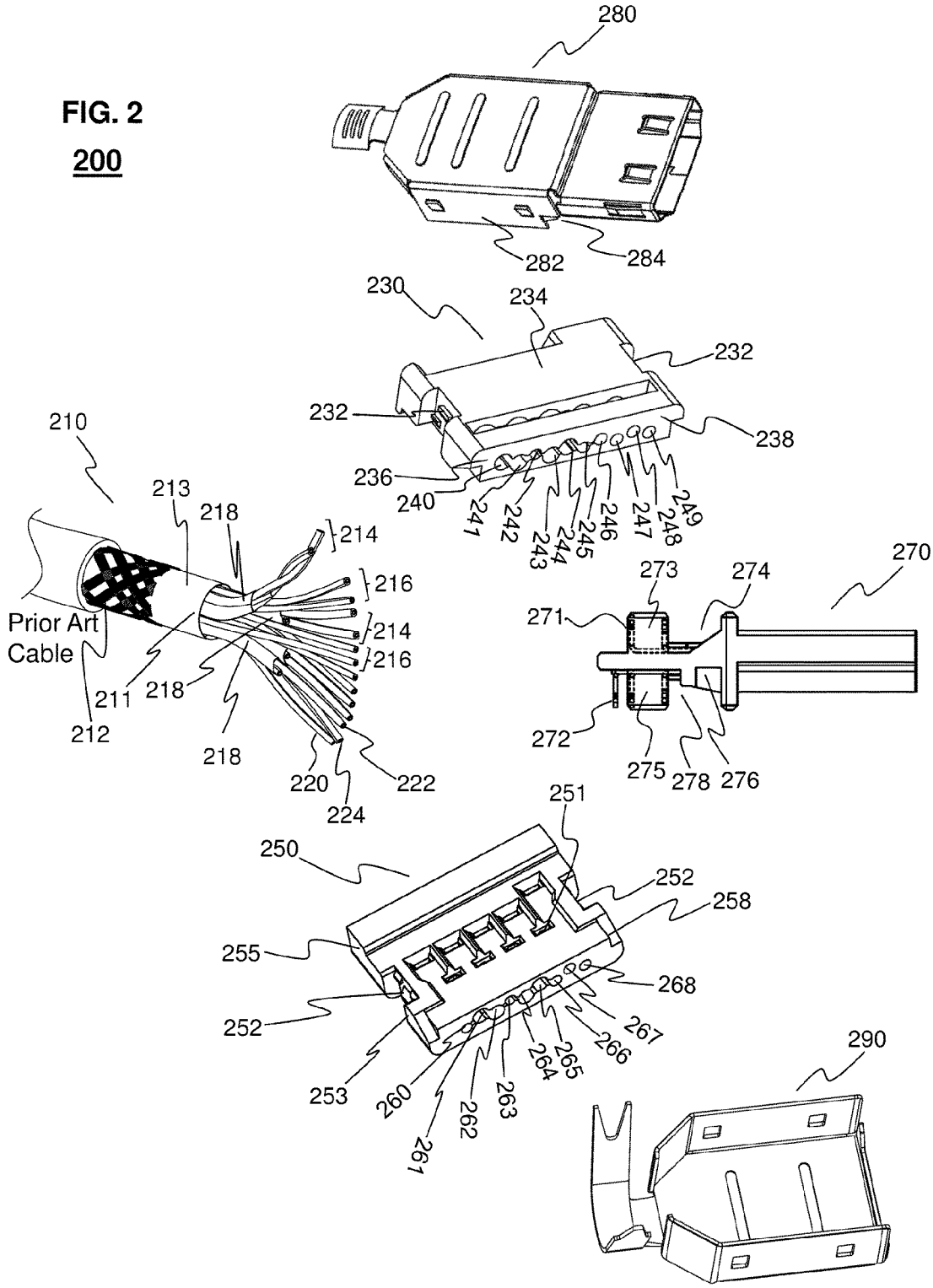
FIG. 2 schematically shows an example illustration of a HDMI system for assembling a male connector onto a standard cable.

Referring now to FIG. 2, an exemplary embodiment HDMI system 200 is shown for terminating a standard HDMI cable 210 containing about 19 internal wires either for factory installation or for field termination applications. Generally, the internal wires are color coded by each manufacturer, or are not uniform in color, since there is no industry standard. This poses problems for field termination since each wire color must go to the same pin assignment on each end.

The connector system 200 components consist of a top 230 and bottom 250 wire holder each being configured for being threaded with a set of ten and nine wires of the internal 19 wires of the standard cable 210, respectively, as well as a connector core 270, a top shell 280, and a bottom shell 290 as described for FIG. 1. Notable distinctions of the connector assembly system 200 are discussed in FIG. 2.

In this embodiment the standard HDMI cable 210 is shown with an open end 212 exposing internal wires and braided sleeve 213 for support and protection from EMI. Four sets of twisted wire pairs 214 with each set containing one naked ground wire 220 and two insulated conducting wires 222, 224 are depicted exposed from the outer cable jacket 211. Also shown are the seven independent insulated conducting wires 216. Each twisted pair is generally covered in foil insulation 218 for EMI shielding and grounding. In a standard cable the ground wire 220 is thinner than the conducting wires 222, 224. To accommodate the specific wires in the standard HDMI cable 210 each of a top 230 and bottom 250 wire holder are configured to receive the set of ten wires or nine wires, respectively, of the 19 internal cable wires, threaded through each wire holder for assembly into the connector core 270. The connector core 270 is shown with the top and bottom sets of V-shaped terminal pins 271, 272 configured to penetrate the slot pins of the top and bottom 251 wire holders to contact the wires (the pin slots are not visible for the top wire holder).

The top wire holder 230 contains ten holes through the holder configured in three sizes to receive the set of ten wires from the standard HDMI cable 210. The back of the top wire holder 234 has a set of ten holes with seven being counter sunk and recessed to facilitate aiming and threading and to make tight mating junctions with threaded wires (see FIG. 8C, 807). The front probe end 238 is for mating the wires with the connector core and shows the ten holes configured to receive wires from a standard HDMI cable 210. Starting from the left of the probe front 238 there are two large diameter holes 240, 241 for receiving a twisted pair of insulated conducting wires followed by a small holes 242 configured to receive a naked ground wire without any insulation covering and then followed by two more large holes 243, 244 for the next twisted pair two insulated conducting wires and another small hole 245 for a second naked ground wire followed by four medium holes for the remaining independent insulated ground wires 246, 247, 248, and 249. The first seven holes are configured as partially overlapping with slits between each for geometrical reasons to fit all of the ten holes for the top wires within the top wire holder 230. The last three holes 247, 248, and 249 are each of the medium size with the hole size being smaller than the pitch size distance between hole centers again for geometrical reasons to accommodate all of the ten wires within the wire holder. The last three holes 247, 248, and 249 are individual holes and have relatively thick walls contiguous with and formed from the wire holder main body. On the sides of the top wire holder 230 are sets of clips 232 for snapping the wire holder into the connector core 270 flexible buckle 273. The top wire holder has a large asymmetrical tab 236 that mates with and orients wire holder with the cognate top portion of the asymmetric receptacle 274 located on the connector core 270. The flexible buckles 273 has hooking protrusions configured at less than ninety degrees for snapping over the clips 232 on the top 230 wire holder to make the non-reversible effectively locking the wire holders into the connector core without need for other securing means.

The bottom wire holder 250 contains nine holes through the holder configured in three sizes to receive the set of nine wires from the standard HDMI cable 210. Similarly to the top wire holder the back of the bottom wire holder has a set of nine holes with seven being recessed to facilitate aiming and threading and for tight mating junctions (see FIG. 8D, 839) with threaded wires. The front probe end 258 is for mating the wires with the connector core and shows the nine holes configured to receive wires from a standard HDMI cable 210. Starting from the left of the probe front 258 the first hole 260 is small to receive a naked ground wire without any insulating cover. The next two holes 261, 262 are large in size for receiving two conducting wires from a twisted pair followed by a second small hole 263 for a fourth naked ground wire. The next two holes 264, 265 are large in size for receiving two conducting wires from a twisted pair. The first seven holes are configured as partially overlapping with slits between each for geometrical reasons to fit all of the nine holes for the bottom set of wires within the bottom wire holder 250. The next three holes 266, 267, and 268 are of medium size for receiving the three remaining independent insulated conducting wires. The last two holes 267, 268 are individual holes and have relatively thick walls with a contiguous circumference with and formed from the wire holder main body. On the sides of the bottom wire holder 250 are sets of clips 252 for snapping the wire holder into the connector core 270 flexible buckle 275. The bottom wire holder 250 also has a small asymmetrical tab 253 for orienting and mating with the cognate bottom portion of the asymmetric receptacle 278 located on the connector core 270. The flexible buckles 275 has hooking protrusions configured at less than ninety degrees for snapping over the clips 252 on the bottom wire holder 250 to make the non-reversible effectively locking the wire holders into the connector core without need for other securing means.

B. Modified HDMI Cable with Interior Ribbon Cables

Figure 3A:
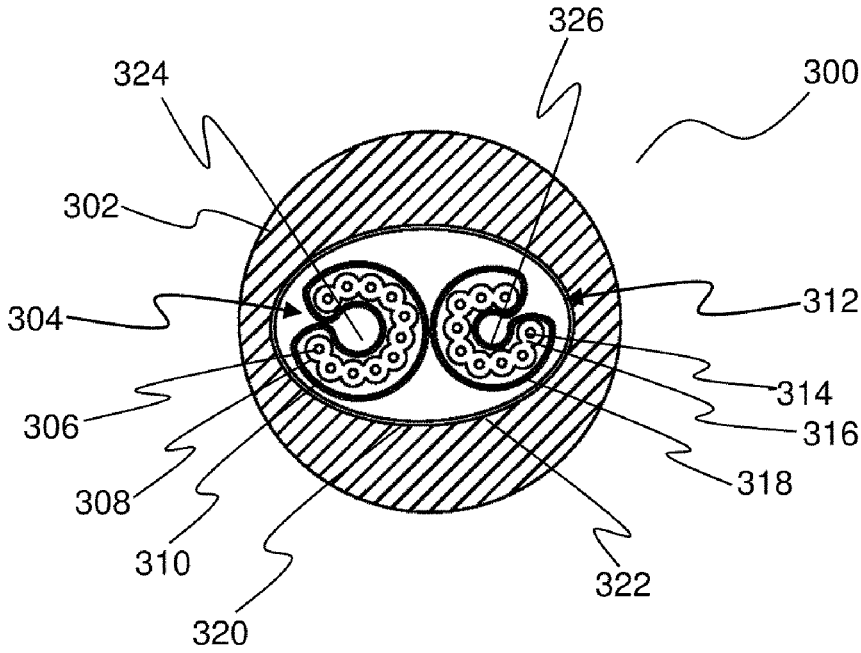
FIG. 3A schematically shows an example illustration of a cross section of a modified HDMI cable.
Figure 3B:
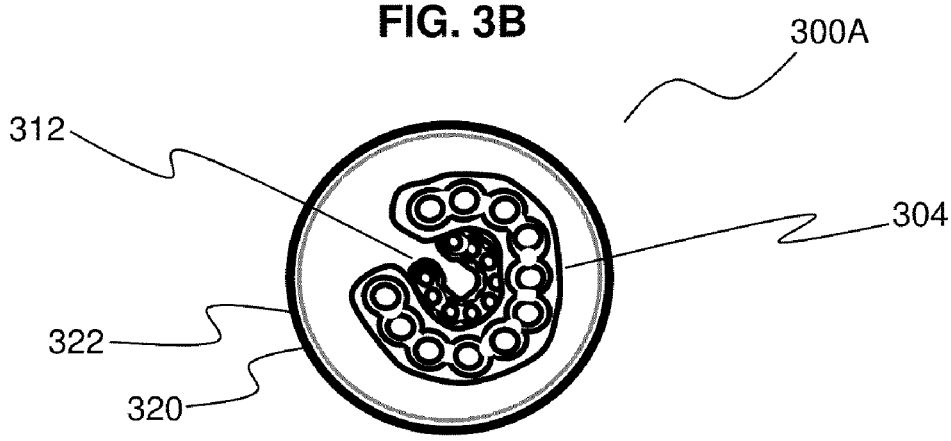
FIG. 3B schematically shows the interior of the cable in FIG. 3A with an alternate configuration for the internal ribbon cables where the ribbons are wrapped around each other in a spiral shape.
Figure 3C:
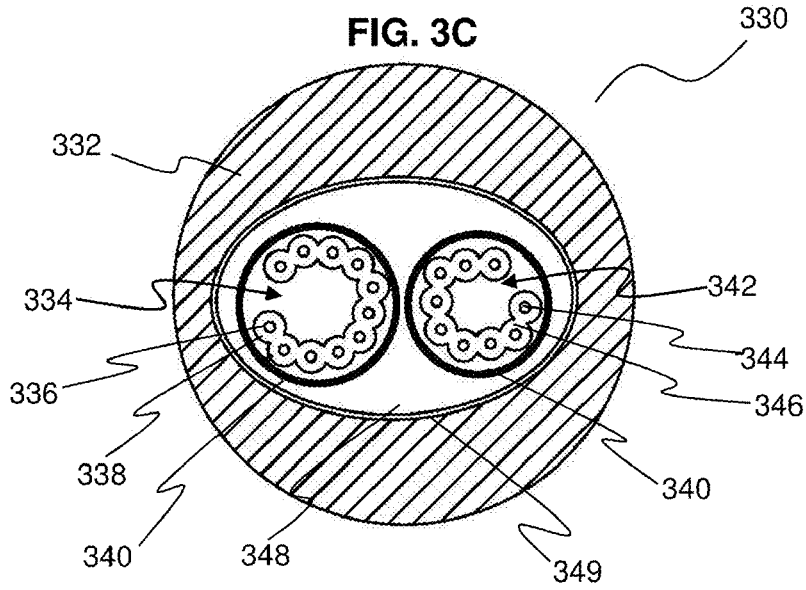
FIG. 3C schematically shows an example illustration of an alternate modified HDMI cable.
Figure 3D:
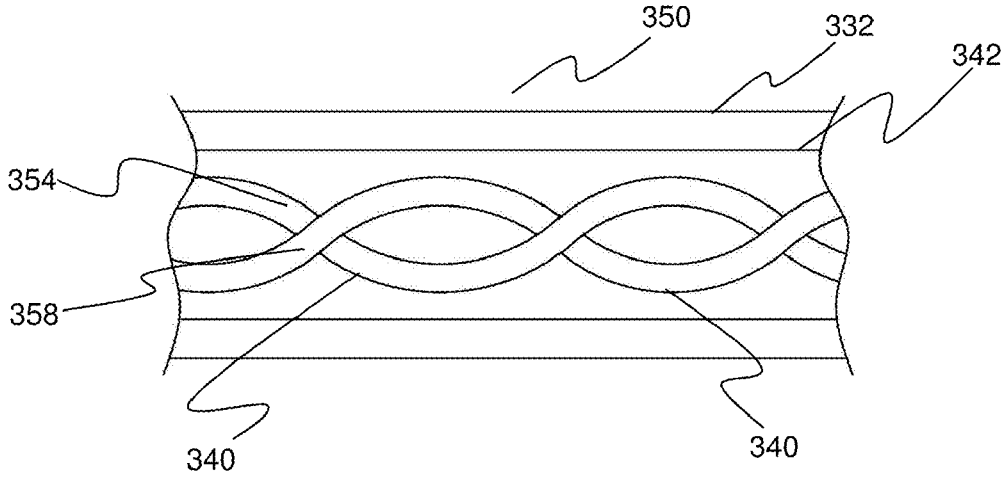
FIG. 3D schematically shows alternate example illustration of a twisted ribbon configuration of the cable of FIG. 3A, FIG. 3B, and FIG. 3C.

Referring now to FIG. 3A-FIG. 3D, shown are cross sectional views example embodiments of two modified HDMI cables in FIG. 3A and FIG. 3B together with a view of a twisted cable embodiment in FIG. 3D. The embodiment cables disclosed below maintain the functionality of round cables which are superior in performance compared to standard and flat HDMI cables for field installation. Since the embodiment cables employ identical length signal conducting wires this eliminates the problems associated with signal timing skew due to differing cable lengths among wires in the standard HDMI twisted pair cable caused by manufacturing tolerance and cable bending in installation. Also since the conducting signal wires of the ribbon cables are injected into insulating jackets the position and relationship between each wire does not change when the cable is bent greatly improving performance.

Additionally, the ribbon design allows for efficient threading into wire holders dramatically facilitation factory installation of connectors or field termination because the standard cable requires the 19 wires to be threaded one by one while the ribbon cable only requires the threading of the 2 ribbons, one for the top ribbon and one for the bottom ribbon. For example wire threading for a standard cable in the factory typically takes an experience worker about 10 minutes which can be reduced to less than two minutes with the ribbon cable. Also the internal wires are held in place and centered by the interior insulating jacket eliminating problems with wire sliding and misplacement. Further, the ribbon cable greatly reduces the chance of incorrect wire threading of the standard cable wires. In addition, a regular flat ribbon cable is not easy to be pulled through conduit or to go over corners because flat cable can only be bent in one axis. This ribbon cable folds the ribbons into crescent shapes that overlap with each other, thus the overall cable jacket maintains the round shape for easy cable pulling and cornering.

In FIG. 3A, a modified HDMI cable 300 is shown in cross section. An exterior jacket 302 surrounds internal components of the cable. A first internal top ribbon cable 304 consists of eleven conducting wires 306 laid side by side in a parallel layout within an interior insulating jacket 308. In some embodiments the top ribbon cable 304 is next to a second internal bottom ribbon cable 312 which consists of nine conducting wires 314 also laid side by side in a parallel layout within an interior insulating jacket 316. Both of the top 304 and bottom ribbon 312 cables are shown folded into a crescent like configurations to fit within exterior jacket 302 and maintain the round shape of the cable. The overall orientation of each crescent shaped cable may be shifted relative to each other about their center axis 324, 326 in different embodiments to facilitate positioning for threading directly into top and bottom wire holders respectively for assembling into a connector. In some embodiments the two ribbon cables are overlapping. The top and bottom ribbon cables are wrapped covered in foil insulation 310, 318 for EMI shielding protection and grounding purposes. In this embodiment the foil 310, 318 is applied by wrapping when the top and bottom ribbon cables are flat. Subsequently, each ribbon cable is folded into the crescent like configuration and both together are then wrapped in a second foil layer 320 for additional shielding protection. In some embodiments the ribbon cables are substantially overlapping in a spiral configuration. In other embodiments the crescent like shape is approximately circular in shape. A braided sleeve 322 surrounds the second foil 320 wrapping for EMI and strain protection. The outer jacket 302 is injected outside the second foil shield 320. Referring to the top ribbon cable 304, an end conducting wire 306 is positioned for separation from the other ten conducting wires and is for grounding by connecting with a surface such as with a metal shell of a connector.

In FIG. 3B, an alternate configuration for the top and bottom ribbon cables of FIG. 3A is shown. In this embodiment the top 304 and bottom 312 ribbon cables are cupped together with one encasing the other forming an approximately and substantially circular shape. When twisted together they form a spiral configuration with one ribbon wrapping around the other ribbon.

Referring now to FIG. 3C, an alternate embodiment configuration is shown in cross section for a modified HDMI cable 330. In this embodiment the exterior jacket 332 is round containing the internal ribbon cables 334, 342 covered in insulation 338, 346, with eleven 336 and nine 344 conducting wires, respectively.

The top 334 and bottom 342 ribbon cables are wrapped in foil 340 after they are folded into their crescent configurations. This results in the foil 340 having a round shape surrounding each crescent like shaped ribbon cable 334, 342. A second wrapping of foil 348 encases both the top 334 and bottom 342 foil 340 wrapped ribbon cables. A braided sleeve 349 surrounds the second foil 348 wrapping for EMI and strain protection. The outer jacket 332 is injected outside the braided sleeve 349.

Referring now to FIG. 3D, shown is a side overall-jacket-cutaway view of an alternate embodiment of the cable 350 described in FIG. 3A, FIG. 3 B, and FIG. 3C. In this embodiment, the internal top 354 and bottom 358 insulated ribbon cables are formed identically to as described above except that they are themselves twisted together instead of being laid flat. Advantages of this configuration is that the twisting of the top and bottom ribbon cables increases the mechanical stability and makes manufacturing more efficient. In these embodiments the two ribbons form a substantially spiral shape as they are twisted together. The twisted configuration also keeps the two ribbons close and tightly together in close proximity which facilitates making the overall round shape of the cable when the outer jacket is extruded onto the interior components during manufacturing.

Figure 4:
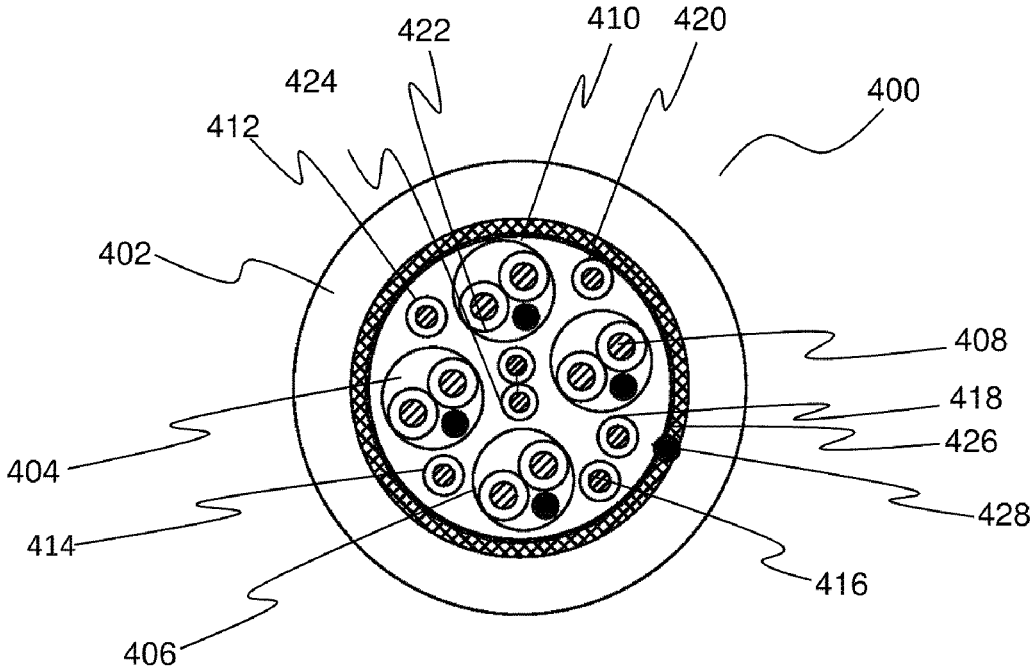
FIG. 4: Schematically shows an illustration of a cross section of a standard prior art HDMI cable.

Referring now to FIG. 4, shown is a cross sectional view of a standard traditional HDMI cable 400 for reference to the embodiments of cables disclosed above and following. Generally, a standard HDMI cable 400 contains about 19 signal wires enclosed within a round outer jacket 402. There are four sets of twisted pairs 404, 406, 408 and 410 in identical size. Each twisted pair consists of two conducting signal wires and a ground wire within an aluminum foil coating. The twisted pairs for wire arrangement are used in the field for two main reasons. First the twisted pair configuration gives relative good noise reduction since the wires are in close proximity to each other and external electronic noise reaching both conducting wires of the pair would be expected to be in almost identical amplitude, thus can be cancelled by a connected receiver. Second the twisted pairs are easy to manufacture by established existing techniques known in the art. The remaining conducting signal wires of a standard HDMI cable are straight wires or of one smaller twisted pair 412, 414, 416, 418, 420, 422, and 424. The set of wires within the cable is shielded by an aluminum foil covering and braided sleeve 426 and ground wire 428 for some added protection from EMI.

However, since the two signal wires are twisted together in each twisted pair they are often not precisely equal in length due to tolerance in the machine that performs the twisting assembly. Also wear and bending of cables alters length of each wire in twisted pairs. When length varies for the signal wires in twisted pairs the signals in each individual signal wires would not reach a receiver precisely at the same time. This creates skew in the signal which increases electronic noise. Skew would affect the receiver's ability to interpolate the signal and to cancel out the noise. Thus added skew will increase electronic noise in a standard HDMI cable.

Figure 5A:
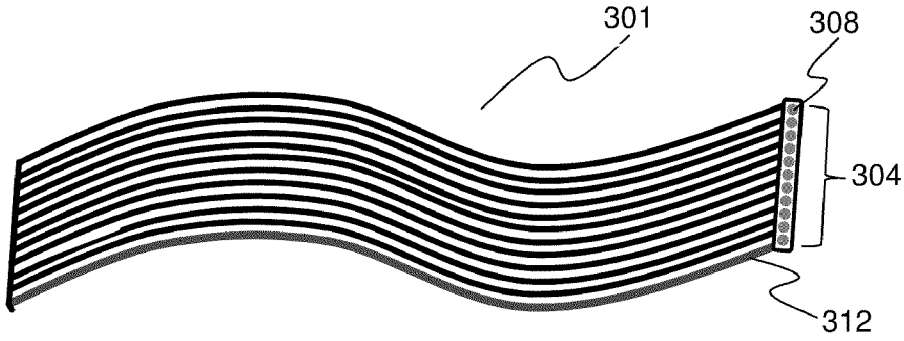
FIG. 5A schematically shows an illustration of a top side view of an internal insulated top ribbon cable.

Referring now to FIG. 5A, an elevated side view of a top internal insulated top ribbon cable is shown 301. The top ribbon cable 301 contains eleven identical conducting wires 304 encased in insulation forming the ribbon. In some embodiments the top ribbon cable has only ten conducting wires lacking the added ground wire (not shown). The last end wire 308 is for grounding and can be separated and stripped for contacting a metal surface such as the metal shell of a connector. In one embodiment the ribbon can be marked in for example by a colored stripe on the exterior of the insulation of a first end wire 312 order to orient the cable for threading into a wire holder. In other embodiments each conducting wire of the ribbon could be similarly color coded to correspond with the particular signal function assigned to the wire for matching with the pin or for matching with slot arrays or connected array of holes in the corresponding wire holder.

Figure 5B:
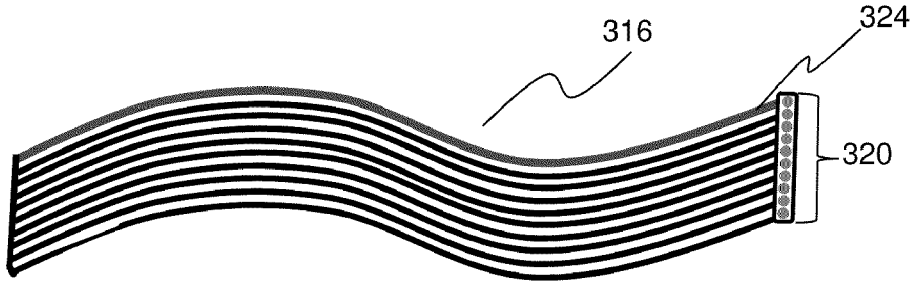
FIG. 5B schematically shows an illustration of a top side view of an internal insulated bottom ribbon cable.

Referring now to FIG. 5B, an elevated side view of a bottom ribbon cable 316 is shown. The bottom ribbon cable 316 contains nine identical conducting signal wires 320. In one embodiment the ribbon can me marked in for example by a colored stripe on the exterior of the insulation of a ninth end wire 324 order to orient the cable for threading into a wire holder. Similarly to the top ribbon cable added color coding of all nine wires represent additional embodiments.

Figure 5C:
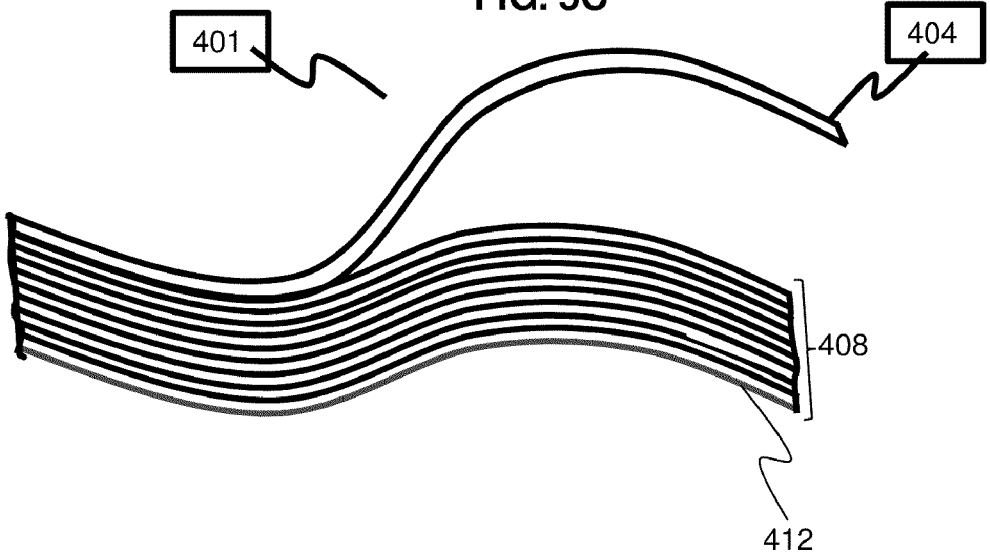
FIG. 5C schematically shows an insulated top ribbon cable with the ground wire separated from the ten conducting signal wires.

Referring now to FIG. 5C, an elevated side view of a top insulated ribbon cable is shown 401. In this example the last end wire 404 intended for grounding is separated from the ten conducting signal wires 408. The first conducting wire is marked on the ribbon insulation 412.

Figure 6A:
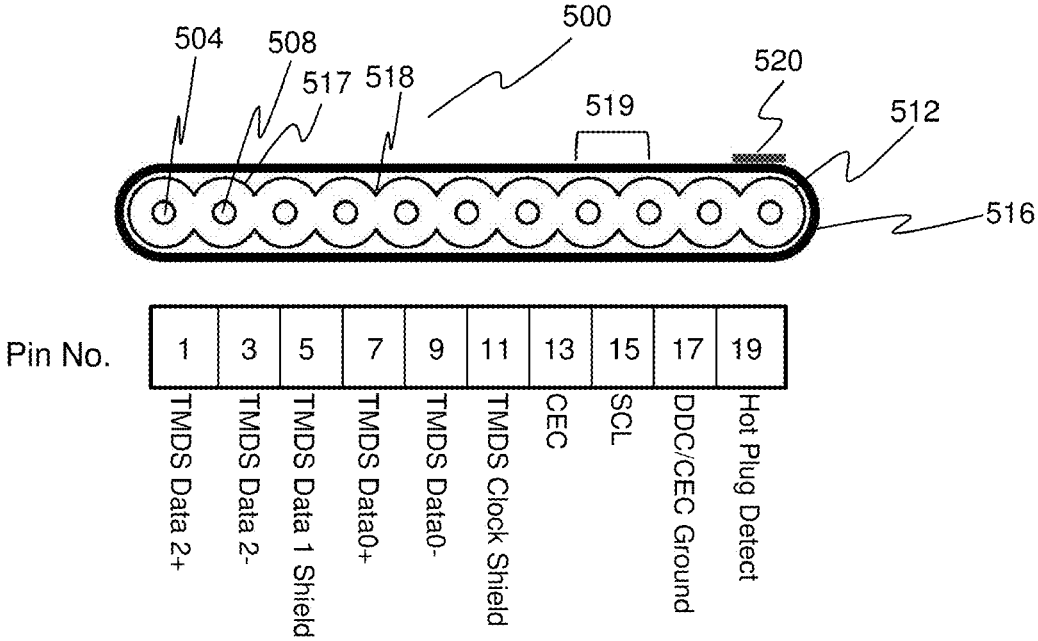
FIG. 6A schematically shows an end view of an internal insulated top ribbon cable with eleven conducting wires including ten signal wires and one ground wire.
Figure 6B:
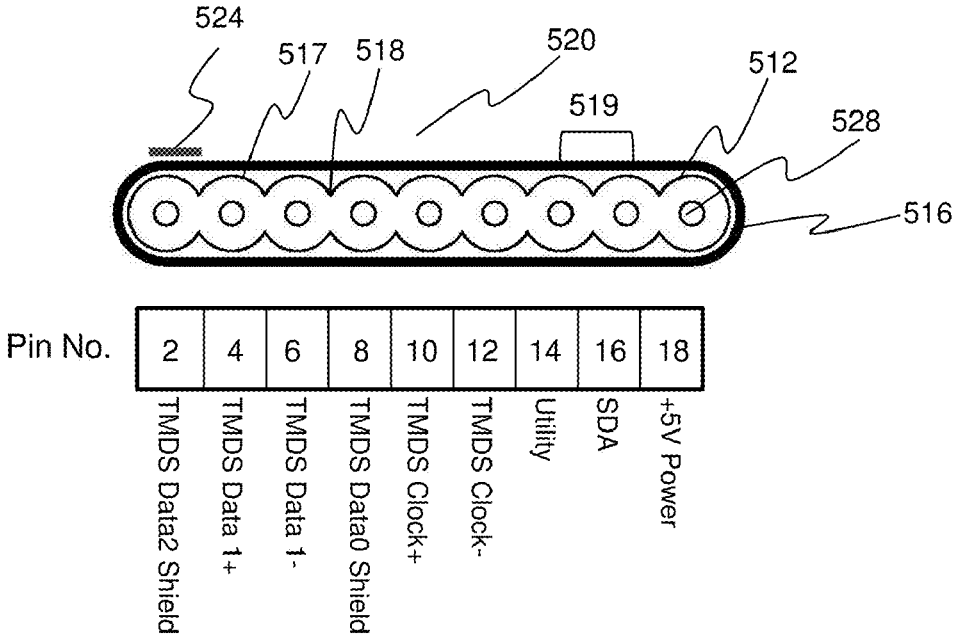
FIG. 6B schematically shows an end view of an internal insulated bottom cable with nine conducting signal wires.

Referring now to FIG. 6A and FIG. 6B, an end view is shown for a top and bottom ribbon cable juxtaposed to the corresponding pin assignment of the HDMI connector and signal assignment below each cable (for reference only, not part of cables). In FIG. 6 A, the top ribbon cable 500 can contain eleven identical conducting wires 508 placed within an insulating jacket 512 which is shown wrapped in foil 516. The last end wire 504 of the top ribbon cable 500 is intended to be separated from the ribbon to serve as a ground wire in some embodiments. In this embodiment the last tenth end wire 520 is color coded (e.g. red) on the insulating jacket 512 to orient the ribbon for insertion into the appropriate top wire holder so that each wire corresponds to the appropriate pin assignment (FIG. 6A, below ribbon, for reference only).

For example when properly oriented the first wire corresponds to pin 1 for signal assignment TMDS Data2$^+$; the second wire for pin 3 for signal assignment TMDS Data2$^-$; the third wire for pin 5 for signal assignment TMDS Data1 shield; the fourth wire for pin 7 for signal assignment TMDS Data0$^+$; the fifth wire for pin 9 for signal assignment TMDS Data0$^-$; the sixth wire for pin 11 for signal assignment TMDS clock Shield; the seventh wire for pin 13 for signal assignment CEC; the eight wire for pin 15 for signal assignment SCL; the ninth wire for pin 17 for signal assignment DDC/CEC ground; and the tenth and last wire for pin 19 for signal assignment Hot Plug Detect.

In FIG. 6B, the bottom ribbon cable 520 contains nine identical wires 528 also identical to those in the top ribbon cable 500. In one embodiment the first end wire 524 is marked on the insulating jacket 512 to also orient the cable for insertion into the appropriate bottom wire holder so that each wire corresponds to the appropriate pin assignment (FIG. 6B, below ribbon, for reference only).

For example when properly oriented the first wire corresponds to pin 2 for signal assignment TMDS Data2 Shield; the second wire for pin 4 for signal assignment TMDS DAta1+; the third wire for pin 6 for signal assignment TMDS Data1$^-$; the fourth wire for pin 8 for signal assignment TMDS Data0 Shield; the fifth wire for pin 10 for signal assignment TMDS Clock$^+$; the sixth wire for pin 12 for signal assignment TMDS Clock$^-$; the seventh wire for pin 14 for signal assignment Utility; the eight wire for pin 16 for signal assignment SDA; and the ninth wire for pin 18 for signal assignment +5V Power.

For both the top 500 and bottom 520 ribbon cables the insulating jacket 512 is extruded onto nearly identical wires forming a contoured insulating jacket 512. Fixing the position and length of each conducting wire within the ribbon cables eliminates noise problems associated with individual wires changing their relative position with respect to each other in a standard HDMI cable.

The height 517 and spacer region between conducting wires 518 of the insulating jacket corresponds to the desired placement and gauge of the internal conducting wires. In embodiments the pitch distance 519 between wire centers differs with a minimum being determined from the gauge (i.e. diameter) of the wire used. The maximum pitch size is only set by constraints of space within a cable or connector which is usually limited, but can be adjusted upward for many gauges of wire. Thus for smaller gauge wires used in modified ribbon HDMI cables the ranges of pitch sizes can overlap on the upper end.

Generally, HDMI cable performance is constrained by dimensional considerations for the conducting wires including the minimum pitch size distance between wire centers and the gauge of wires with larger gauge or size being positively correlated with improved performance. Ranges for pitch distances for internal conducting wires include but are not limited to a range of about 0.4 mm to about 2.0 mm. Specific embodiments have conducting wires with pitch ranges of about 0.4 mm to about 0.5 mm; about 0.5 mm to about 0.6 mm; about 0.6 mm to about 0.7 mm; about 0.8 to about 1.0 mm; 1.0 mm to about 1.1 mm; about 1.1 mm to about 1.2 mm; about 1.2 mm to about 1.3 mm; about 1.3 mm to about 1.4 mm; about 1.4 mm to about 1.5 mm; about 15 mm to about 1.6 mm; about 1.6 mm to a about 1.7 mm; about 1.7 mm to about 1.8 mm; about 1.8 mm to about 1.9 mm; and about 1.9 mm to about 2.0 mm.

For the terminal pins of the male probe of an HDMI connector the pitch distance is set by specifications at about 1.0 mm where the male pins contact the pins of the female connector. However, the pitch distance between terminal pins from the male connector to the contact point can be varied from 0.4 mm to about 2.0 mm from the wire terminal end to the probe end contact where the about 1.0 mm distance is required. These embodiments minor the above pitch distances of the conducting wires.

Embodiments of modified ribbon cables of smaller gauge (e.g. 28, 30, and 32) with a minimum pitch distance below 1.0 mm can be adjusted with added insulating space between conducting wires in the ribbon cable to conform to the standard 1.0 mm pitch distance for the pins of the male probe. For larger gauge wire in ribbon cable (e.g. 26, 24, 22, and 20 AWG) the minimum pitch distance exceeds the 1.0 mm maximum HDMI standard specification requiring a Printed Circuit board (PCB) trace bridge to reduce the pitch distance down to the 1.0 mm maximum set for the male probe pins.

Embodiments of the ribbon cables include, but are not limited to, internal conducting wires of the most commonly used sizes of 22, 24, 26, 28, 30, and 32 AWG wire (American Wire Gauge). In these embodiments the corresponding wire diameter is 0.644 mm, 0.511 mm; 0.405 mm; 0.321 mm; 0.255; and about 0.202 mm, respectively. Generally, in different embodiments the pitch size of the ribbon cables should be at least three times the conducting wire diameter because the requirement for space to accommodate the insulator around the conductor and between the insulating jackets of each individual conducting wire within the ribbon. For example, the minimum pitch distances for preferred gauges of wires would be: 22 AWG, about 1.9 mm; 24 AWG, about 1.5 mm; 26 AWG, about 1.2 mm; 28 AWG, about 0.96 mm; 30 AWG, about 0.77 mm; 32 AWG, about 0.60 mm. One skilled in the art would recognize that the by adding space between wires or by making the insulating jackets thicker the maximum pitch distance could be adjusted upward as desired and the pitch distances can overlap. In embodiments utilizing a gauge of wire with a minimum pitch distance below 1.0 mm the pitch size is adjusted upward to 1.0 mm to correspond to the HDMI pin pitch on the probe side for a simple connector design.

For larger wires (e.g. 26, 24, and 22 AWG) a minimal pitch size would be larger than the 1.0 mm pin pitch of the HDMI probe. Thus a solution for this problem is to provide a Printed Circuit Board (PCB) to adapt the larger pitch distance by adjusting them down via circuit traces to the 1.0 mm pin pitch size of the HDMI probe.

In some embodiments of the modified ribbon cable the number of internal conducting wires can be added or reduced with corresponding pitch distances in other complementary applications for HDMI such as for the DisplayPort (VESA: Video Electronics Standard Association) interface standard which uses a preferred 1.0 mm pitch distance for 20 pins (i.e. conducting wires), or the mini DisplayPort (Apple Inc.) interface standard which uses a preferred 0.6 mm pitch distance for 20 pin (i.e. conducting wires).

When the embodiments of the modified Ribbon cable for HDMI or other formats are utilized for transmission of signals via connectors both the reliability and productivity is improved. These cables are designed to function with the other components of the connector system disclosed as well as with commercially available HDMI connector components but are in particular well suited for use with the "Do It Yourself" (DIY) field termination components and methods described below in section I, and J, and in the other sections.

C. Wire Holders for Modified HDMI Cables with Interior Ribbon Cables and for Standard HDMI Cables The HDMI connector systems described in FIG. 1 and FIG. 2 employ wire holders through which the conducting signal wires as individual single wires or as a ribbon cables are threaded in different embodiments for assembly with the connector core and top and bottom shells to make a complete assembled connector on the cable. Features of wire holder embodiments are described below.

Referring now to FIG. 7A-FIG. 7F, regarding the system of FIG. 1, different views are shown to illustrate features of top and bottom wire holder embodiments that are for use with a modified HDMI cable with interior top and bottom insulated ribbon cable for efficient assembly into an HDMI connector assembly.

Figure 7A:
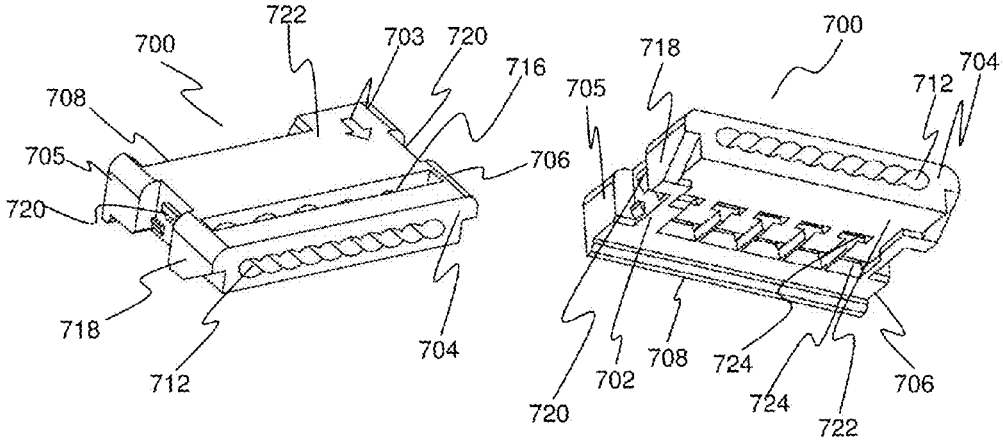
FIG. 7A schematically shows an elevated view down to the front probe end of the exterior of a top wire holder (left) for a top ribbon cable and also a view up to the interior of the front probe end of same top wire holder (right).

In FIG. 7A, a relief top view down into the front probe end exterior of a top wire holder 700 is shown in the left panel. A bottom view up into interior the same top wire holder 700 is shown in the right panel. This top wire holder 700 is designed for use with the cognate bottom wire holder 726 and modified HDMI cable with internal insulated ribbon cables described above.

The top wire holder 700 contains a front 704, back 708, left side 705, right side 706, exterior 722 and interior 702 surfaces. An array of holes forms a grooved slot 712 through the body of the wire holder into which the top ribbon cable with ten conducting signal wires can be threaded from the back 708 to front 704 surfaces forming a tight but moveable seal. The slot array 712 matches the outer dimensions of the ribbon cable precisely to the inner dimensions of the connected array slot such that a tight fit results that still allows the ribbon to be threaded and readily drawn through for subsequent connection to a connector core of a connector. In one embodiment the array slot 712 is about 10 mm in length and between about 0.65 to about 0.70 mm in inner diameter. In other embodiments the dimensions of the array slot is from about 5 mm to 20 mm in length and from about 0.50 mm to about 2 mm in inner diameter.

In other embodiments the dimensions of the array slot are matched to the diameter dimensions of the wire gauge with the insulating jacket based on the gauge of the conducting wire (AWG) and the desired pitch distance between conducting wires. For example for a ribbon cable with conducting wires of 30 AWG the wire diameter is about 0.76 mm with the insulation jacket consisting of a wire of diameter of about 0.255 mm and insulating jacket of about 0.25 mm thick. Other embodiments would add proportionally to the diameter of the gauge with insulation depending on space, pitch distance and need for insulation from EMI. In some embodiments the thickness of the insulating jacket for the ribbon cable is from about 0.1 mm to about 0.2 mm; 0.2 mm to about 0.3 mm; about 0.3 mm to about 0.40 mm; 0.4 mm to about 0.5 mm; and 0.5 mm to about 0.6 mm which covers the diameter conducting wire to form the overall outer diameter (OD) of the ribbon cable wires.

In one embodiment the top wire holder 700 is made colored (e.g. black or any suitable color) during manufacture to distinguish it from the bottom wire holder which is made of a differing color. In other embodiments the top or bottom wire holder are differently textured on the top and bottom surfaces (e.g. rough, ribbed, dimpled, smooth). In some embodiments a marking, for example an arrow, molded into the surface, or any other suitable image 703 (e.g. an arrow), can be positioned on the top surface 722 or one side 705, 706, to orient the holder with the top ribbon cable for threading into the array slot 712 cable where the first conducting wire also marked is matched to the end with the marking (e.g. a red stripe of an arrow). In other embodiments the back surface 708 or front surface 704 is similarly marked during manufacture with a molded, embossed, or colored image to orient the threading of the top (or bottom) ribbon cable.

Located on the left 705 and right 706 sides is a larger asymmetric tab 718 that snaps into place in a cognate receptacle on the top compartment base of the connector core that directionally positions and locks the top wire holder 700 onto the connector core. The top exterior surface 722 contains an open groove 716 into which the hand tool pre-crimping compression member that is matched to the groove dimensions is inserted to compress the wire holder to both apply compression so that wire holder holds the conducting wires tightly to prevent movement and also to center each wire within the wire holder slot array. The open groove 716 has an internal reverse V-shape inner wall of each groove-hole within the slot array that moves the conducting wires to the center of the designated groove-hole.

The interior surface 702 of the top wire holder 700 shows two off-set series of staggered pin-slots 724 with five being positioned toward the probe end off-set to the right side 706 and five closer to the wire terminal end and off-set toward the left side 705 of the top wire holder as viewed oriented facing the probe end. The pin-slots 724 are configured connected with the array slot 712 for the metal pins of the connector core to penetrate to contact the conducting wires of the top ribbon cable (see FIG. 9A, 910, 914).

Figure 7B:
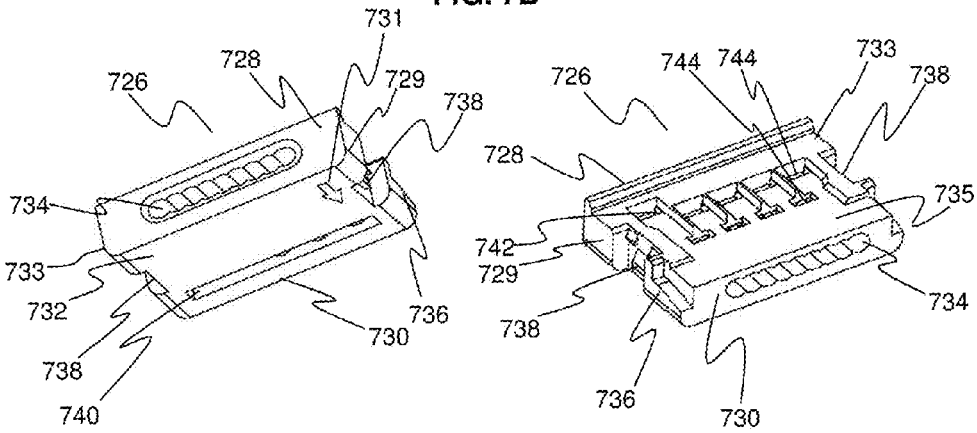
FIG. 7B schematically shows an elevated view up to the back wire terminal end exterior of a bottom wire holder (left) for a bottom ribbon cable and also a view down to the front probe end into the interior of the same bottom wire holder (right).
Figure 7C:
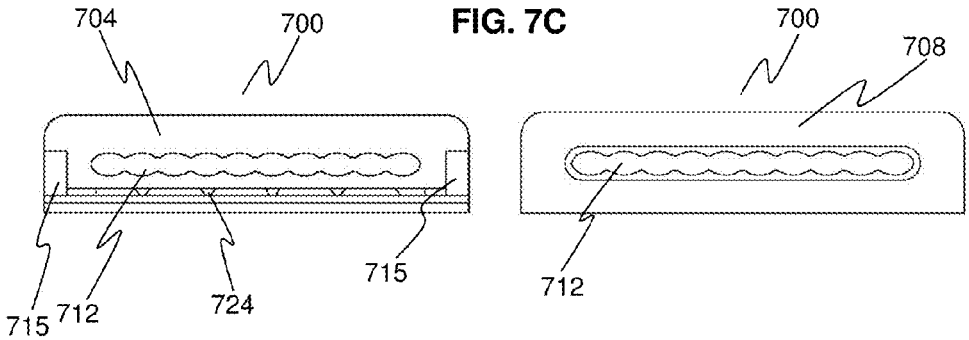
FIG. 7C schematically shows a front probe end view (left) and back wire terminal end view (right) of a top wire holder for a top ribbon cable.
Figure 7D:
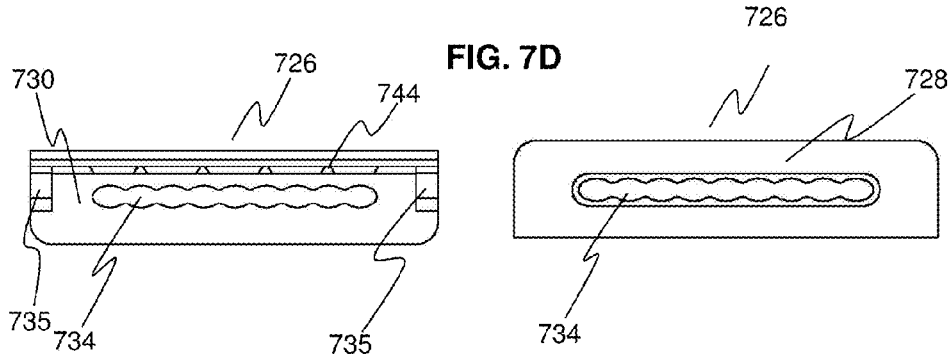
FIG. 7D schematically shows a front probe end view (left) and back end view (right) of a bottom wire holder for a bottom ribbon cable.
Figure 7E:
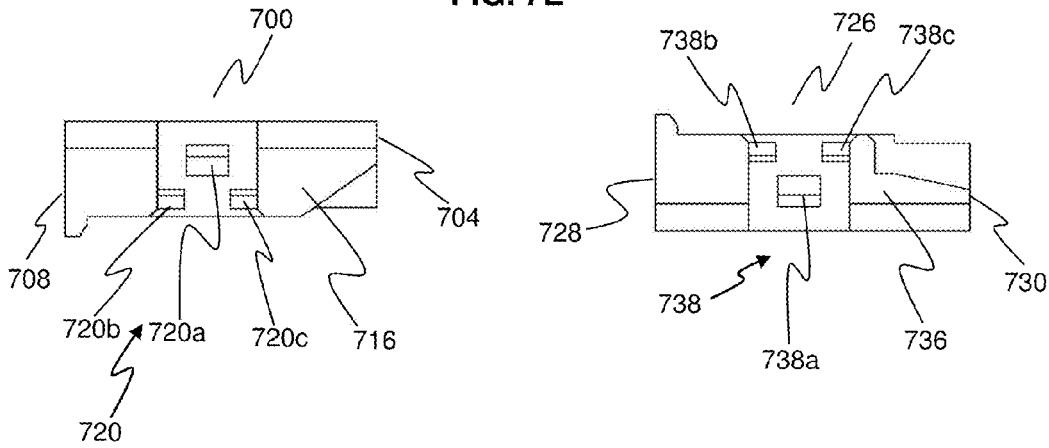
FIG. 7E schematically shows side views of a top wire holder for a top ribbon cable (left) and bottom wire holder for a bottom ribbon cable (right).

The right 705 and left 706 sides of the top wire holder 700 include a top set of clips 720 with a center larger convex block clip 720*a* positioned above two smaller clips 720*b*, 720*c* (see also FIG. 7E). The set of clips 720 are for connecting with a flexible buckle structure on the connector core to lock the wire holder into place within the connector core body (see FIG. 9A, 920, 924).

In FIG. 7B an elevated view up to the back wire terminal end of the exterior of a bottom wire holder 726 is shown in the left panel. An elevated view down to a front probe end of the same bottom wire holder is shown in the right panel. This bottom wire holder is for use with the cognate top wire holder 700 and modified HDMI cable with internal insulated ribbon cables described above (see FIG. 1). The bottom wire holder contains a front 730, back 728, left side 729, right side 733, exterior 732, and interior 735 surfaces. In one embodiment the exterior (bottom) surface 732 is marked with a molded image, for example an arrow 731, but any molded image or color would suffice for orientation of the similarly bottom ribbon cable. Similarly, the other surfaces including the front 730, back 728 or sides 729, 733, could be marked with a molded image or with color to orient the bottom ribbon cable for threading into the bottom wire holder 726.

The slot array 734 is shown configured to receive the bottom ribbon cable with the nine conducting signal wires which is threaded through the bottom wire holder body. The slot array 734 matches the outer dimensions of the bottom ribbon cable precisely being slightly smaller than the slot array 712 for the top wire holder 700 since the bottom ribbon cable has one or in some embodiments two fewer wires. Located on the right 729 and left 733 sides, as viewed towards the probe end, is a smaller asymmetric tab 738 that is configured to snap into place in a cognate receptacle on the bottom compartment base of the connector core that directionally positions and locks the bottom wire holder 700 onto the connector core. The bottom wire holder exterior surface 732 also contains an open groove 740 which has a V-shaped interior which functions like the open groove 716 on the top wire holder 700 described above. When a hand tool member is used to compress the groove 740 of the bottom wire holder in an assembly pre-crimp step the thin V-shaped wall in the groove moves inward centering the conducting wires within the bottom wire holder 726. During this pre-crimp process each of the holes in wire holder deform shrinking slightly which creates friction between the wall of the hole and the wire jacket, but does not deform the wires to any significant degree.

The interior surface of the bottom wire holder 735 contains three series of staggered pin-slot holes 744 consisting of four forward and four back with one 742 further back closest to the back 728 surface and to the right side 733 of the wire holder for a total of nine pin-slots. Each pin-slot 744, 742 is connected to the array slot 734 that allows the V-shaped metal pins of the connector core to penetrate to contact the nine conducting wires of the bottom ribbon cable (see FIG. 9A, 914). The left and right sides of the bottom wire holder 729, 733 include a bottom set of clips 738 with a center larger convex block clip 738*a* positioned above two smaller clips 738*b*, 738*c* (see also FIG. 7E). The set of clips 738 is for connecting with a flexible buckle hooking protrusion on the connector core to lock the wire holder into place within the connector core body (see FIG. 9A, 920, 924).

In FIG. 7C, the front probe end view is shown in the left panel and a back wire terminal end view is shown in the right panel for the top ribbon type wire holder 700. The array slot 712 is located positioned in the center of the front surface 704 of the top wire holder 700. The recessed sets of clips 720 are visible on each end. The staggered short pin slots 724 are visible at the bottom of the wire holder.

In FIG. 7D, the front probe end view is shown in the left panel and a back wire terminal end view is shown in the right panel for the cognate bottom ribbon type wire holder 726. The array slot 734 is located positioned in the center of the front surface 728 of the bottom wire holder 726. The recessed sets of clips 738 are visible on each end. The staggered short pin slots 744 are visible at the bottom of the wire holder.

In FIG. 7E, a side view of the top 700 and bottom 726 ribbon wire holders are shown in the left and right panels, respectively. The set of three clips 720, 738 are shown in the center of the side for the top and bottom ribbon holders. The large convex block clip 720*a*, 738*a*, is located above the two smaller clips 720*b*, 738*b* and 720*c*, 738*c*. These clips mate with a cognate flexible buckle hooking protrusion of the connector core for locking the wire holders into the top and bottom base of the connector core (see FIG. 9A, 920, 924). Also visible is the large and small asymmetrical tabs 716, 736 for orienting the top and bottom wire holders 700, 726.

Figure 7F:
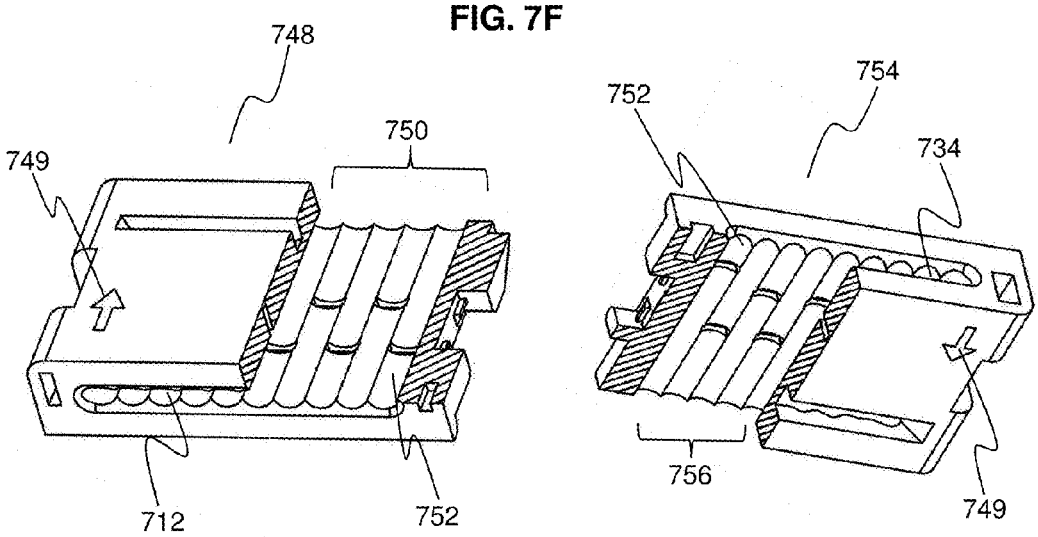
FIG. 7F schematically shows a cut away view of the connected array of holes (slot array) for both a top wire holder (left) for a ribbon cable and also for a bottom wire holder for a bottom ribbon cable (right).

In FIG. 7F, a cut away view of the top array slot 748 (from the top wire holder 700) is shown in the left panel. The array slot 754 (from the bottom wire holder 726) is shown in the right panel. The inside contour of the slot array 712, 734 for each is shown 750, 756 where the lower insider surfaces is grooved 752 with a diameter to match that of the corresponding ribbon cable. The upper inside surface is also grooved with a diameter to match the ribbon cable (not shown).

Referring now to FIG. 8A-FIG. 8E, regarding the system of FIG. 2, different views are shown to illustrate features of top and bottom wire holder embodiments that are for use with a standard HDMI cable with internal 19 wires including four sets of twisted pairs for efficient assembly into an HDMI connector assembly.

Figure 8A:
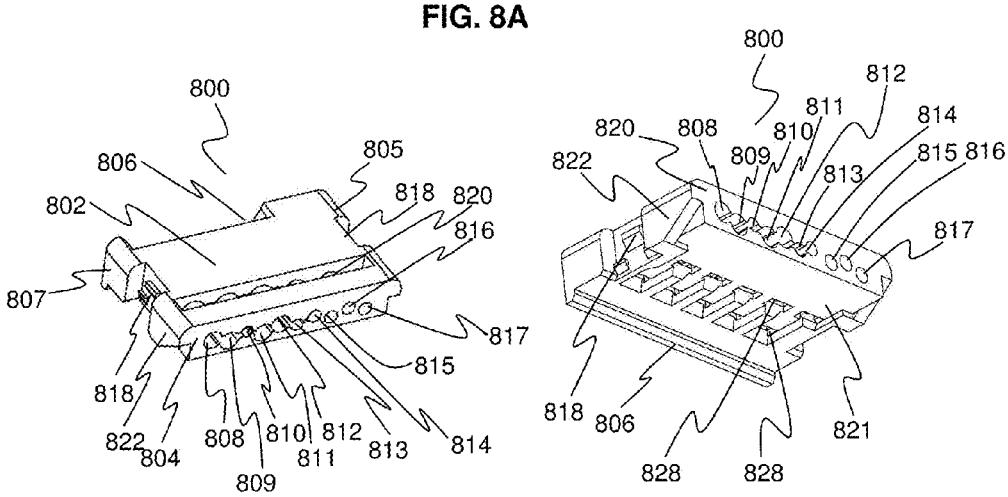
FIG. 8A schematically shows an elevated view down to the front probe end exterior of a top wire holder (left) for a standard HDMI cable and also a view up to the front probe end interior of the same top wire holder (right).

In FIG. 8A, a top view down into the front probe end exterior of a top wire holder 800 is shown in the left panel. A bottom view up into interior the same top wire holder 800 is shown in the right panel. This top wire holder 800 is designed for use with the cognate bottom wire holder 830 and standard, about 19 wire, HDMI cable.

The top wire holder 800 contains a front 804, back 806, left side 807, right side 805, exterior 802 and interior 821 surfaces. An array of ten holes 808, 809, 810, 811, 812, 813, 814, 815, 816, and 817 is formed through the wire holder 800 through which the appropriate wires from a standard HDMI cable can be threaded from the back 806 to front 804 surfaces.

Located on the left 805 and right 807 sides is a larger asymmetrical tab 822 that snaps into place in a cognate receptacle on the bottom compartment base of the connector core that directionally positions and locks the bottom wire holder. The top exterior surface 802 contains an open groove 820 into which the hand tool pre-crimping compression member that is matched to the groove dimensions is inserted to compress the wire holder to prevent movement of the wires and center each wire within the specific hole of the array. The open groove has an internal reverse V-shape inner wall of each hole within the array that moves the conducting wires into the center of each hole.

The interior surface of the top wire holder 821 contains two sets of staggered pin-slots 828 with five being positioned toward the probe end off-set to the right side 807 and five closer the wire terminal end and off-set toward the left side 805 of the top wire holder as viewed oriented facing the probe end. The pin-slots 828 are configured connected with each of the array of holes for the V-shaped metal pins of the connector core to penetrate to contact the conducting wires of the standard HDMI cable (see FIG. 9A, 910, 914; FIG. 9B, 917, 918, 919; FIG. 9C, 911, 912; FIG. 9D, 917, 918, 919).

Figure 8B:
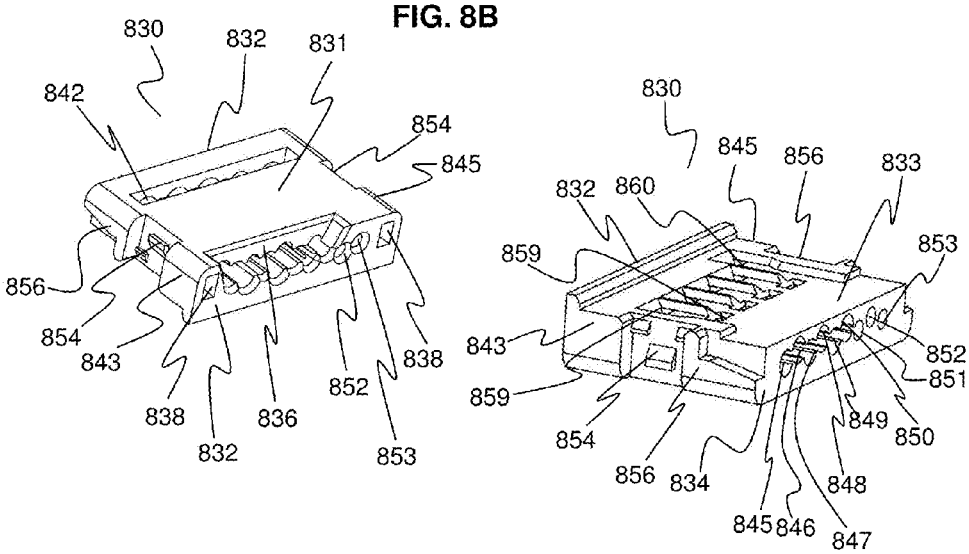
FIG. 8B schematically shows an elevated view down to the back wire terminal end exterior of a bottom wire holder (left) for a standard HDMI cable and also a view down into the front probe end interior of the same bottom wire holder (right).
Figure 8C:
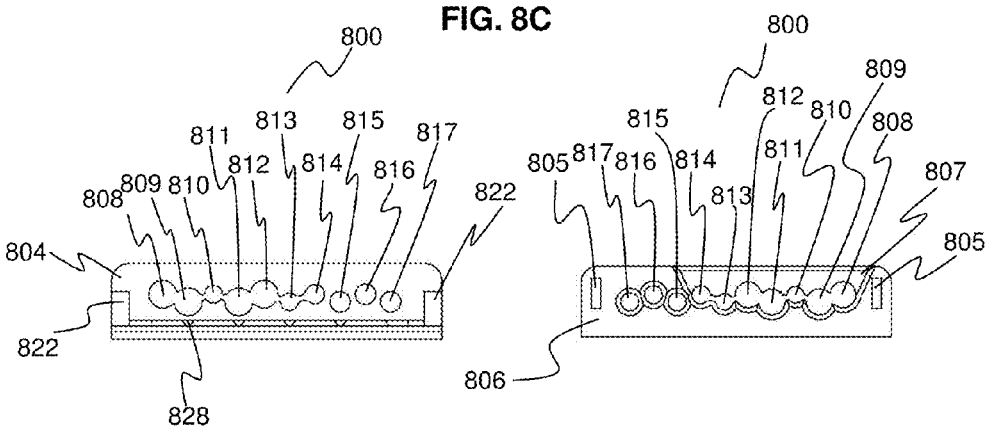
FIG. 8C schematically shows a front probe end view (left) and a back wire terminal end view (right) of a top wire holder (left) for a standard HDMI cable.
Figure 8D:
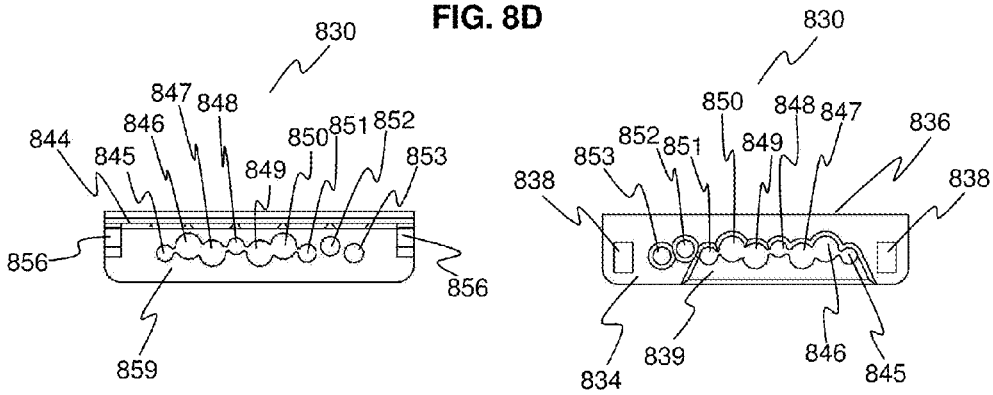
FIG. 8D schematically shows a front end view (left) and back wire terminal end view (right) of a bottom wire holder for a standard HDMI cable.
Figure 8E:
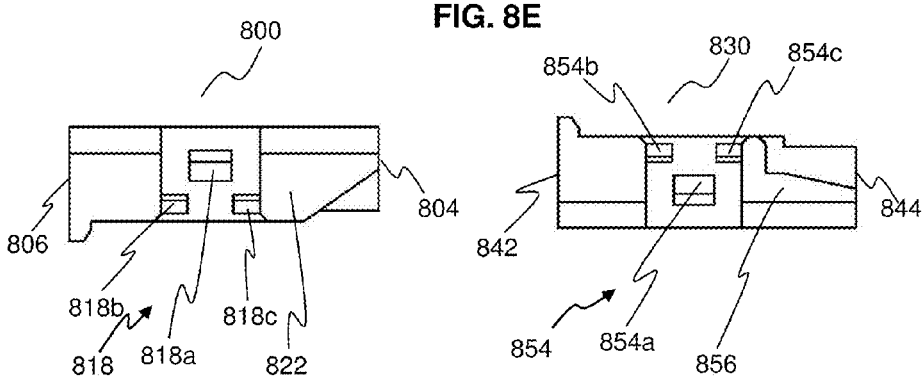
FIG. 8E schematically shows side views of a top wire holder for a standard HDMI cable (left) and bottom wire holder for a standard HDMI cable (right).

The left 805 and right 807 sides of the top wire holder 800 include a top set of clips 818 with a center larger convex block clip 818*a* positioned above two smaller clips 818*b*, 818*c* (see also FIG. 8E). The set of clips 818 are for connecting with a flexible buckle hooking protrusion on the connector core to lock the wire holder into place within the connector core body (see FIG. 9A, 920, 924).

In FIG. 8B an elevated view up to the back wire terminal end of the exterior of a bottom wire holder 830 is shown in the left panel. An elevated view down to a front probe end of the same bottom wire holder 830 is shown in the right panel. This bottom wire holder is for use with the cognate top wire holder 800 and standard, about 19, wire HDMI cable (see FIG. 2, 210).

The bottom wire holder contains a front 834, back 832, left side 845, right side 843, exterior 831, and interior 833 surfaces. An array of holes 845, 846, 847, 848, 849, 850, 851, 852, and 853 is formed through the wire holder 830 through which the appropriate wires from a standard HDMI cable can be threaded from the back 832 to front 834 surfaces.

Located on the left 845 and right 843 sides is a smaller asymmetrical tab 856 that snaps into place in a cognate receptacle on the bottom compartment base of the connector core that directionally positions and locks the bottom wire holder. The top exterior surface 831 contains an open groove 842 into which the hand tool pre-crimping compression member that is matched to the groove dimensions is inserted to compress the wire holder to prevent movement of the wires and center each wire within the specific hole of the array. The open groove has an internal reverse V-shape inner wall of each hole within the array that moves the conducting wires into the center of each hole.

The interior surface 833 of the bottom wire holder 830 contains three sets of staggered pin-slots 859 with four being positioned toward the probe end off-set to the right side and four closer the wire terminal end and off-set toward the left side 845 of the bottom wire holder with a single pin-slot 860 further off-set to the wire terminal end closer to the left side 845, as viewed oriented facing the probe end. The pin-slots 859 are configured connected with each of the array of holes for the V-shaped metal pins of the connector core to penetrate to contact the conducting wires of the top ribbon cable (see FIG. 9A, 910, 914; FIG. 9B, 917, 918, 919; FIG. 9C, 911, 912; FIG. 9D, 917, 918, 919). The set of clips 854 is for connecting with a flexible buckle structure on the connector core to lock the wire holder into place within the connector core body (see FIG. 9A, 920, 924).

In some embodiments the exterior (top) surfaces of either the top or bottom standard wire holders 802, 831 are marked with a molded, embossed, or colored image, for example an arrow, but any molded image or color would suffice for orientation with the sets of conducting wires of proprietary color coded wires. Similarly, the other surfaces including the front 804, 834, back 806, 832 or sides 805, 807, 843, 845 could be marked with a molded or embossed image or with color to orient the top and bottom ribbon cable for threading with top and bottom sets of wires from a standard, about 19 wire, HDMI cable.

In FIG. 8C, the front probe end view is shown in the left panel and a back wire terminal end view is shown in the right panel for the top standard HDMI wire holder 800. In one embodiment the array of ten holes are flush with the front 804 probe end surface while a subset of the seven of the holes, 808, 809, 810, 811, 812, 813, and 814 are counter sunk being recessed from the back 806 wire terminal surface. Having the set of seven counter sunk recessed holes 807 provides for improved and more efficient wire aiming and threading for field terminated DIY connectors as well as factory installations.

In some embodiments the array of holes has three different dimensions of large, medium, and small in order for all of the holes to fit within the confines of the top (and bottom) standard type wire holders. In this embodiment the large diameter is for receiving the conducting signal wires from the twisted pairs while the smallest holes are for receiving naked ground drain wires removing the need to add shrink wrap insulation done in factory installations greatly facilitating the efficiency of field termination of standard HDMI cables.

For example in this embodiment the first and second holes 808, 809, and fourth and fifth 811, 812 would be of the large diameter for conducting signal wires from the twisted pairs while the third 810 and sixth 813 would be of the smallest diameter for naked ground drain wires. The medium sized holes would correspond to the seventh, eighth, ninth, and tenth holes 814, 815, 816, and 817, respectively, being for the other independent conducting signal wires designated for the top wire holder set of wires. In this embodiment the eighth ninth and tenth holes 815, 816, and 817, respectively, are distinct from the other holes having a contiguous inner circumference with and formed from the wire holder body because the diameter of these wire insulators are smaller than the 1.0 mm pitch size of the holes and this allows for a stronger structural strength for the wire holder. The other holes 1-7, 807, form an array where each is partially overlapping because the diameter of each of the conducting wires in the twisted pair of wires are bigger than the 1.0 mm pitch size of the holes.

In FIG. 8D, the front probe end view is shown in the left panel and a back wire terminal end view is shown in the right panel for the bottom standard HDMI wire holder 830. In one embodiment the array of nine holes are flush with the front 844 probe end surface while a subset of the seven of the holes, 845, 846, 847, 848, 849, 850, and 851 are counter sunk being recessed from the back 806 wire terminal surface. Having the set of seven counter sunk recessed holes 836 provides for efficient and improved wire aiming and threading for field terminated DIY connectors as well as factory installations. Embodiments of the bottom wore holder 830 also employ the three sizes of holes (i.e. large, medium, and small) as described above for the cognate top wire holder 800.

For example in this embodiment the first and fourth holes 845, 848, are small for naked ground drain wires. The second, third, fifth, and sixth are large for the conducting signal wires from the twisted pairs 846, 847, 849, 850 while the seventh, eight, and ninth 851, 852, and 853 are of the medium size for the independent conducting signal wires. In this embodiment the eighth and ninth holes 852 and 853 respectively, are distinct from the other holes having a contiguous inner circumference with and formed from the wire holder body because the diameter of these wire insulators are smaller than the 1.0 mm pitch size of the holes and this allows for stronger wire holder strength. The seven other holes 1-7, 839, form an array where each is partially overlapping because the diameter of the conducting wires of the twisted pairs are bigger than the 1.0 mm pitch size of the holes.

In FIG. 8E, a side view of the standard top 800 and bottom 830 wire holders are shown in the left and right panel, respectively. The set of three clips 818, 854 are shown. The large convex blocks 818*a*, 854*a* are located above the two smaller clips 818*b*, 818*c* 854*b*, 854*c*, respectively. These clips mate with a cognate flexible buckle of the connector core for locking the wire holders into the top and bottom base of the connector core (see FIG. 9A, 908). Also visible are the large and small asymmetrical tabs 822, 856, for orienting the top and bottom wire holders into the connector via cognate receptacles (see FIG. 9A, 903, 905).

D. Connector Core

Each of the embodiment ribbon type and standard type top and bottom wire holders described above are designed to assemble with the connector core embodiments described below for DIY and factory installation connector systems.

Figure 9A:
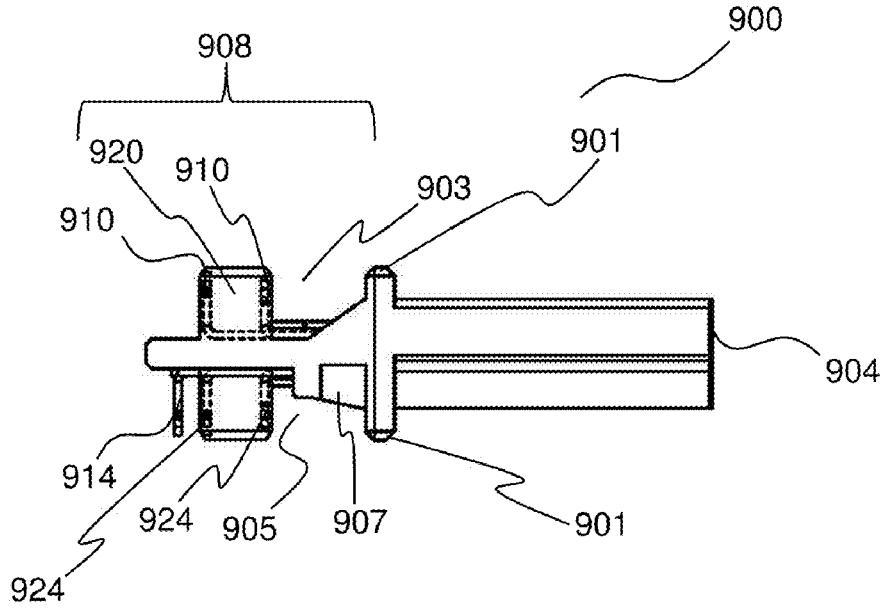
FIG. 9A schematically shows a side view of an insulating connector core with top and bottom V-shaped terminal metal pin sets exposed configured to receive top and bottom wire holders.
Figure 9B:
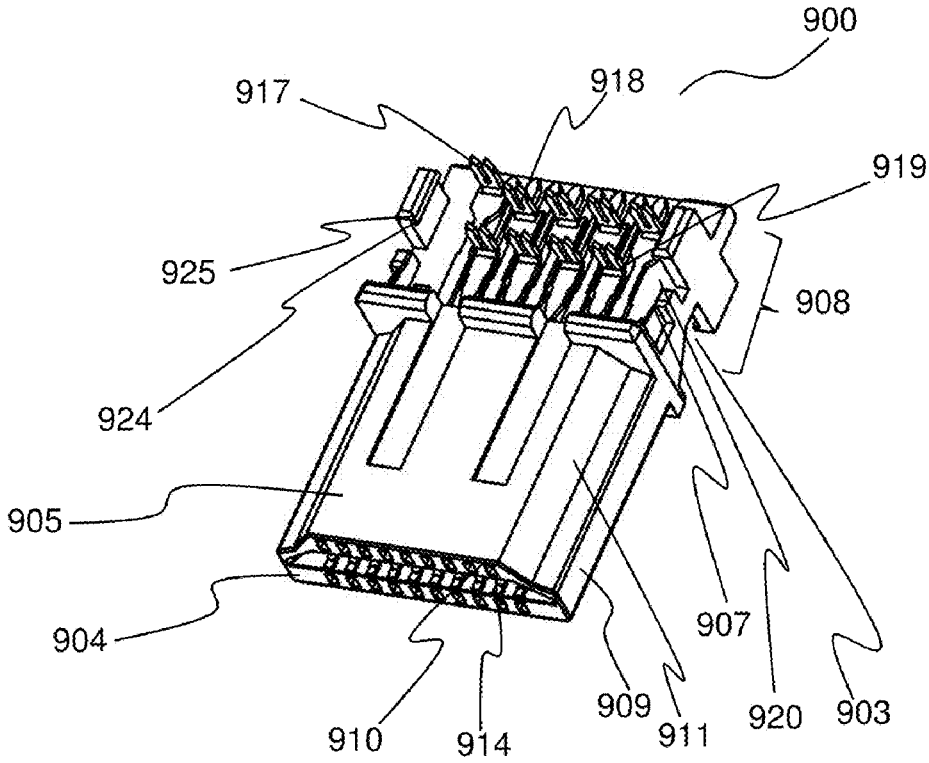
FIG. 9B schematically shows a relief top down view to the bottom of a connector core with the bottom sets of V-shaped terminal metal pins visible.
Figure 9C:
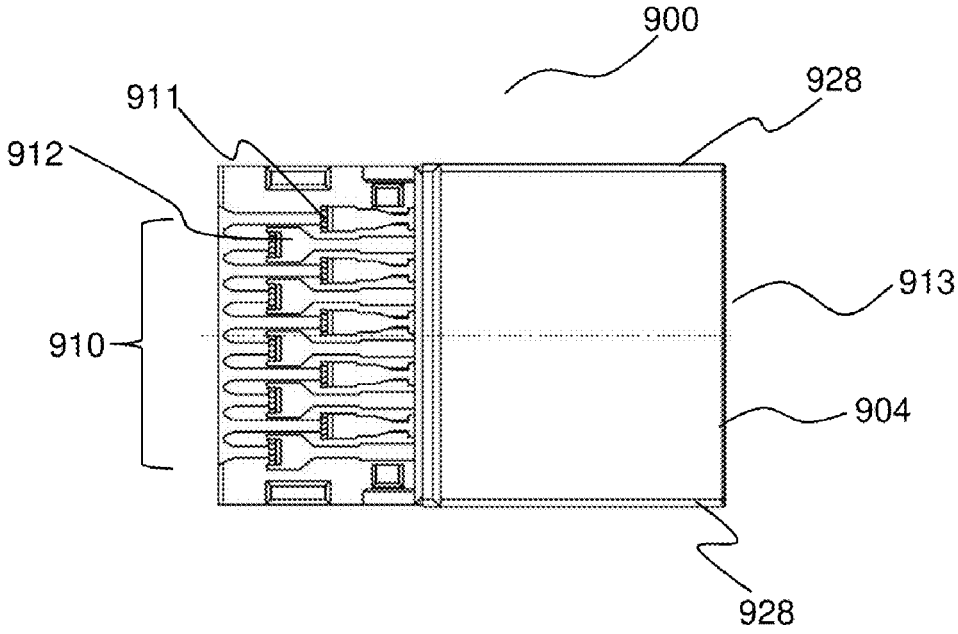
FIG. 9C schematically shows a top view of an insulating connector core with the top sets of V-shaped terminal metal pins exposed.

Referring now to FIG. 9A, FIG. 9B, FIG. 9C, FIG. 9D, FIG. 9E, FIG. 9F, and FIG. 9G schematically shown are different views of a connector core. In FIG. 9A, shown is a side view of an insulating connector core 900 body. The connector core 900 has a probe member end 904 for insertion into a top shell and a back compartment 908 that contains the top sets 910 and bottom sets 914 of metal V-shaped terminal pins. The back compartment 908 is configured to receive the top and bottom wire holders, respectively. Straight metal V-shaped terminal pins 910, 914 containing a bend to increase compressive strength and project into the base that are organized in two 910 or three 914 staggered sets of pins for contacting the conducting signal wires through the pin-slots of the wire holders. A flexible buckle with a top 920 and bottom 924 hooking portion is configured to slide over and mate with the large clip positioned on both the top and bottom wire holders. A top receptacle 903 is positioned to receive the cognate large asymmetrical tab on the top wire holder. A bottom receptacle 905 is positioned to receive the cognate small asymmetrical tab on the bottom wire holder. Another receptacle 907 is configured on each side of the connector core to lock with a cognate tabs on a top shell to lock the connector core assembled subunit with wire holders into the top shell (see FIG. 1, 112; FIG. 10B, 1050). Between the three receptacles 903, 905, 907 and the probe 904 is a dividing wall 901 of the connector core body 900. Together the top and bottom receptacles position and lock the top and bottom wire holders forming a connector core subunit (see FIG. 15A, 1500).

Referring now to FIG. 9B, shown is a relief view of the bottom of the connector core with terminal pins visible. The bottom of the back compartment 908 of the connector core 900 contains the staggered three sets of bottom V-shaped metal terminal pins. One pin 917 projects back furthest to the wire terminal end, followed by a set of four pins 918 positioned in the middle of the compartment with another set of four 919 positioned closer to the probe end. The top compartment contains two sets of five V-shaped metal terminal pins staggered with one set closer to the wire terminal end and the other closer to the probe end (not shown). Each of the top and bottom compartment contain two flexible buckles 925 with smooth inner walls, designed to guide wire holders into position, and a hooking portion 925 configured to be angled at about 70 to about 80 degrees to both easily slide over and mate non-reversibly with a large clip on the corresponding top and bottom wire holder, respectively (see FIG. 7A 720; FIG. 7B, 738; FIG. 7E, 720*a*, 738*a*; FIG. 8A, 818; FIG. 8B, 854; FIG. 8E, 818*a*, 854*a*).

The probe 904 has a bottom surface 905, left and right sides 909 with corresponding angled sides 911 configured to fit within the top shell. The probe 904 insulates the probe end of the top 910 and bottom 914 sets of terminal pins which are exposed for contacting the corresponding pins of a female receptacle.

Referring now to FIG. 9C, shown is a top view of the insulating connector core 900. The top 913 and side 928 surfaces of the probe member end 904 are for insulating the terminal pins and for insertion into the top shell. The top back compartment 908 contains the sets 910 of straight metal V-shaped terminal pins. The two sets of pins are off-set being staggered with one set of five 912 positioned closer to the wire terminal end and the other set of five positioned 911 closer to the probe member end 904. The two sets of straight pins 910 containing the compressive inducing bend are configured to be inserted into the pin-slots of a top wire holder for contacting the conducting signal wires positioned in the wire holders.

Figure 9D:
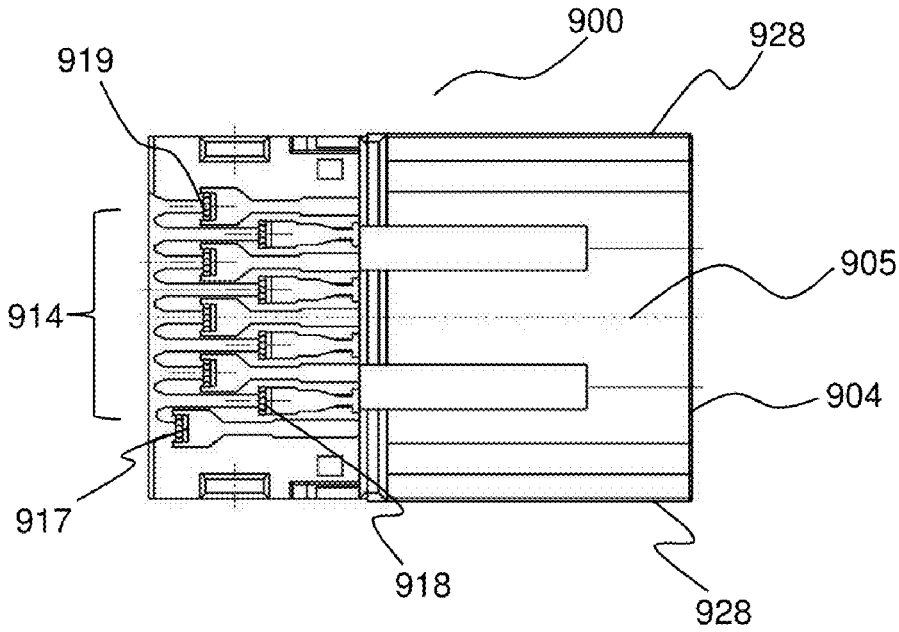
FIG. 9D schematically shows a bottom view of an insulating connector core with the bottom sets of V-shaped terminal metal pins exposed.

Referring now to FIG. 9D, shown is a bottom view of the insulating connector core 900. The bottom 905 and side surfaces 928 of the probe member end 904 is insulation of the terminal pins and for insertion into the top shell. The top back compartment contains the sets 914 of straight V-shaped metal terminal pins. The three sets of pins are off-set being staggered with one pin 917 being positioned closest to the wire terminal end being for the specific pin-slot on bottom wire holders (see FIG. 7B, 742; FIG. 8B, 860). A second set of four pins 918 is positioned closer to the probe member end and a third set of four pins 919 is positioned closer to the wire terminal end. The three sets of straight pins 914 containing the compressive inducing bend are configured to be inserted into the pin-slots of a bottom wire holder for contacting the conducting signal wires positioned in the wire holders.

Figure 9E:
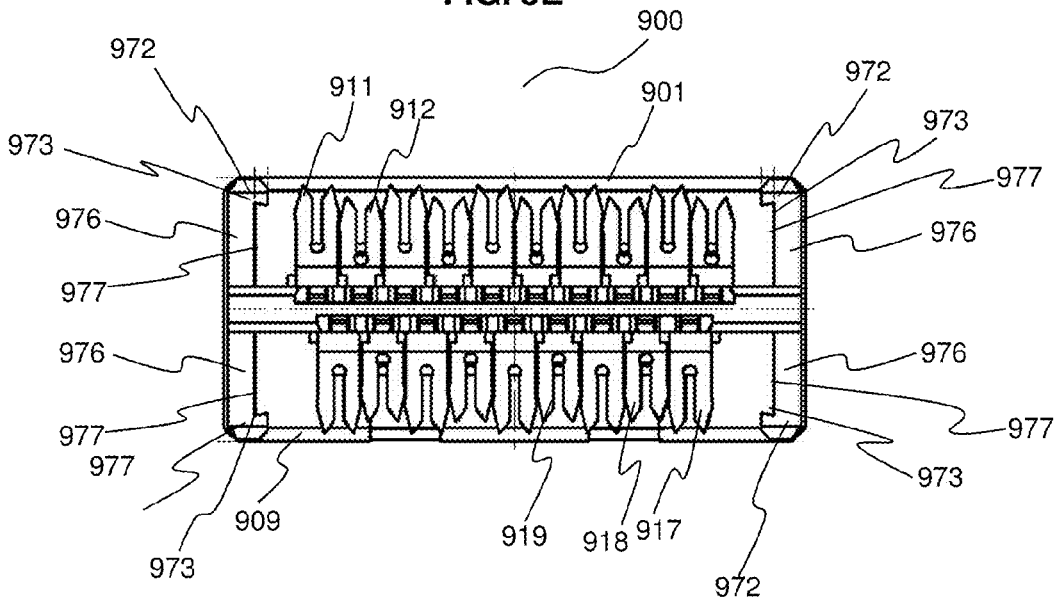
FIG. 9E schematically shows a view into the wire terminal end of a connector core.
Figure 9F:
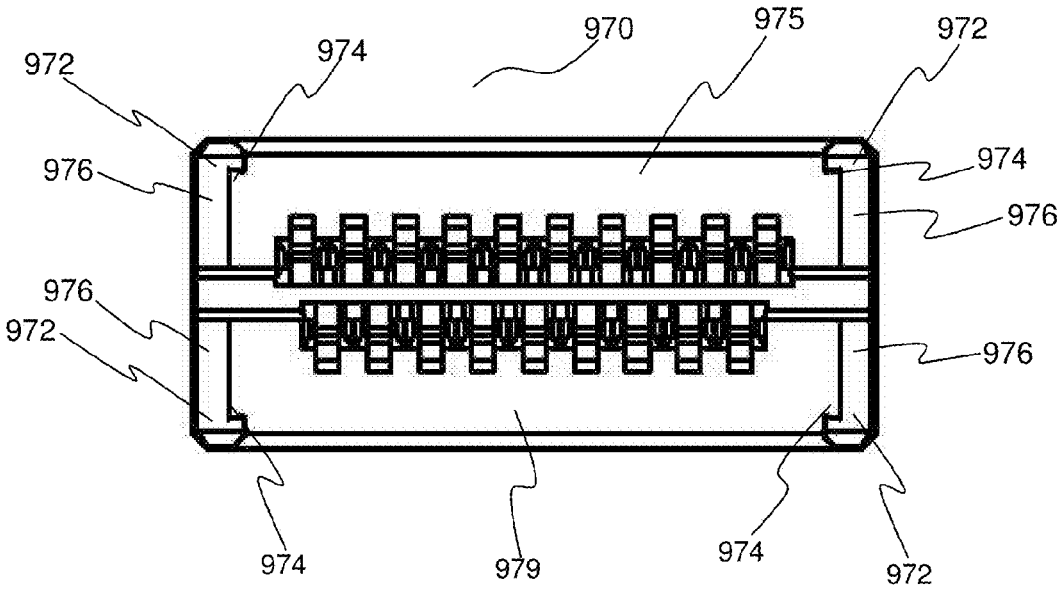
FIG. 9F schematically shows a view into the wire terminal end of an assembled connector and top and bottom wire holder subunit.

Referring now to FIG. 9E and FIG. 9F, schematically shown is the connector core alone and with top and bottom wire holders assembled into a connector core wire holder subunit. In FIGS. 9E and 9F, the connector core 900 and assembled subunit 970 are shown viewed from the wire terminal end. The connector core contains four flexible hooking buckles 976 with two positioned on the top for receiving the top wire holder 975 and two on bottom for receiving the bottom wire holder 979. The wall 977 of each buckle is smooth facilitating the guiding of the top and bottom wire holders 975, 979 into their respective compartments in the connector core body 900. The buckle hook 972 is configured to have an angled receptacle 973 from about 70 to about 80 degrees with about 75 degrees being preferred to mate non-reversibly with large clips 974 present on the top 975 and bottom 979 wire holders, respectively. The large clips 974 of the top and bottom wire holder are configured to have the flexible buckle wall slide over them and then to mate non-reversibly effectively locking each wire holder into place forming a subunit 970. Each clip is similarly shaped with a cognate protrusion matching the angle on the buckle of about 70 to about 80 degrees with about 75 degrees being preferred.

The non-reversible hook is for field termination of connectors since the non-reversible locking feature eliminates the need for a standard machine hot sealing step performed in factory connector installations to secure the wire holders in the connector core. This improvement makes the field termination both feasible and efficient and was designed to eliminate the hot sealing step which is impractical if not impossible in the field. In some embodiments (e.g. factory installations) the hook is configured to be reversible. In these the receptacle may be about 90 degrees (or greater) which gives some retaining force but that can be overcome when each wire holder is inserted or removed. Such embodiments allow repositioning of the wire holders while the technician performs the hot sealing step locking the connectors into place.

Figure 9G:
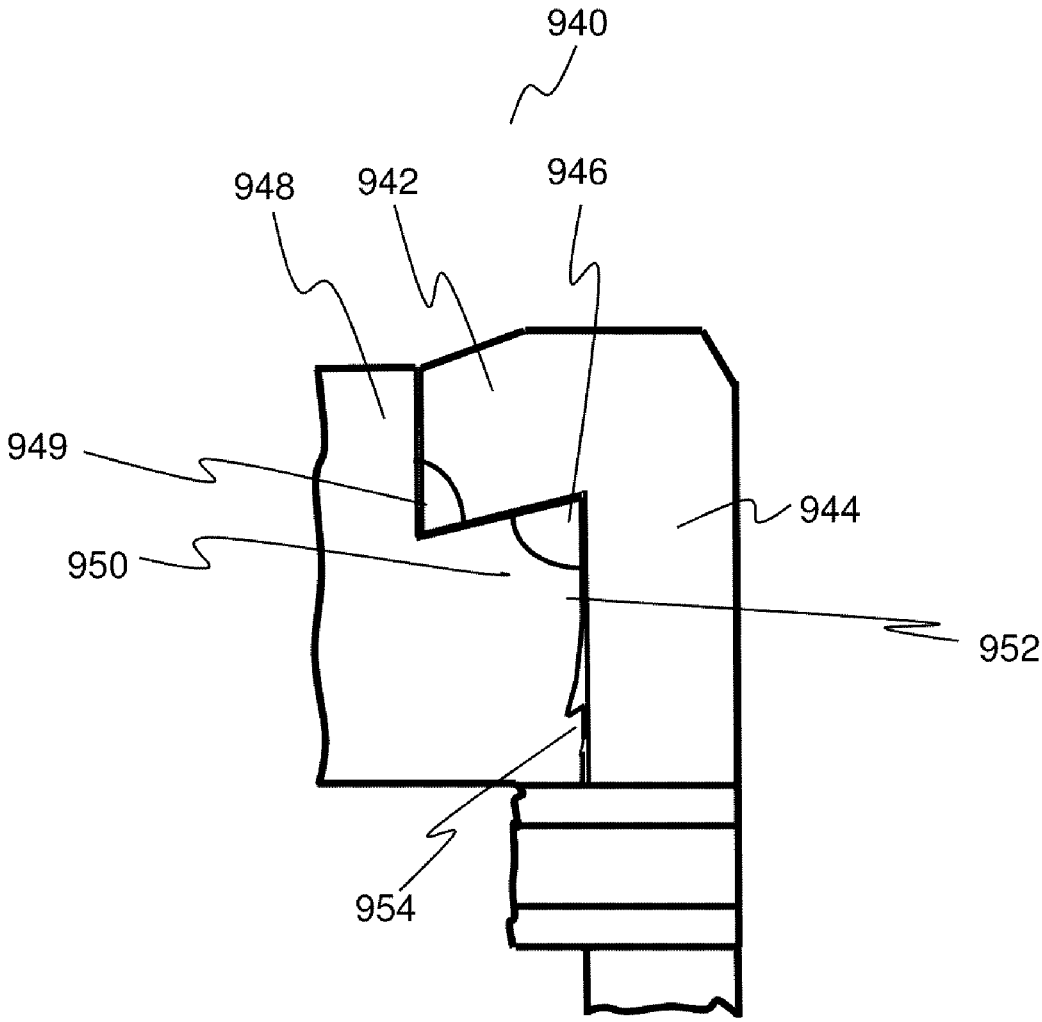
FIG. 9G schematically shows an exploded view of an example embodiment of the junction between a connector core flexible buckle hooking protrusion and a clip protrusion of a wire holder.

Referring now to FIG. 9G, schematically shown is an expanded view of a representative flexible hooking buckle 940 of a connector core mated non-reversibly with the large clip 950 of a wire holder 948. In preferred embodiments the hooking portion is configured to have an angle of about 75 degrees. The wire holder 948 is configured to also have a cognate receptacle 949 of about 75 degrees. The hooking buckle 942 and large clip 950 are positioned such that when the wire holder 948 is inserted into the connector core the flexible smooth wall 944 of the flexible buckle 940 flexes sliding over the small 954 and large 950 clips of the wire holder and when mated the wire holder buckle connection becomes non-reversible.

Once mated the cognate hook and receptacle are non-reversibly mated effectively locking the wire holder into the connector core. The locking of the wire holder into the connector core is desirable for field termination and is designed to eliminate the need for a machine mediated hot sealing step used to ensure each wire holder is secured within the connector core.

In some embodiments the hooking buckle is angled at an angle of less than 90 degrees 946 to be non-reversible. In other embodiments the hooking buckle is angled at about 70 to at out 80 degrees. In preferred embodiments the hooking buckle may be angled at about 71, about 72, about 73, about 74, about 75, about 76, about 77, about 78 about 79 and about 80 degrees. In these same embodiments the receptacle of the large clip is similarly configured to be at less than 90 degrees; at about 70 to at out 80 degrees; and at about 71, about 72, about 73, about 74, about 75, about 76, about 77, about 78, about 79, and about 80 degrees.

In still other embodiments where reversibility of the mating of the connector core flexible buckle and the wire holder clip is desired (e.g. factory installation) the angle of the hooking portion and clip receptacle can be made at 90 degrees or greater where insertion or retraction of a wire holder can overcome the retention force of the mated hook and clip. In these embodiments the set of two smaller clips present on top and bottom wire holders serve to guide and allow an intermediate configuration where wither insertion or retraction can be performed.

For the terminal pins of the male probe of an HDMI connector the pitch distance is set by specifications at about 1.0 mm where the male pins contact the pins of the female connector. However, the pitch distance between terminal pins from the male connector core to the contact point can be varied. In these embodiments the pitch distance between pins can also be from about 0.4 mm to about 2.0 mm. Specific terminal pins can have pitch distances between pins from the wire terminal end into the probe that vary until the about 1.0 mm distance. These embodiments of connector core configurations minor the above pitch distances for the conducting wires. Specific embodiments have conducting wires with pitch ranges of about 0.4 mm to about 0.5 mm; about 0.5 mm to about 0.6 mm; about 0.6 mm to about 0.7 mm; about 0.8 to about 1.0 mm; 1.0 mm to about 1.1 mm; about 1.1 mm to about 1.2 mm; about 1.2 mm to about 1.3 mm; about 1.3 mm to about 1.4 mm; about 1.4 mm to about 1.5 mm; about 15 mm to about 1.6 mm; about 1.6 mm to a about 1.7 mm; about 1.7 mm to about 1.8 mm; about 1.8 mm to about 1.9 mm; and about 1.9 mm to about 2.0 mm. In such alternate embodiments the connector core would have bent pins that are placed precisely in the connector core to connect to the wires and probe end pins or straight pins on both probe and terminal ends and connected via a Printed Circuit Board (PCB) where the traces on the PCB connect pin to pin and adapt to different pitch sizes of the two ends.

E. Top Shell

An assembled connector core and wire holder subunit is inserted into a top shell. Embodiments of different top shells are described to highlight features below.

Figure 10A:
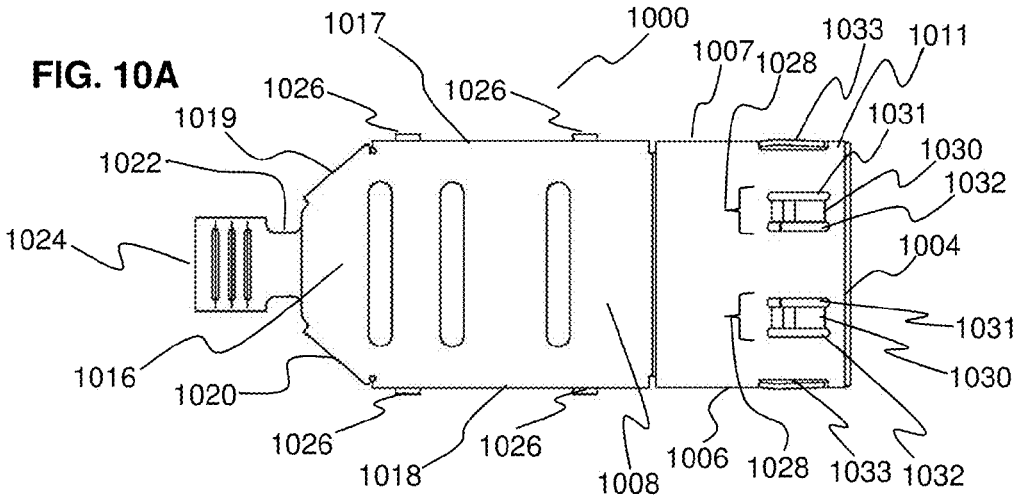
FIG. 10A schematically shows a top view of a top shell for a male connector with retention springs.
Figure 10B:
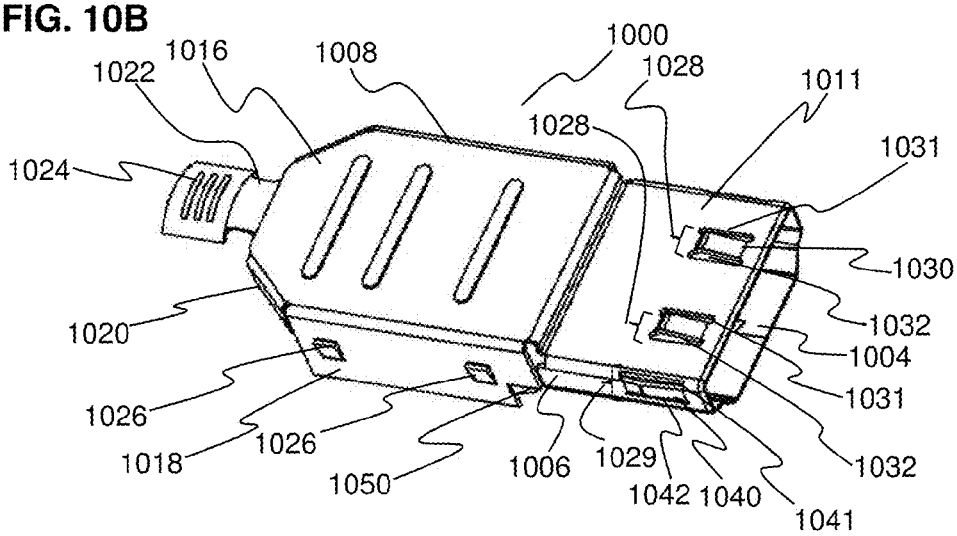
FIG. 10B schematically shows a relief top side view of a top shell for a male connector with retention springs.
Figure 10C:
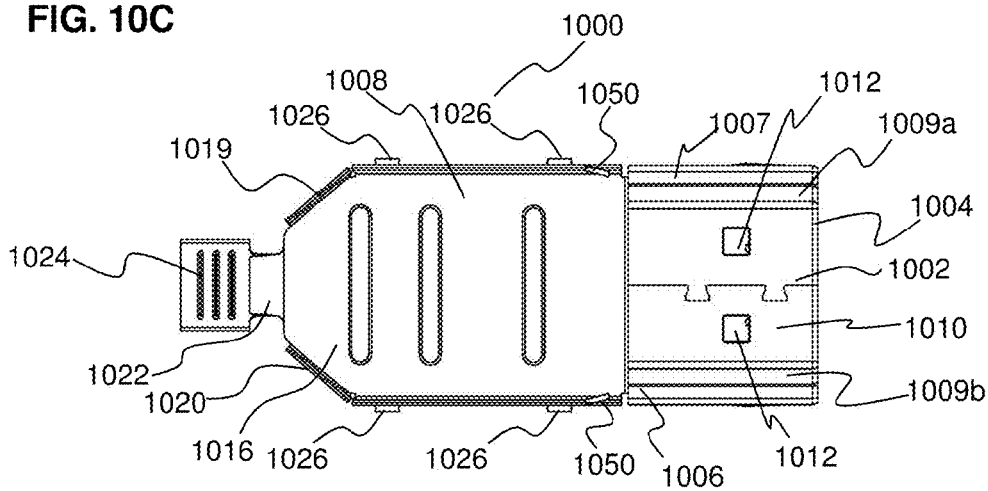
FIG. 10C schematically shows a bottom view of a top shell for a male connector.

Referring now to FIG. 10A, FIG. 10B, and FIG. 10C, schematically shown are top view, relief top side view, and a bottom view, respectively. The top shell 1000 contains a probe plug member 1004 for surrounding internal connector components and for mating with a cognate female receptacle for signal transmission. The top shell 1000 includes an open base with an extended portion serving as strain relief tabs 1024 connected to the base by a connecting member 1022 for tightly wrapping around a cable wire jacket to serve as strain relief. In some embodiments the extended portion for strain relief tabs is "T" shaped. The open base consists of a rectangular main compartment 1008 and trapezoidal end 1016. First 1017 and second 1018 sides are parallel to each other and perpendicular to the rectangular base 1016 and a third 1019 and fourth 1020 side flank the trapezoidal end 1016. The first 1017 and second 1018 sides have two tabs 1026 for locking with cognate receptacles on a bottom shell. The probe member contains a first 1006 and second 1007 angled sides 1009*a*, 1009*b* and bottom surface 1010 with HDMI optional square holes 1012 for encasing the probe member of the insulating connector core. In some embodiments the bottom surface meets at a seam 1002 and contains two locking receptacles 1008 for mating with tabs in the cognate female receptacle. A set of two tabs 1050 are configured on the first 1017 and second 1018 sides near the probe end to mate with cognate receptacles on the insulating connector core to lock the connector core into the top shell (see FIG. 1, 86; FIG. 9A, 907).

In some embodiments the top shell probe member contains at least one retention spring 1028, 1029 on at least on at least one of the surfaces of the probe member of the top shell 1000. Each of the retentions springs for the probe top surface 1011 further comprises a set of at least one member 1030, 1033 and a set of slots 1031, 1032 cut through the shell probe surface. Each of the retention springs for a side surface of the probe also further comprise a set of at least one member 1040 and a set of slots 1041, 1042 cut through the shell probe surface that form the side of the spring and to separate the spring from the shell so the spring can rise up like a bridge. The slots allow the spring to travel adding flexible distance for a given retention spring. In some embodiments the retention springs may become of a different shape and of different orientation and location from the top surface 1011, bottom surface 1010, and side surfaces 1006 and 1007 (see FIG. 11G-M). The retention spring may include more than one member 1030, 1040 and embodiments may have 1, 2, 3, and 4 or more members (e.g. 6, 8, 10) for some configurations, where the members combine to generate the restraining force when contacting the inner surface of a cognate receptacle.

The retentions springs 1028, 1029 provide for a restraining force to keep the male connector inserted into a female receptacle when compressed against a surface of a cognate receptacle locking the male connector into the female receptacle and eliminating movement in the horizontal and vertical directions. In one embodiment the top surface of the male probe of the top shell contains two retention springs 1028 with one retention spring of different dimension of each side 1029.

In some embodiments the retention spring positioned on the top surface is dimensionally different than a retention spring positioned on a side surface to generate greater or lesser retention forces. In certain embodiments the retention springs are made from or coated with a non-conducting material (e.g. polymer, plastic, or polycarbonate).

Referring now to FIG. 11A, FIG. 11B, FIG. 11C, and FIG. 11D, shown are different embodiments for the configuration of the at least one retention springs 1100, 1110, 1120, and 1130, designed to generate differing retention force. In FIG. A-C, a retention spring of a pyramid shape with two fixed points with the shell surface provides the retention force. By varying the shape and height and position of the pyramid structure of the retention springs these different embodiments generate differing retention forces.

Figure 11A:
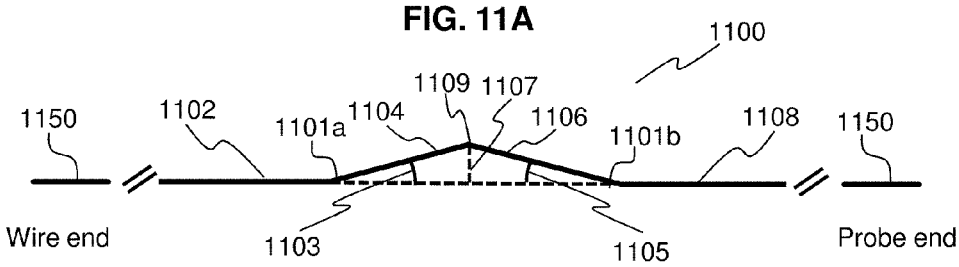
FIG. 11A schematically shows embodiments for retention springs where the second and third member are approximately equal in length and the apex ridge in about centered between the fixed points.

In FIG. 11A, the embodiment retention spring consists of a first member 1102 positioned on a surface of the male plug member of the shell that is contiguous with the shell 1150 and a second member 1104. The second member 1104 is elevated at a first angle 1103 relative to the shell surface 1150 and contiguous with the first member 1102. A fixed point 1101*a* between the first 1102 and second 1104 members joins them together. The second member 1104 is contiguous with a third member 1106 where they join at an apex ridge 1109. The third member 1106 lowers at a second angle 1105 relative to the shell surface 1150 to the fourth member 1108 joining with the fourth member at a second fixed point 1101*b*. In this embodiment the second 1104 and third members 1106 are about the same length and the first 1103 and second angles 1105 are about the same placing the apex ridge 1109 about midway 1107 between the fixed points 1101*a* and 1101*b*.

Figure 11B:
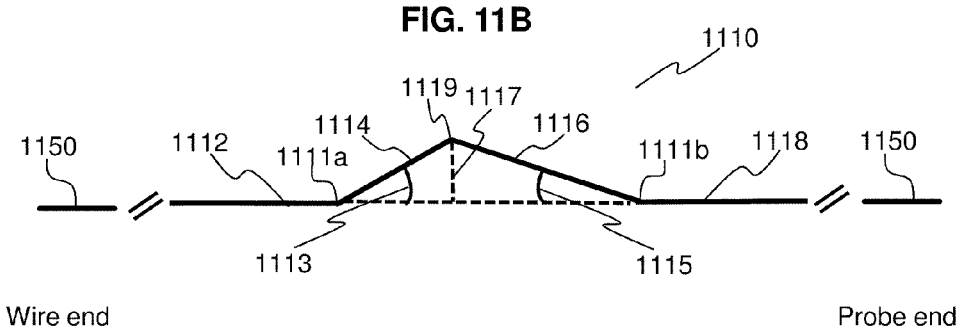
FIG. 11B schematically shows embodiments for retention springs where the second member is shorter than the third member and the apex ridge is closer to the first fixed point.

In FIG. 11B, the relationship of the four members 1112, 1114, 1116, and 1118 is similar except that the second member 1114 is shorter than the third member 1116 and the first angle 1113 is larger than the second angle 1115. In this embodiment the apex ridge 1119 is closer 1117 to the first fixed point 1111*a* than the second fixed point 1111*b*. Generally, retention springs of this embodiment would generate more retention force when the male plug with such retention springs is moving from right to left (i.e. pulling out the connector) than moving from left to right (i.e. inserting the connector) because the member 1114 is a shorter and steeper slope then member 1116.

Figure 11C:
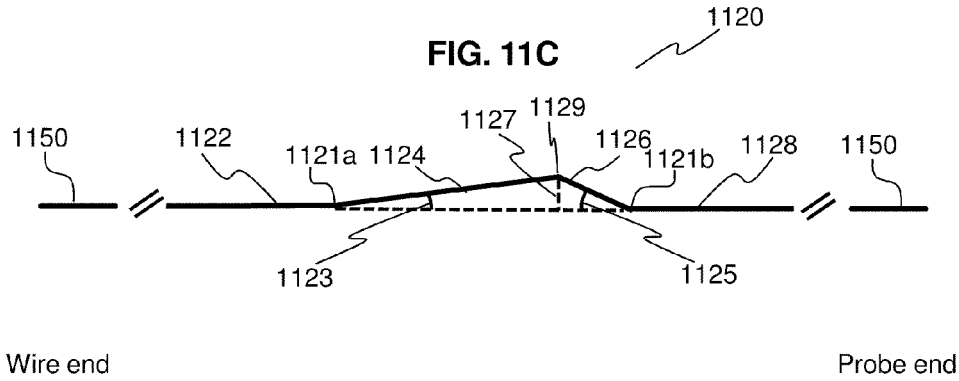
FIG. 11C schematically shows embodiments for retention springs where the second member is longer than the third member and the apex ridge is closer to the second fixed point.

In FIG. 11C, the relationship of the four members 1122, 1124, 1126, and 1128 is the similar except that the second member 1124 is longer than the third member 1126 and the first angle 1123 is smaller than the second angle 1125. In this embodiment the apex ridge 1129 is closer 1127 to the second fixed point 1121*b* than to the first fixed point 1121*a*. Generally, retention springs of this embodiment would generate less force when the male plug with such retention springs is moving from right to left (i.e. pulling out the connector) than moving from left to right (i.e. inserting the connector) because member 1124 is a longer and more gradual slope than member 1126.

One skilled in the art would recognize the number of retention springs is only limited by the surface area of the top shell plug member and the overall dimension of the retention spring. In some embodiments the retention spring has an outer dimension of about 7.0 mm in length with a width of about 2.0 mm with a first and second angle between about 1 to about 40 degrees. Embodiments within these dimensions include one, two, three, and four or more retentions springs on a surface of a top shell plug member and one, two, or even three on a side.

Embodiments include retention springs where the outer dimensions of the length and width of the retention spring is about 2.5 mm to about 3.7 mm by about 1.0 mm to about 1.4 mm measured from the slots through the shell surface flanking each pyramid structure. In another embodiment the retention spring includes an outer dimension of about 3.2 mm to about 4.2 mm in length, about 0.8 mm to about 1.2 mm, with a first angle of about 1 to about 3 degrees and the second angle of about 3 to about 7 degrees. In still other embodiments the retention spring includes an outer dimension of about 2.5 mm to about 3.0 mm in length, about 1.2 mm to about 1.5 mm in width, with a first angle of about 7 to about 10 and a second angle of about 26 to about 32 degrees.

In some embodiments the retention spring may be larger having an outer dimension of length and width about 3.54 mm to about 5.0 mm by about 1.44 mm to about 5.0 mm measured from the slots through the shell surface flanking each pyramid structure. In other embodiments the retention spring may be smaller having an outer dimension of length and width about 1.0 mm to about 2.5 mm by about 0.5 mm to about 1.05 mm measured from the slots through the shell surface flanking each pyramid structure. For some embodiments the first angle can be from about 1 to about 30 degrees with about 2 degrees to about 5 degrees; about 5 degrees to about 10 degrees; about 10 degrees to about 15 degrees; about 15 degrees to about 20 degrees; and about 25 degrees to about 30 degrees. In specific embodiments the first angle can be about 26 degrees; about 27 degrees; and about 29 degrees.

In specific embodiments the retention spring parameters of the length and width of the second member and third member and first and second angle are set. In a first embodiment the retention spring has a second member with a length of about 0.8 mm to about 1.1 mm and width of about 0.8 mm to about 1.0 mm. In this embodiment the third member has a length of about 2.0 mm to about 2.4 mm and a width of about 0.8 mm to about 1.2 mm. The first angle of this embodiment is set at about 7.1 degrees to about 10.1 degrees and the second angle is set at about 2.9 degrees to about 4.9 degrees.

In a second embodiment the retention spring has a second member with a length of about 1.1 mm to about 1.5 mm and width of about 1.0 mm to about 1.3 mm. In this embodiment the third member has a length of about 2.7 mm to about to about 3.0 mm and a width of about 0.6 mm to about 1.0 mm. The fist angle of this embodiment is set at about 5.4 degrees to about 8.6 degrees and the second angle is set at about 2.2 degrees to about 3.2 degrees.

In a third embodiment the retention spring has a second member with a length of about 1.1 mm to about 1.5 mm and width of about 0.9 to about 1.2 mm. In this embodiment the third member has a length of about 1.5 mm to about 2.0 mm and a width of about 1.2 mm to about 1.4 mm. The first angle of this embodiment is set at about 11.3 degrees to about 14.3 degrees and the second angle is set at about 11.3 degrees to about 14.3 degrees.

In a fourth embodiment the retention spring has a second member with a length of about 0.6 mm to about 0.7 mm and width of about 0.7 mm to about 1.2 mm. In this embodiment the third member has a length of about 1.9 mm to about 2.4 mm and a width of about 1.1 mm to about 1.2 mm. The first angle of this embodiment is set at about 24.6 degrees to about 26.6 degrees and the second angle is set at about 5.1 degrees to about 7.1 degrees.

In a fifth embodiment the retention spring has a second member with a length of about 1.2 mm to about 1.4 mm and width of about 0.9 mm to about 1.5 mm. In this embodiment the third member has a length of about 3.1 mm to about 3.5 mm and a width of about 1.3 mm to about 1.5 mm. The first angle of this embodiment is set at about 16.4 degrees to about 18.4 degrees and the second angle is set at about 4.5 degrees to about 6.5 degrees.

In similar embodiments the second angle can be from about 1 degree to about 2 degrees; about 2 to about 3 degrees; about 3 to about 4 degrees; about 4 to about 5 degrees; about 5 to about 6 degrees; about 6 to about 7 degrees; about 7 to about 8 degrees; about 8 to about 9 degrees; and about 9 to about 10 degrees. In certain embodiments the second angle is from about 2 to about 5 degrees. One skilled in the art would recognize once the lengths of the second and third members are set and either the first or second angle is chosen the other corresponding angle is set and can be calculated.

In some embodiments the length and width of members of the retention springs and first and second angles would generate a range of retention forces and are contemplated as added embodiments. In some embodiments the ratio of lengths of the second and third members is about 0.2 to about 5.0. In other embodiments the ratio of the lengths of the second member to the lengths of the third member can be about 4:1; about 3:1; about 2:1; and about 1:1. Such rations make it easier to push in the male connector with the retentions springs than to pull the same connector out of a female HDMI receptacle. If the ratios of lengths of the second member to the lengths of the third member are reversed (i.e. 1:4; 1:3; 1:2) the male connector with the retention springs would be harder to push in and easier to pull out. Such alternate embodiments would be desirable mainly when a quick or easier disconnect feature is required given that some restraining force would be required just less than with the reverse ratio retention springs.

In some embodiments the second member can be from about 0.2 mm to about 0.4 mm; about 0.4 mm to about 0.6 mm; about 0.6 mm to about 0.8 mm; about 0.8 mm to about 1.0 mm; about 1.0 mm to about 1.2 mm; and about 1.2 mm to about 1.4 mm in length. In these embodiments the third member can be about 2.0 mm to about 2.2 mm; about 2.2 mm to about 2.4 mm; about 2.4 mm to about 2.6 mm; about 2.6 mm to about 2.8 mm; and about 2.8 mm to about 3.0 mm in length.

In one embodiment the rise in height of the apex ridge is about 0.05 mm to about 0.154 mm; about 0.3 mm to about 0.5 mm; and about 0.15 mm to about 0.34 mm relative to the shell surface. Some embodiments have an apex ridge with a height of about 0.1 mm to about 0.15 mm; about 0.15 to about 0.20 mm; about 0.20 mm to about 0.25 mm; about 0.25 mm to about 0.30 mm; about 0.30 mm to about 0.35 mm; and about 0.35 to about 0.40 mm. Specific embodiments encompass an apex ridge of a height that would exert a maximal force before distorting the shape or structure of the female receptacle depending on composition, being made of metal or other materials.

In certain embodiments the retention spring or springs generates a restraining frictional force of at least about 1.5 kg (3 lbs) to about 10 kg (20 lbs) that would be required to remove a male connector from a female receptacle. In specific embodiments the retention spring or springs generates a restraining frictional force of at least about 1.5 kg to about; about 3.0 kg to about 5.0 kg; about 5 kg to about 7.5 kg; about 7.5 kg to about 10 kg, would be required to remove a male connector from a female receptacle.

Male connector embodiments that generate restraining forces of up to about 15 kg (about 30 lbs) have a built in safety feature since if the cable is kicked or pulled where the male connector is connected to a female receptacle the male connector will separate from the female receptacle preventing damage to the electronic devices that are connected. Generally, with standard circuit boards a force of about 18 kg (about 40 lbs) is required to break the board. In most cases this is undesirable since a male connector that requires such a force to remove risks damage to any electronic devices that utilize the connector. However in some cases such as with field work or where the support board holding the female receptacle or circuit board is made stronger, male connectors that require greater force to remove would be contemplated.

In these embodiments where the support shell holding the female receptacle is strong or where field work requires greater restraining forces to prevent unplugging of the connector the retention springs that generate a restraining force of about 10 (about 20 lbs) to about 15 kg (about 30 lbs); and about 15 kg (about 30 lbs) to about 20 kg (about 40 lbs) would be required to remove a male connector from a female receptacle.

In certain applications the top shell and retention springs may be composed of or coated with a composite polymer or plastics where elimination of conducting potential is desired. In other embodiment the top shell and retention springs are made of metal and are thus conducting surfaces.

Figure 11D:
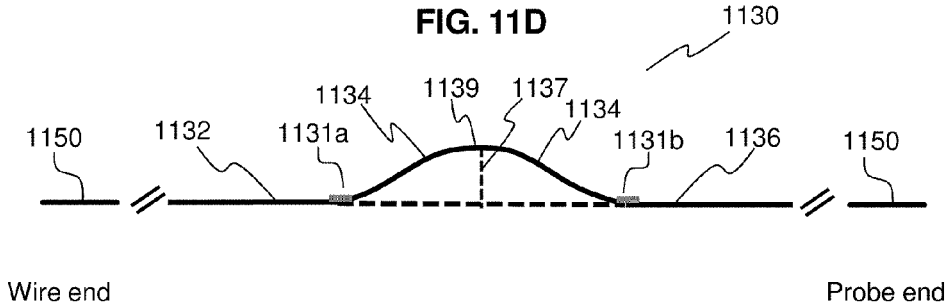
FIG. 11D schematically shows embodiments for retention springs of a dimple domed design where the member is a convex arc.
Figure 11E:
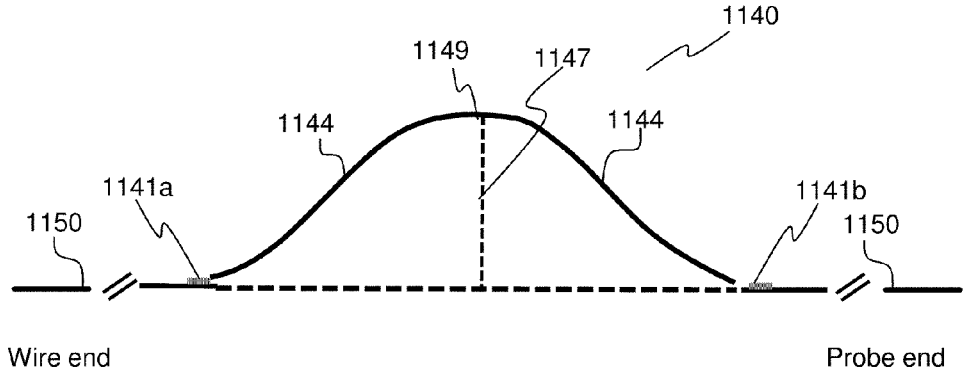
FIG. 11E schematically shows embodiments for retention springs of a dimple domed design where the member is a convex arc with a broad dome.
Figure 11F:
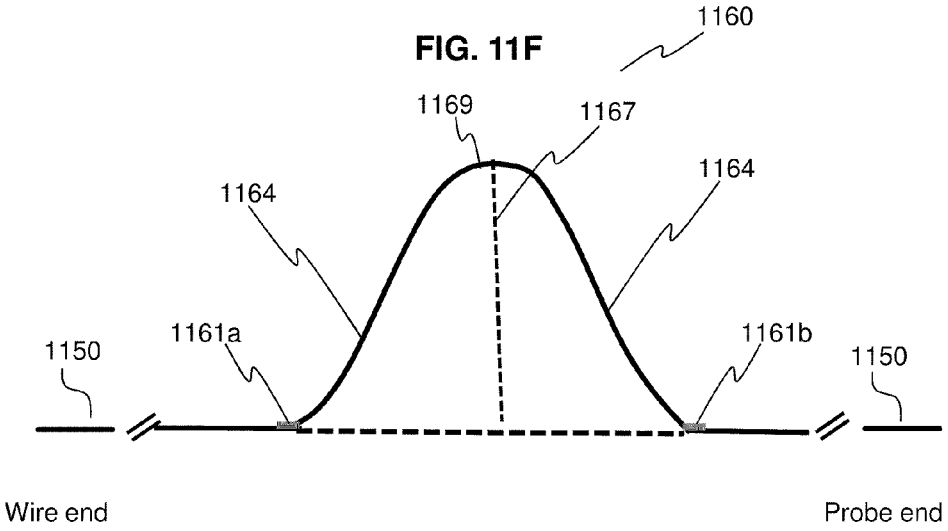
FIG. 11F schematically shows embodiments for retention springs of a dimple domed design where the member is a convex arc with narrow dome.

In FIG. 11D, FIG. 11E, and FIG. 11F, as well as in FIG. 11G-J, alternate embodiments of a retention spring structure are shown instead of a pyramid structure these retention springs comprise a raised dome or dimple like configuration. In FIG. 11D, for this embodiment the top shell plug member 1150 contains at least one retention spring 1130 on at least one surface where the retention spring consists of a convex member 1134 fixed at a first 1131*a* and second 1131*b* point with the top shell 1132, 1136. A set of slots cut through the shell and form part of the retention spring being in line with the fixed sectional points. In this embodiment the highest portion 1137 of the arc 1139 of the convex member which forms a dome shape and is for contacting the inner surface of a female receptacle and generates the restraining frictional force when compressed eliminating movement in the vertical or horizontal direction for a male connector when mated in a female receptacle.

In FIG. 11E, for this embodiment the top shell plug member contains at least one of this type of retention spring 1140 on surface of the probe 1150. The convex member 1144 is broader at the apex 1149 so that the dome structure of the arc of the convex member 1144 is both higher 1147 and of a larger diameter as measured from the fixed points 1141*a*, 1141*b* (or slots).

In FIG. 11F, for this embodiment the top shell plug member contains at least one of this type of retention spring 1160 on surface of the probe 1150. The convex member 1164 is more narrow at the apex 1169 so that the dome structure of the arc of the convex member 1164 is both higher 1167 and of a smaller diameter as measured from the fixed points 1161*a*, 1161*b* (or slots).

Figure 11G:
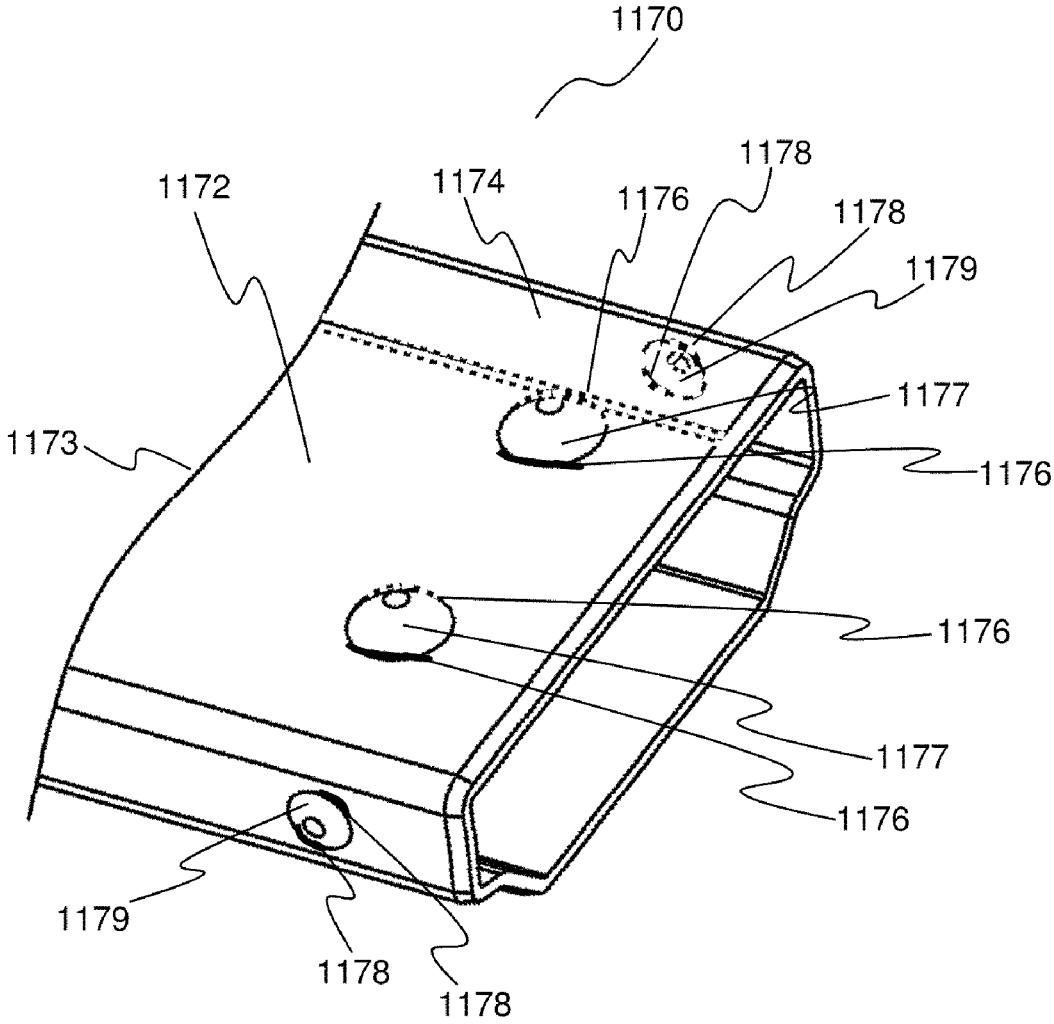
FIG. 11G schematically shows a relief top down view of embodiments for a male probe with dimple domed type retention springs.

Referring now to FIG. 11G, the male probe member of a top shell is shown with two dimple type retention springs positioned on its surface. The top shell 1170 is shown from the edge of the base 1173 to the probe end with two dimple type retention springs formed from a convex member 1177 on the top surface 1172 and one retention spring formed from a convex member 1179 of a different diameter on each of the right and left side surfaces 1174. Each retention spring is shown with a set of four slots 1176, 1178 and fixed sectional points that form the base of each retention spring being cut through the top shell which provide for travel of the convex member allowing the dome of each spring to flex and travel. The portions of the base that abut the slots form the fixed points on these retention springs. The dome structure is for contacting the inner surface of a female receptacle and can flex or travel based on the slot and fixed sectional points.

Figure 11H:
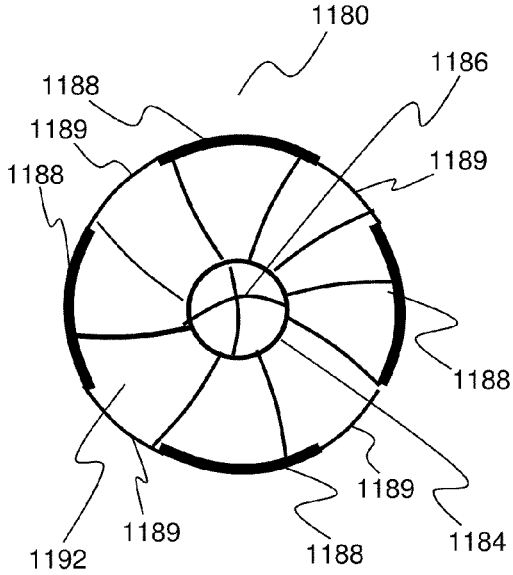
FIG. 11H schematically shows a top down view of embodiments for a dimple domed type retention springs with a set of four slots and fixed sectional points.
Figure 11I:
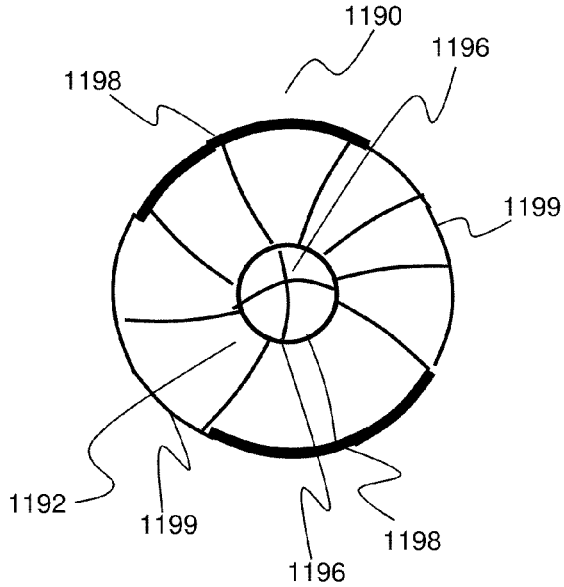
FIG. 11I schematically shows a top down view of embodiments for a dimple domed type retention springs with a set of two slots and fixed sectional points.

Referring now to FIG. 11H and FIG. 11I, schematically shown are top views of two embodiments of the dimple or dome type retention spring. In FIG. 11H the retention spring 1180 contains four slots 1188 with four corresponding fixed sectional points 1189 that form the base of the spring. The convex member 1192 can travel or flex based on the slot and fixed sectional point configuration. In FIG. 11I, the retention spring 1190 contains two slots 1198 with two corresponding fixed sectional points 1199 that from the base of the spring. The combination of slots and fixed sectional points alter the travel and flexibility of the spring. In different embodiments the slots and fixed points may be made equal or can differ in degree as measured from a center axis point of the spring.

Figure 11J:
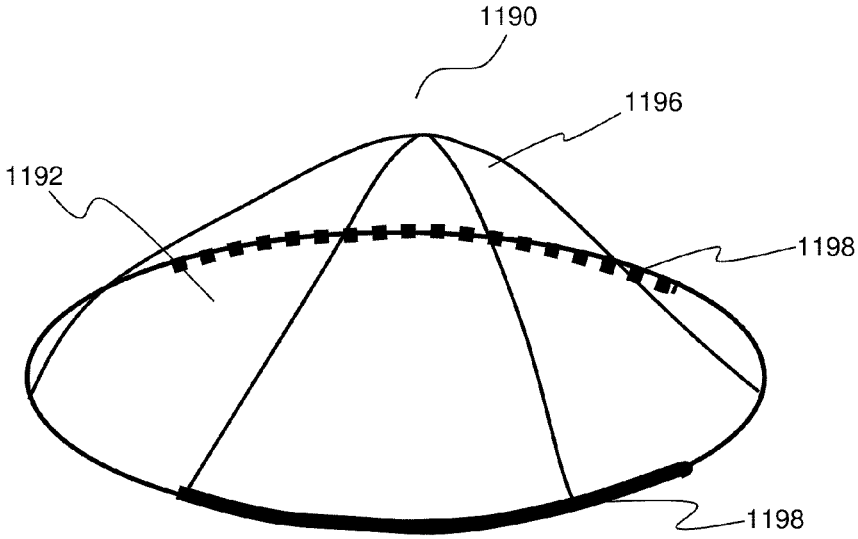
FIG. 11J schematically shows a relief top down view of the retention spring of FIG. 11I.

Referring now to FIG. 11J, schematically shown is a relief view of a representative dimple or dome type retention spring from FIG. 11I. The retention spring 1190 has a dome 1196 that is formed from the arc of the convex member 1192.

The dome structure of different dimple type retention springs provides for the contact with the female receptacle and can be narrow or broad depending on the retention force desired. Generally, the smaller the vertical travel of the convex arc or dome when contacting the inner surface of a female receptacle the smaller the retention force that would be generated. Thus, the restraining for can be adjusted by both the overall diameter and height of retention spring of the dimple type.

In embodiments where the retention spring is a circular or a dimple configuration the diameter of the convex member is about 1 mm to about 2 mm; about 2 mm to about 3 mm; about 3 mm to about 4 mm; and about 4 mm to about 5 mm. In specific embodiments the diameter of an approximately circular member is from about 0.30 mm. to about 0.50 mm; about 0.15 mm. to about 0.34 mm. In some embodiments the shape of the at least one convex member is oval with a length from about 0.30 mm. to about 1.50 mm and a width from about 0.05 mm to about 0.5 mm.

Figure 11K:
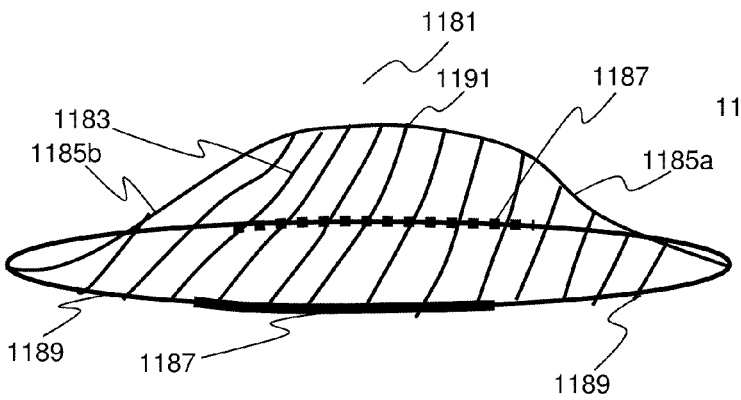
FIG. 11K schematically shows a relief top down side view of an elongated oval shaped retention spring.
Figure 11L:
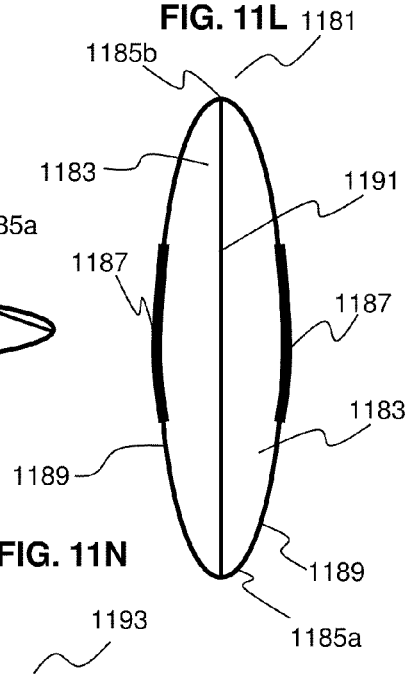
FIG. 11L schematically shows a top view of an elongated oval shaped retention spring.

Still other shaped retention springs are contemplated and are shown schematically in FIG. 11K-O. In FIG. 11K, an approximately oval shaped retention spring is shown. The oval retention spring 1181 is formed from an elongated convex member 1183 that has two sides 1189 and a front 1185*a* and back 1185*b* that slope up to the apex arc 1191 of the convex member. The retention spring is shown with two slots 1187 and fixed sectional points 1189 of unequal dimension where the fixed sectional points encompass the front and back of the retention spring. In some embodiments the slots and fixed sectional points could be moved relative to each other or be equal in size and present as 3, 4, 6, or more slots or fixed points. In FIG. 11L, a top view of the oval retention spring of FIG. 11K is shown. The sides of the convex member 1183 are elongated along the base formed from the slots 1187 and fixed sectional points 1189. Generally, this type of retention spring embodiment would be inserted with the narrow end 1185*a* towards the female receptacle.

Figure 11M:
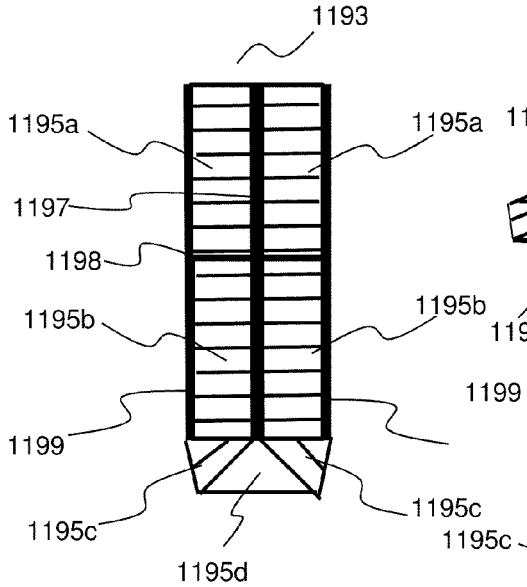
FIG. 11M schematically shows a top view of an alternate angled tent shaped retention spring.
Figure 11N:
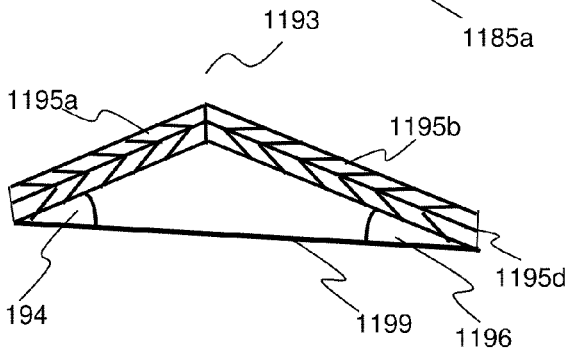
FIG. 11N schematically shows a relief top down side view of an alternate angled tent shaped retention spring.
Figure 11O:
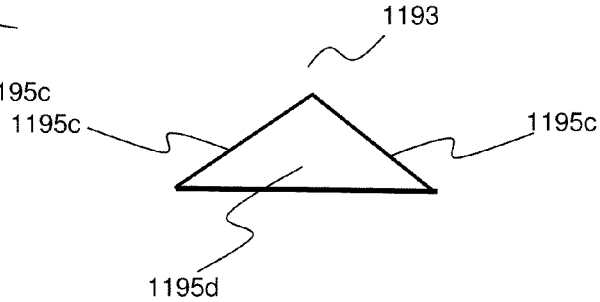
FIG. 11O schematically shows an end view into the front of an alternate angled tent shaped retention spring.

Referring now to FIG. 11M, FIG. 11N, and FIG. 11O, schematically shown are a top, side and front view of an angled tent type retention spring. The tent type spring 1193 what would be the second 1195*a* and third 1195*b* members of a pyramid type spring (see FIG. 11A) are composed of two sub-members that are angled downward so that a ridge 1197 runs the length of the spring. The second 1195*a* and third 1195*b* members are joined at an apex ridge 1198. The second 1195*a* and third 1195*b* members rise and lower at a first 1194 and second 1196 angle relative to the shell. The front of the spring contains a sloped triangular portion 1195*d* flanked by extensions 1195*c* of the second and third member. Embodiments of this tent type retention spring provide a longer ridge for contacting the inner surface of a female receptacle.

F. Bottom Shell

Figure 11P:
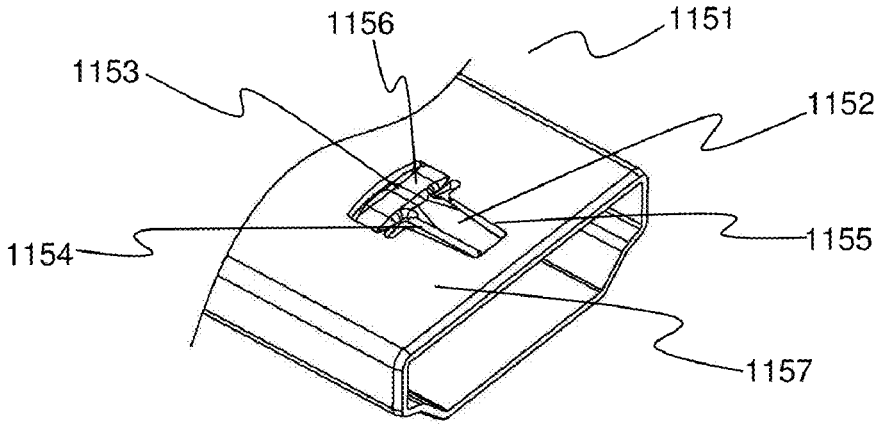
FIG. 11P schematically shows a relief top down view of an alternate T shaped dimple retention spring positioned in the male probe of a top shell.
Figure 11Q:
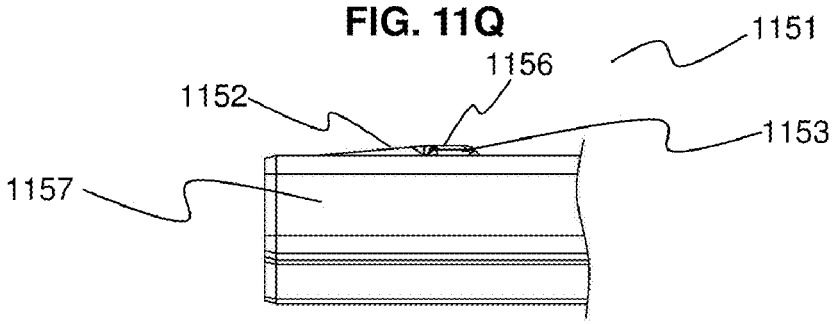
FIG. 11Q schematically shows a side view of an alternate T shaped dimple retention spring positioned in the male probe of a top shell.
Figure 11R:
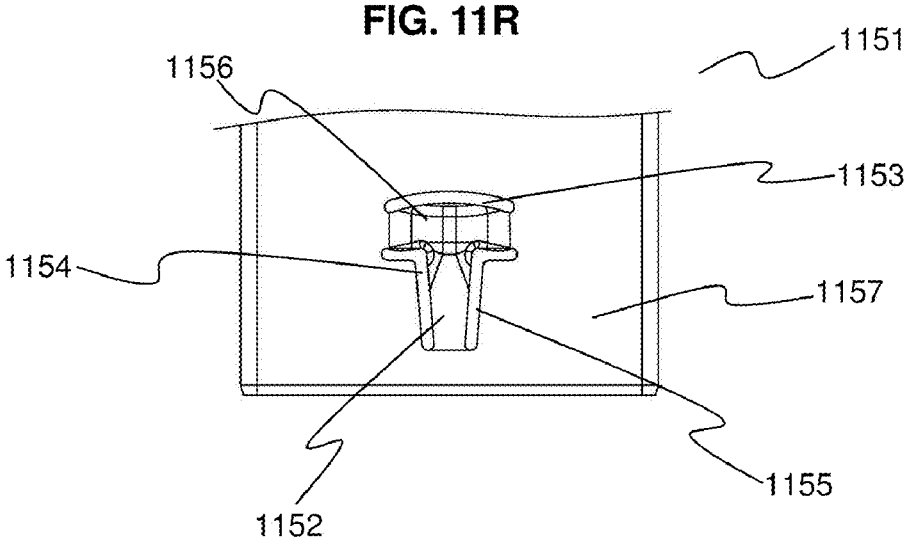
FIG. 11R schematically shows a top view of an alternate T shaped dimple retention spring positioned in the male probe of a top shell.

Referring now to FIG. 11P, FIG. 11Q, and FIG. 11R schematically shown are a relief top down view, a side view and front view of an alternate T shaped dimple retention spring 1151. This retention spring consists of a member 1152 connected to an elongated T shaped dimple member 1156 that is convex. Slots 1153, 1154, 1155 cut through the top shell 1157 flank the members 1152, 1156 to provide for movement of the spring for contacting the inner surface of a cognate female receptacle.

After the assembled connector core and wire holder subunit is inserted into a top shell the bottom shell is added to make the male connector. Embodiments of different top shells are described to highlight features below.

Figure 12A:
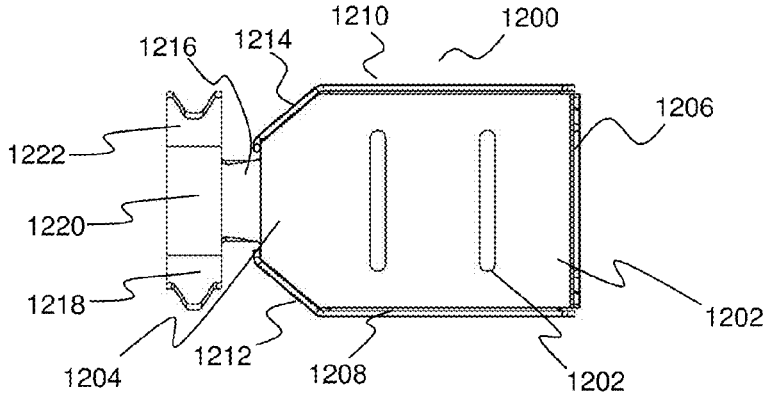
FIG. 12A schematically shows a top down view of a bottom shell.

Referring now to FIG. 12A, FIG. 12B, FIG. 12C, and FIG. 12D schematically shown are a top view, a relief top down side view, a front probe end view, and a back wire terminal view, respectively. In FIG. 12A, the bottom shell 1200 has a quadrilateral base with a front probe end 1206 and a back wire terminal end 1220. The first probe end 1206 includes a rectangular compartment 1202 configured to receive a connector core and wire holder subunit and a second wire terminal end 1220 end forms a trapezoid portion 1204 for receiving a cable. The rectangular compartment has a first 1208 and second 1210 side with cognate receptacles 1226 for mating with locking tabs on a side of the top shell. The trapezoidal portion

1204 of the base contains a third 1212 and fourth 1214 side for mating with the trapezoidal wire terminal end of a third and fourth side of a top shell.

The front probe end 1206 of the bottom shell contains a lip structure that has a first 1207*a* and second 1207*b* triangular tab positioned for mating with abutting to the a back end of a male plug member of a top shell. The back wire terminal end 1220 contains a set of strain relief tabs 1218, 1222, joined to the bottom shell trapezoidal portion 1204 by a connecting member 1216.

G. Special Connectors for Applications

One issue that arises in regard to performance of HDMI cables and connectors is that the cable length can be limited depending on the gauge of wire used in standard or modified ribbon type HDMI cables. Increased performance is observed with larger gauge wires and requires modifications to HDMI connector systems to accommodate such larger gauge wires.

Figure 12B:
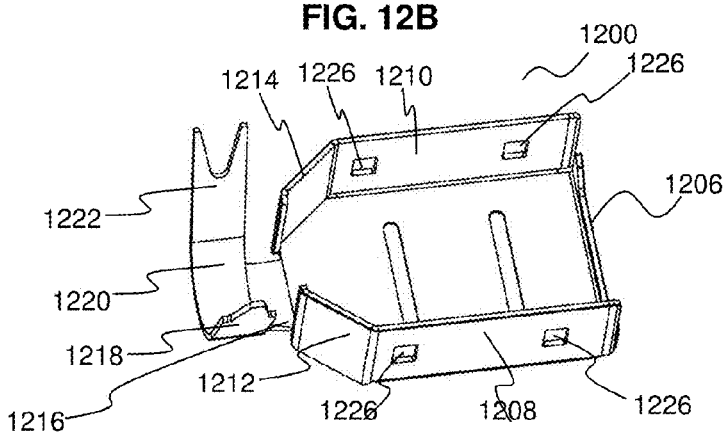
FIG. 12B schematically shows a relief top side view of a bottom shell.
Figure 12C:
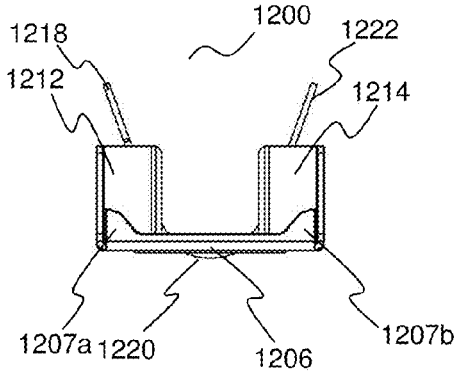
FIG. 12C schematically shows a front probe end top view into a bottom shell.
Figure 12D:
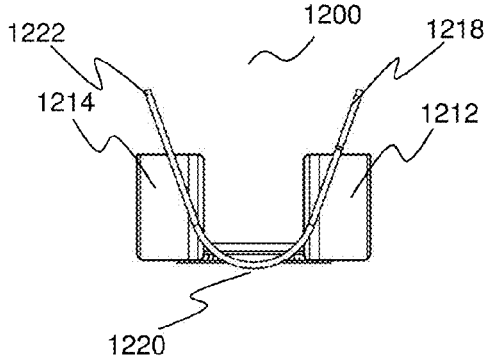
FIG. 12D schematically shows a back wire terminal end view into a bottom shell.
Figure 12E:
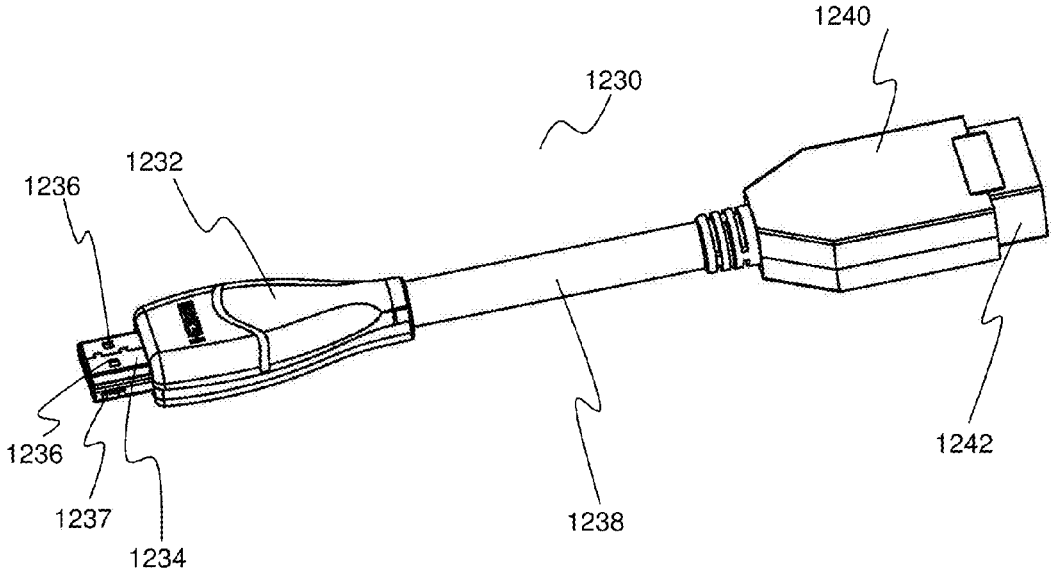
FIG. 12E schematically shows an embodiment of a pigtail cable with male connector terminated end, in-line extender, and female connector terminated end.

Referring now to FIG. 12E, schematically shown is an pigtail cable embodiment configured with an in-line extender to lengthen the maximal cable length. The pigtail cable extender 1230 contains a male HDMI connector 1232 shown with side retentions springs 1237 and optional HDMI square holes 1236 on a top surface of the probe member 1234 on one end of a short HDMI cable 1238 and a female HDMI receptacle on the other end 1242. An extender 1240 is incorporated in-line towards the female end that contains internal circuits that extend the HDMI signal effectively lengthening the maximum usable cable length.

The in-line extender 1240 is configured to draw power via the female end from the electronic source device (e.g. DVD player) using a second HDMI cable for boosting the HDMI signal and removing the need for an external power source common in box type extenders in use commercially. The internal circuits allow the pigtail to extend maximal usable cable length via the increased signal strength and clarity without the need for an external mounted box or plug for power. The pigtail is connected via the male end to the HDMI sink device (e.g. HDTV).

The circuitry employed in box type extenders with external power supplies are generally known in the art. However, the in-line pigtail configuration that does not require external power which effectively eliminates the need to mount the box type extender next to a wall mounted flat panel HDTV and the need to look for a power outlet for the external power supply; it also improves the clean appearance of the installation.

The pigtail embodiment is compatible with standard HDMI cable, or with modified HDMI ribbon cables disclosed elsewhere in this application. The male connector on the pigtail embodiment is also compatible with the retention springs and DIY connectors disclosed in this application but also are efficiently manufactured in the factory using standard components.

Figure 12F:
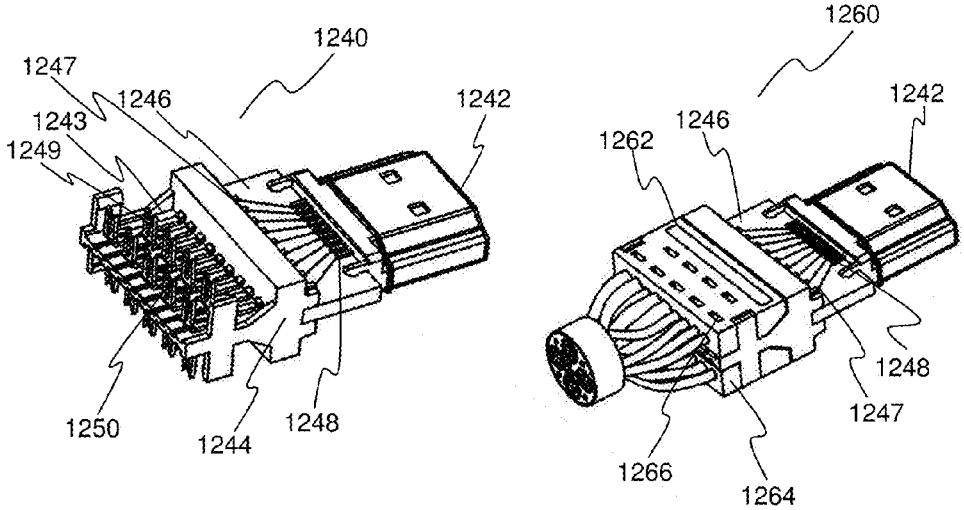
FIG. 12F schematically shows an embodiment for a Printed Circuit Board (PCB) trace connector core (left) and circuit board trace connector core wire holder subunit (right).
Figure 12G:
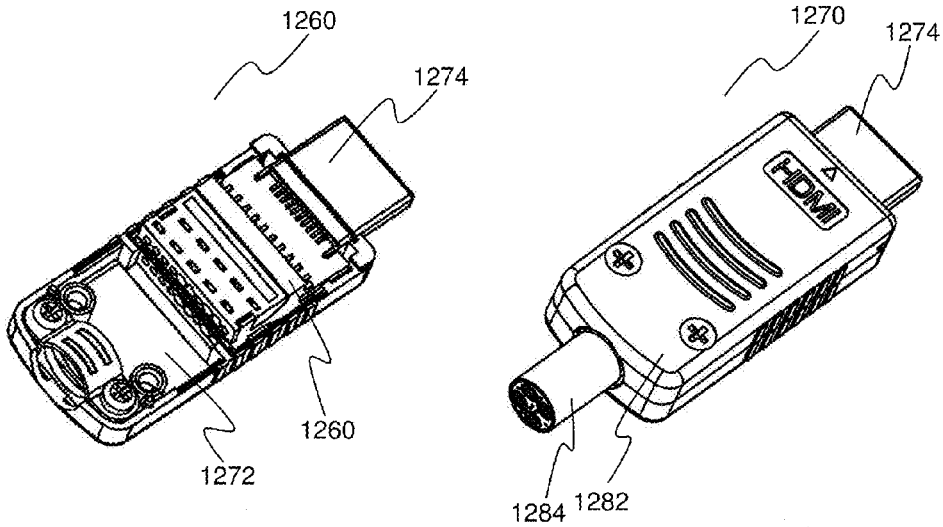
FIG. 12G schematically shows an embodiment for a PCB circuit board trace connector core and wire holder subunit assembled into a top shell (left) and with outer protective shell (right).

Referring now to FIG. 12F and FIG. 12G, schematically shown are different views of a Printed Circuit Board (PCB) male HDMI connector. The PCB connector is based around a PCB connector core 1240 which contains trace circuits that reduce pitch size. The PCB connector core is designed to bridge 1244 between large minimum pitch distances (e.g. 26, 24, and 22 AWG) necessary with large gauge wire and the smaller about 1.0 mm pin pitch distance required at the contact junction between the HDMI male probe and female connector. The PCB 1246 has traces connecting the pins 1243 on the terminal side with non-standard pitch size to the pins 1247 on the probe side with standard pitch size (about 1 mm) one by one (pin 1 to pin 1, pin 2 to pin 2, etc). In one embodiment the PCB HDMI the connector core 1240 contains a probe end 1242 and open compartment wire terminal end with sets of terminal pins 1249, 1250 in a back compartment. In FIG. 12F (left panel) the bottom compartment is visible and the V-shaped metal pins are arranged as two staggered sets 1249, 1250, of five and four pins that are for the wires of the HDMI cable. The probe end contains corresponding pins 1248 that are set at a smaller distance, typically at about 1.0 mm.

In some PCB connector embodiments the internal pins of the probe or wire terminal end could be set at between about 0.4 mm to about 2.0 mm provided that the contact point between the male probe end and the mating female connector is about 1.0 mm. Such embodiments would adjust for alternate connector configurations for connectors while maintaining the required HDMI specifications for the contact point. In other embodiments intermediate distances could be used of about 0.4 to about 0.5; about 0.5 mm to about 0.6 mm; about 0.6 to about 0.7 mm; about 0.7 mm to about 0.8 mm; about 0.8 mm to about 0.9 mm; about 0.9 mm to about 1.0 mm; about 1.0 to about 1.1 mm; about 1.1 to about 1.2 mm; about 1.2 mm to about 1.3 mm; about 1.3 mm to about 1.4 mm; about 1.4 mm to about 1.5 mm; about 1.5 mm to 1.6 mm; about 1.6 mm to 1.7 mm; about 1.7 mm to 1.8 mm; about 1.8 mm to 19 mm and about 1.9 mm to 2.0 mm once again provided that the probe pins are finally configured to meet the about 1.0 mm requirement for the contact point.

The top compartment of the PCB connector core contains 10 V-shaped metal pins similarly configured in sets of five for the other 10 wires of the HDMI cable (not shown, reverse side). In embodiments utilizing the full spectrum of gauge wires both the top and bottom pins would be set at pitch distances of about 0.4 mm to about 2.0 mm with larger gauges (e.g. 24, 26, and 22 AWG) having a minimum pitch distance of about 1.6 to about 2.0 mm.

In embodiments without the PCB the pins would have to be bent to adapt pitch size in the range from ones other than 1.0 mm to about 1.0 mm which is problematic for manufacturing since each pin requires a different degree of bend but also since these pins would have to be placed precisely in the connector core. Straight pins are symmetrical and solve these manufacturing problems. The PCB connector design allows pins to remain straight while solving the problem of decreasing large pitch sizes down the about 1.0 mm required at the contact point between the male and female connectors.

In this embodiment the PCB connector core is modeled on the DIY connector core and so has four flexible buckles with hooking protrusions for securing a top 1264 and bottom 1262 wire holders as well as pin slots 1266 hat allow the V-shaped metal pins to contact the conducting wires within the connector core 1240, but other configurations are combatable with the PCB connector design.

The printed circuit board (PCB) 1246 is positioned between the pins of the wires 1249, 1250 in the top and bottom compartments of the connector core and the pins of probe end 1248 and contains internal circuit traces that connect the pin sets directly together while reducing the pitch size down from that of the wire end to about 1.0 mm at the probe end. The PCB circuit trace configuration allows the connector core to utilize straight pins facilitating pin placement and manufacturing precision while at the same time allowing use of larger gauge wires or alternate connector configurations.

In certain embodiments the PCB connector core reduces the pitch size down to about 1.0 mm from about 1.6 mm to about 2.0 mm. Specific embodiments reduce pitch size down from about 1.6 to about 1.7 mm; about 1.7 to about 1.8; about 1.8 to about 1.9; about 1.9 to about 2.0.

The PCB connector core when assembled with top and bottom wire holders as a subunit 1260 has a larger overall dimension compared to standard and DIY connectors requiring a space saving design for the protective shell. The PCB connector core and wire holder subunit 1260 utilizes a single top 1272 and bottom 1282 metal shell design to encase the connector core and wire holder subunit to efficiently use space and to provide EMI shielding and protection. The PCB connector core and wire holder subunit is configured to be sandwiched between the top shell 1272 and the bottom shell 1282 to complete the PCB connector 1270. In some embodiments the top surface 1274 of the probe end can contain retention springs (not shown, as described above). The PCB connector can utilize standard HDMI cables or modified ribbon type cables 1284.

H. Hand Tool for Field Termination

The compression hand tool described below is used in several steps of the method for "Do It Yourself" (DIY) field termination for adding a male connector to a HDMI cable for both the modified ribbon cable described in this disclosure as well as for standard about 19 wire HDMI cables.

Figure 13A:
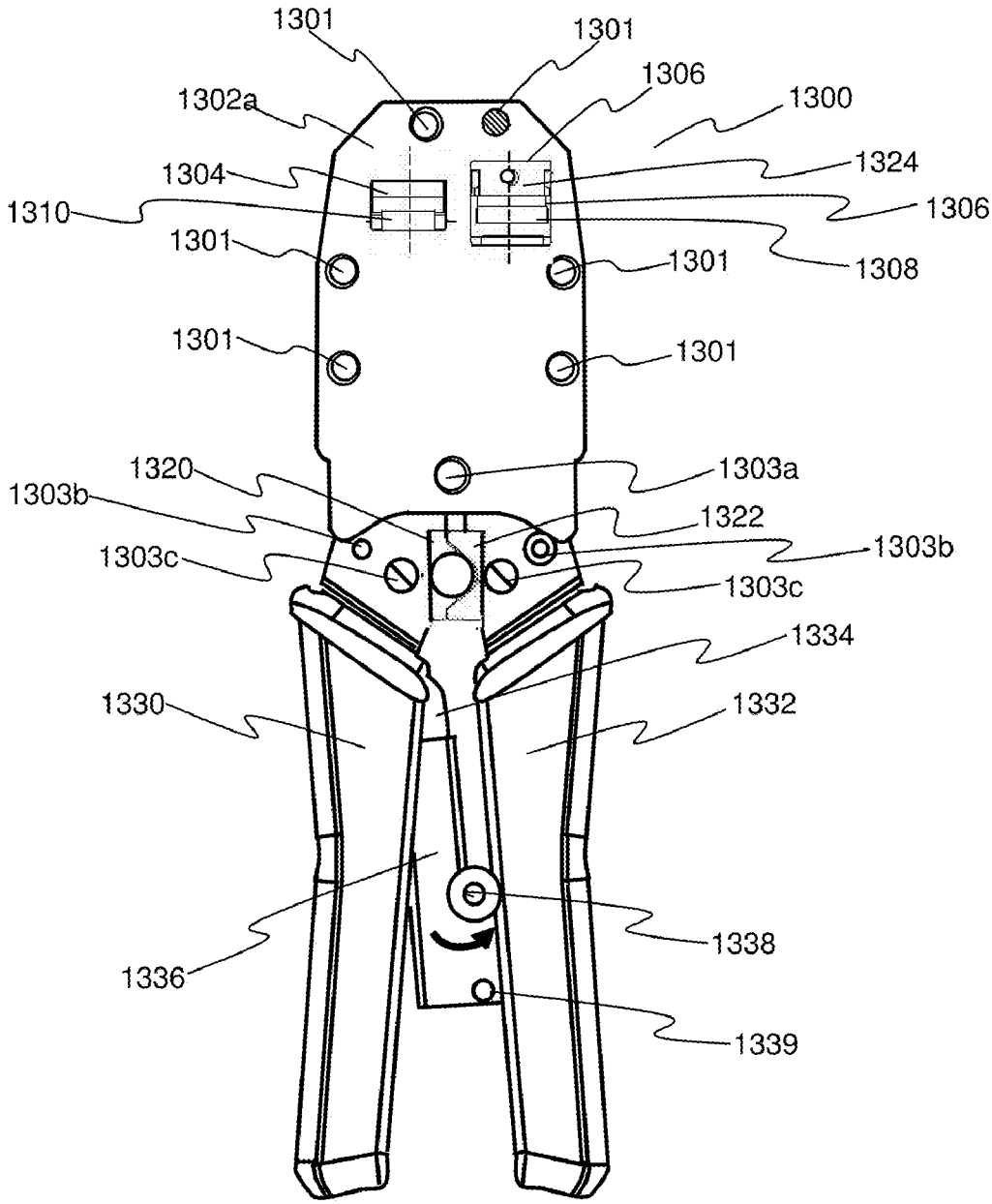
FIG. 13A schematically shows a front view of a compression hand tool in the closed configuration.
Figure 13B:
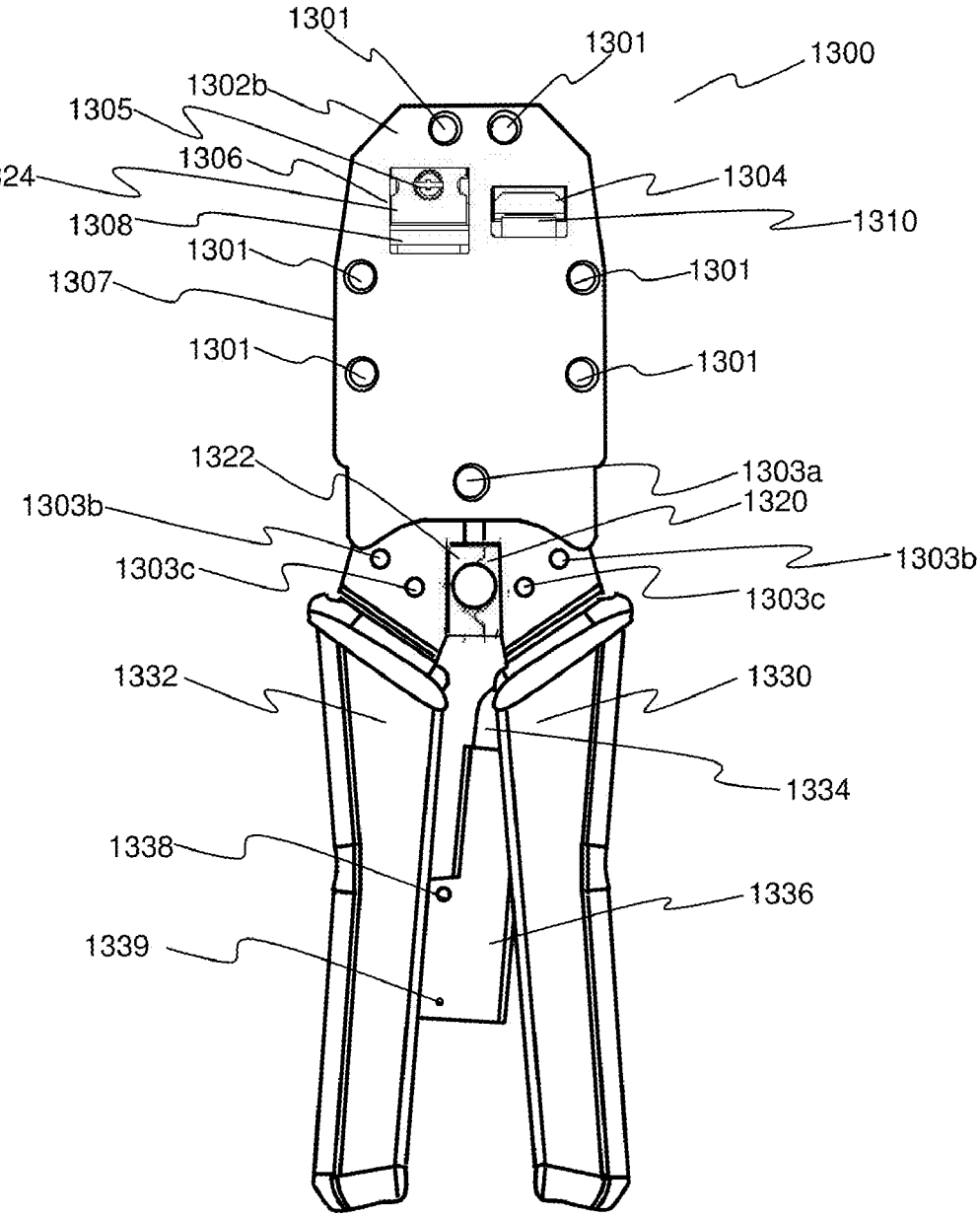
FIG. 13B schematically shows a back view of a compression hand tool in the closed configuration.
Figure 13C:
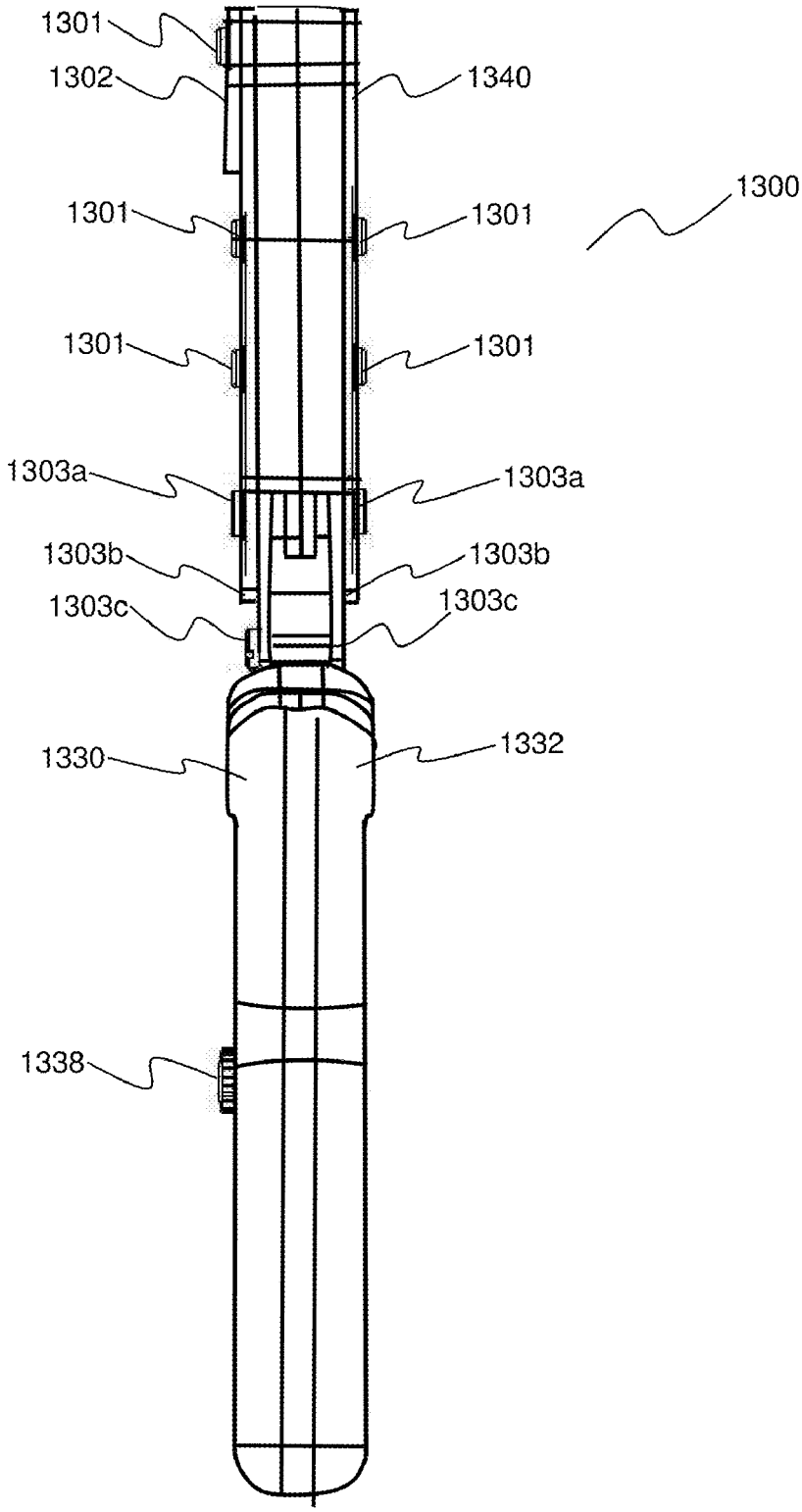
FIG. 13C schematically shows a side view of a compression hand tool.

Referring now to FIG. 13 A, FIG. 13B, and FIG. 13C, schematically shown are front, back and side views of a compression hand tool in the closed configuration. In FIG. 13A, a compression hand tool 1300 used to assemble the connectors systems disclosed for embodiments of the present invention is shown in the open configuration. The hand tool 1300 contains a first and second body member 1302*a*, 1302*b* that contains a first receptacle 1304 through an open body cavity for receiving wire holders and a second receptacle 1306 through the body cavity for receiving connector core and wire holder subunits. A first 1330 and second 1332 handle each with an upper plate 1314 are attached to a ratchet means for applying and reducing compression by moving a first compression means 1310 for pre-crimping wire holders in the first receptacle and second compression means die 1308 for crimping the connector core wire holder subunit such that the V-shaped metal pins in the connector core penetrate the pin-slots of each wire holder contacting the internal conducting wires.

The first and second body members 1302*a*, 1302*b* are secured by a set of screws 1301. The left and right link arms 1303*b* are connected to the left and right handle arm at two joint poles 1303*c*; and are connected to each other and the top member 1302*a* and bottom member 1302*b* at the joint pole 1303*a*. Each joint pole allows the link arms to pivoting freely. When the left and right handles 1330 and 1332 are squeezed closer to each other, the two joint poles 1303*c* are also coming closer while pushing the two link arms 1303*b* to come closer; and this will make the joint pole 1303*a* to travel downward. This will make the top and bottom member 1302*a* and 1302*b* to travel downward, thus the two dies 1308 and 1310 will relatively move upward to finish the crimp. A blade 1324 for trimming wires is fixed by a screw 1305 in the second receptacle 1306 housing the second compression means die 1308. Movement of the compression means die 1308 upward allows for wire trimming against the blade 1324.

Just below the body member is a compartment for compressing strain relief tabs to secure connectors on the cable ends. A circular receptacle formed from means 1320, 1322 for compressing the strain relief tabs mate around the cable jacket as well as for centering the cable. When the hand tool is in the open configuration the cable centering means 1320, 1322 are open. When closed these means 1320, 1322 come together providing a a circular receptacle to hold the cable where the strain relief tabs can be compressed around the cable jacket. The ratchet arm means 1334 travels into member 1336 during the compression when the handles 1330 and 1332 are squeezed towards each other; the ratchet latch inside member 1336 only allows the arm 1334 to travel inwards moving on a pivot point 1339 unless it reaches the inner most position to ensure a full compression and not allow a half compressed tool to open unless the racket release knob 1338 is rotated counter clockwise.

I. Assembly Method for "do it Yourself" Field Termination

Figure 14:
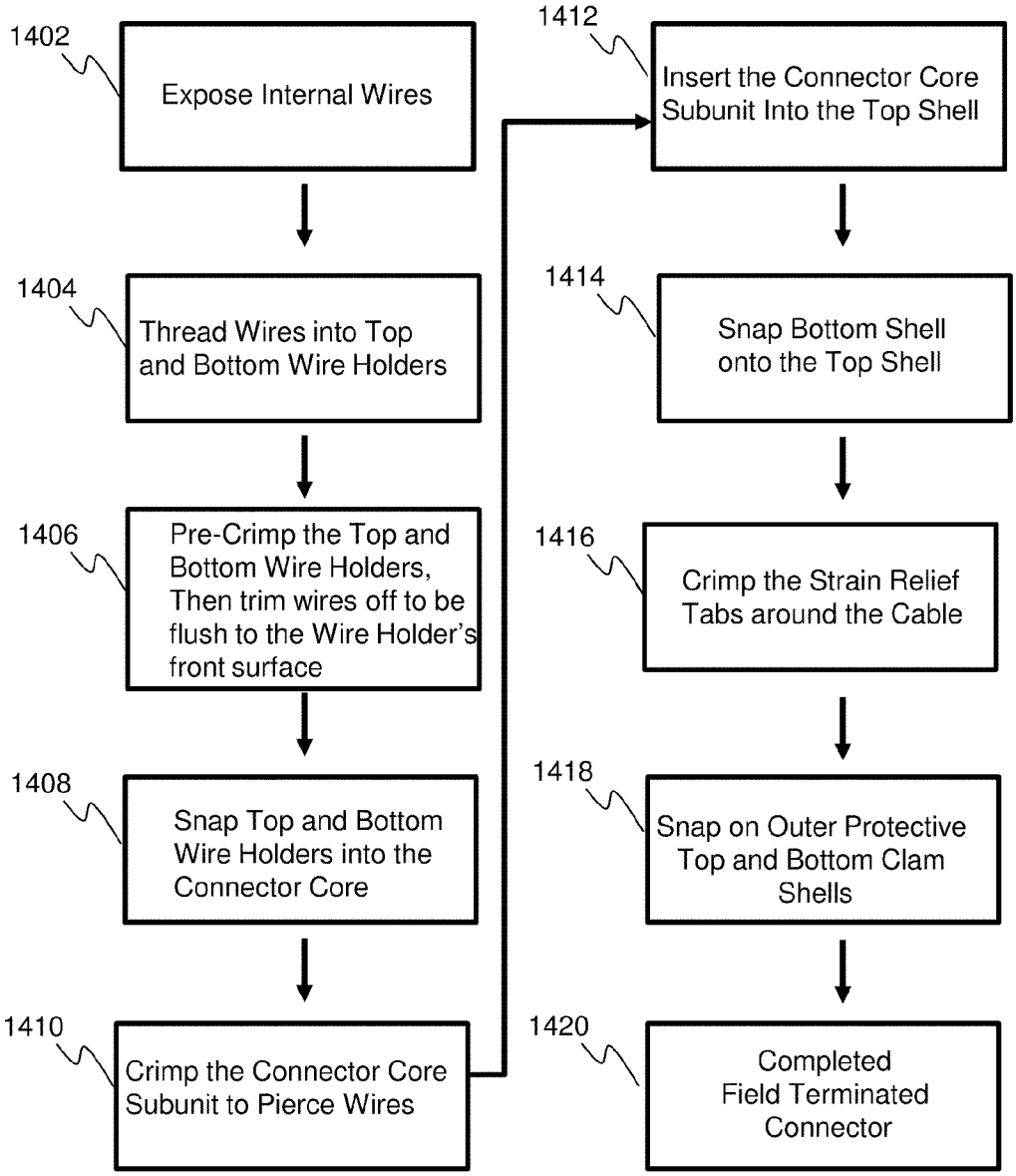
FIG. 14 schematically shows a scheme for a method for field terminating a standard HDMI cable with a male connector.

Referring now to FIG. 14, shown is a flow scheme 1400 highlighting the steps for field terminating a male connector onto a standard HDMI cable. In Step 1, 1402, the jacket from a standard HDMI cable is opened by cutting along the circumference of one end of the cable exposing the internal 19 wires covered by aluminum foil and braided sleeve. The foil and braided sleeve are cut using the blades of the hand tool (see FIG. 13A-C) and also pulled back and removed to free the internal wires. In this step the twisted wire pairs are separated and their added foil covering is also removed. There is a drain ground wire in each of the twisted pairs. Each one should be twisted into a tight wire. Generally, it is sufficient to expose about 3 cm (1¼ inch) the outer cable jacket. The 19, internal wires, are separated into a top ten wire set and bottom none wire set for threading into the top and bottom wire holders, respectively.

Typically, manufactures employ color coding to identify the function of each wire for connection to the appropriate pin within the connector. In some embodiments the wire holders may be marked with color, embossing, or a molded image to facilitate orientation of the wire sets for threading into the wire holders. Coding the top and bottom wire holders removes the need to create a key for keeping track of the specific function of each wire and reduced the time for threading the wires.

Step 2, 1404, the ten wires of the top set are threaded one by one into top wire holder and the nine wires of the bottom set are threaded one by one into the bottom wire holder. It is best to thread the four drain ground wires last with two for the top wire holder and two for the bottom wire holder. The order of threading either the top or bottom wire holder is not critical and may be reversed. It is important to slide the wire holders as far as they will go into the wire to remove wire slack and to ensure good termination quality. Each of the top and bottom wire holders has sets of seven counter sunk holes facilitating the aiming and penetration of wires into the wire holders.

Step 3, 1406, in series the threaded top and bottom wire holders are inserted into the first receptacle at the top left of the compression hand tool (see FIG. 13A, 1304). The hand tool is closed applying compression to pre-crimp one of the wire holders. The other wire holder is lined up to about the same position as the first wire holder and the pre-crimp step is them performed in series. Each of the top and bottom wire holders is placed in the receptacle such that the interior surface face is up so that the open groove (see FIG. 8A, 821, 820; FIG. 8B, 833, 842) is contacted by the blade mean for applying the compression from the hand tool (See FIGS. 13A and 13B, 1310). The pre-crimp step accomplishes two main functions (1) the internal wires are held in place to prevent sliding and (2) each wire in centered within the holes in each wire holder. After the pre-crimp step excess wires are cut from each wire holder using the blade means on the hand tool (see FIG. 13A, 1324, 1326) to be flush to the front surface of each wire holder.

Step 4, 1408, the top and bottom wire holders are assembled onto the connector core forming a connector core wire holder subunit. The wire holders are lined up with the connector core. The top wire holder should be positioned with large asymmetrical tab facing forward with the angled portion up to the top and the counter sunk holes facing back with the interior surface down so that the connector core pins can be inserted into the pin-slots (see FIG. 8A, 822, 821, 828). The bottom wire holder should be positioned with small asymmetrical tab facing forward with the angled down to the bottom and the counter sunk holes facing back with the interior surface up (see FIG. 8B, 856, 833, 859). By hand each of the wire holders are pressed half way into the connector core.

Step 5, 1410, the connector core and wire holder subunit 1500 is inserted into the second receptacle of the hand tool (see FIG. 13A, 1306). The hand tool is closed to crimp the subunit so that the V-shaped metal pins of the top and bottom compartment of the connector core pierce into each wire holder pin-slots contacting the internal wires. Each of the top and bottom wire holder are then crimped fully into place using the hand tool.

Figure 15A:
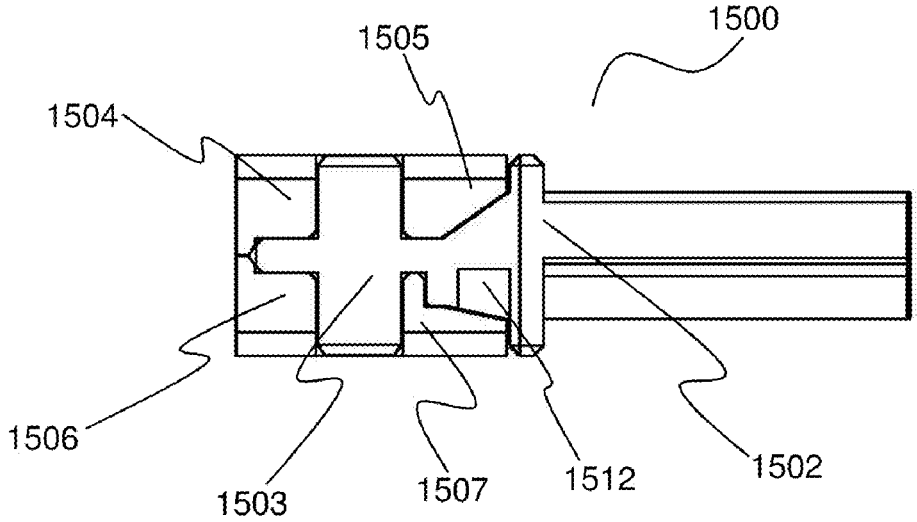
FIG. 15A schematically shows a side view of an assembled connector core and top and bottom wire holder subunit ready for insertion into a top shell.

For reference referring now to FIG. 15A, a connector core wire holder subunit is shown 1500. The top wire holder 1504 and bottom wire holder 1506 are snapped into place such that the flexible buckle 1503 of the connector core 1502 locks with clips sets on each holder (not shown, see FIG. 8E. 818*a,b,c*; 854*a,b,c*). The top wire holder is oriented by the large asymmetrical tab 1505 with the angled portion up to the top that mates into the cognate receptacle in the connector core. The bottom wire holder is oriented by the small asymmetrical tab 1507 with the angled portion down to the bottom that mates into the cognate receptacle in the connector core. The receptacle 1512 positioned on either side of the connector core 1500 mate with tabs on the top shell for locking the connector core into the top shell when inserted obviating the need to other securing means such as adhesive (e.g. adhesive or glue) (see FIG. 16, 1604).

Figure 15B:
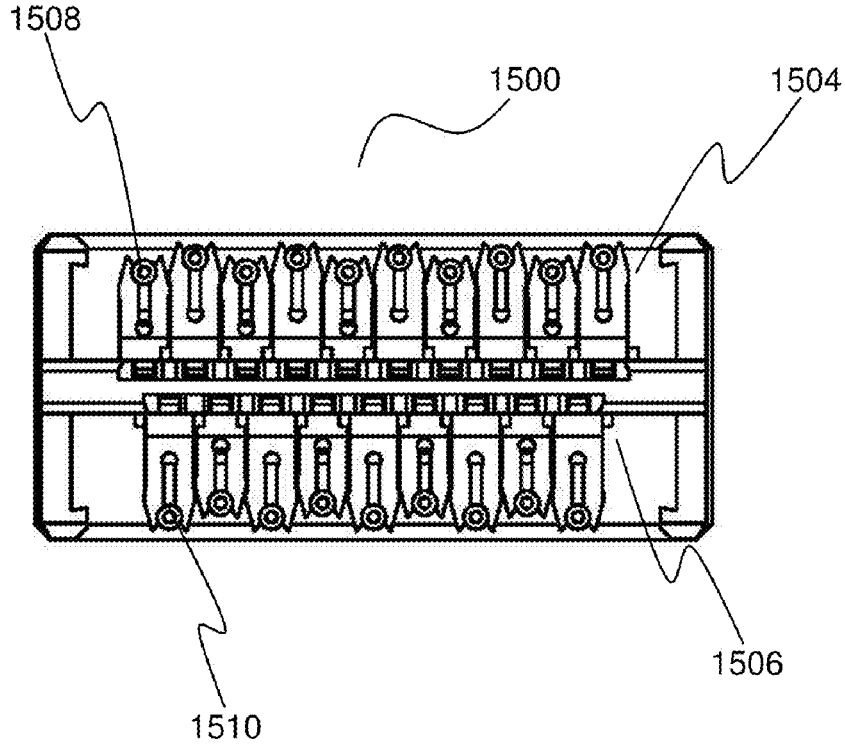
FIG. 15B schematically shows a front probe end view into an assembled connector core and top and bottom wire holder subunit where the V-shaped metal pins are pierced into the conducting wires of the cable.

Referring now to FIG. 15B, a connector core wire holder subunit is shown 1500 from the back wire terminal end. The top 1504 and bottom 1506 wire holders are snapped into place and the V-shaped metal pins 1508, 1510 are shown piercing internal wires of the top and bottom wire holders. These contacts provide for signal transmission and are facilitated by the solderless design.

Referring back to FIG. 14, Step 6, 1412, the connector core wire holder subunit 1500 is inserted into the top shell by sliding it into place until is clicks locking the tab 1604 (FIG. 16A) on the top shell with the receptacle 1512 (FIG. 15A) on the connector core body. This locks the connector core into the top shell together so the bottom shell can be added.

Figure 16A:
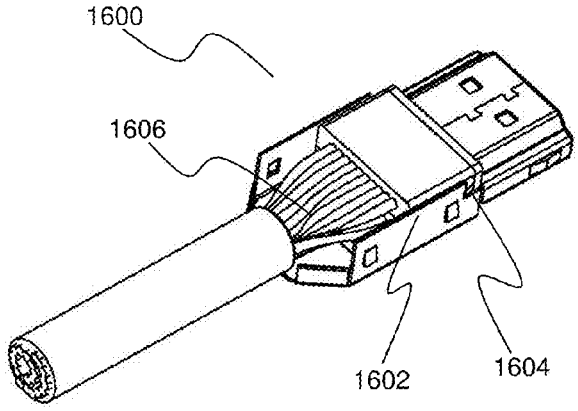
FIG. 16A schematically shows a connector core and top and bottom wire holder subunit inserted into a top shell (without cable and wires).
Figure 16B:
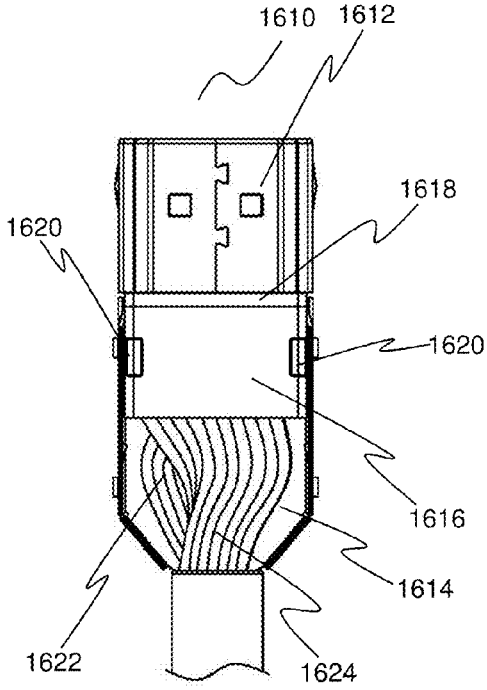
FIG. 16B schematically shows a connector core and top and bottom wire holder subunit inserted into a top shell with standard 19 wire HDMI cable.
Figure 16C:
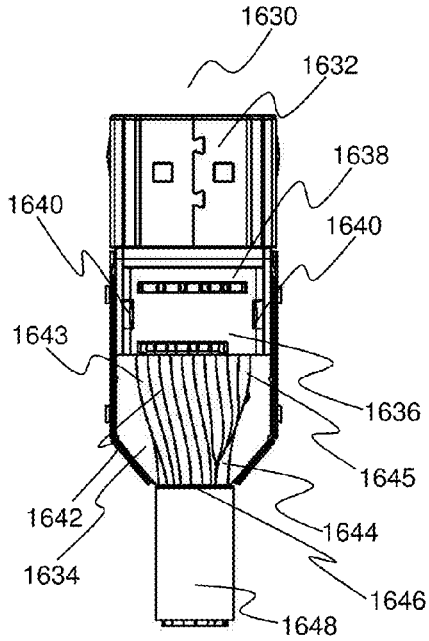
FIG. 16C schematically shows a connector core and top and bottom wire holder subunit inserted into a top shell with top and bottom ribbon cables.

Referring now to FIG. 16A, FIG. 16B and FIG. 16C for reference, schematically shown are partially assembled embodiment HDMI male connectors using standard, about 19 wire, HDMI cable and modified ribbon cable. In FIG. 16A, shown is a connector core and wire holder subunit 1600 locked into the top shell 1602. The tab 1604 on the top shell locks into a receptacle on the connector core subunit into place removing need to glue or use other means to secure the subunit within the top shell (see also FIG. 10B, 1050; FIG. 15A, 1512). The sets of wires 1606 of the HDMI cable is shown schematically for illustration purposes only to focus on the locking tab feature holding the connector core subunit in the top shell. In FIG. 16B, the connector core and wire holder subunit 1610 is shown inserted into the top shell 1614 before the bottom shell is added with standard HDMI conducting wires 1622, 1624 connected to the pins. The probe end 1612, bottom wire holder 1616, bottom wire holder groove 1618 for receiving the hand tool member for the pre-crimp (see FIG. 14, 1406, Step 3), and set of bottom flexible buckles hooking protrusions 1620 are visible.

Referring back to FIG. 14, Step 7, 1414, the bottom shell is then added onto the top shell containing the connector core subunit. The two tabs present on the first and second sides, for a total of four, of the top shell must be lined up to mate with the cognate receptacles on the bottom shell (see FIG. 10B, 1026; FIG. 12B, 1226). This locks the top and bottom shells together.

Referring to FIG. 14, Step 8, 1416, the hand tool is then used to crimp the strain relief tabs around the cable body. The center portion of the hand tool between the two handles contains a receptacle for the cable (see FIG. 13A, 1320, 1322). When the end of the assembled connector is placed into the hand tool receptacle closing the handles this crimps the strain relief tabs around the cable jacket (see FIG. 12B, 1218, 1222). In this step the ground wires are also crimped into place and are trimmed off using a blade. It is important to make sure the crimp makes the strain relief tabs tightly grip around the cable jacket.

Referring to FIG. 14, Step 9, 1418, the final step is to place protective outer top and bottom shells called clam shells. The male connector is terminated and functional for connecting to a female receptacle 1420.

Figure 17A:
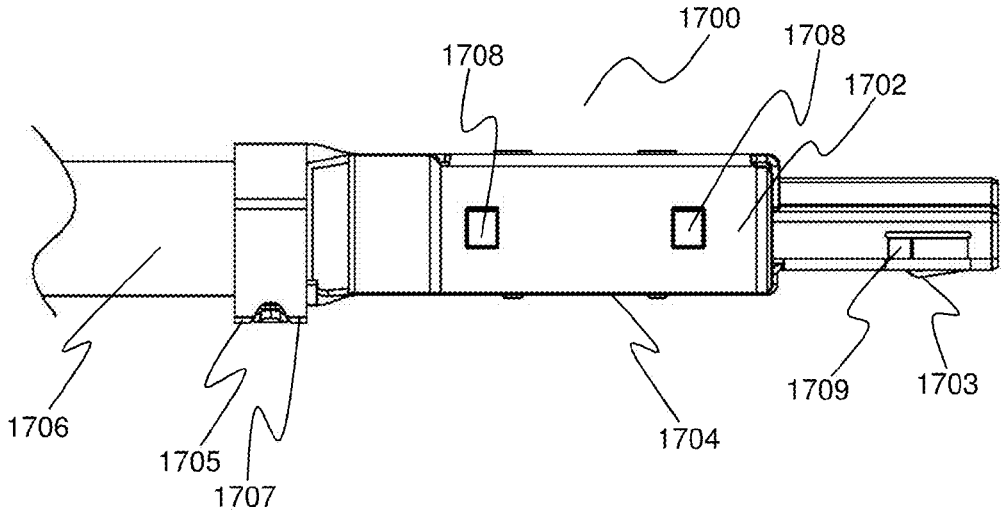
FIG. 17A schematically shows a side view of an assembled connector with top and bottom shells together.
Figure 17B:
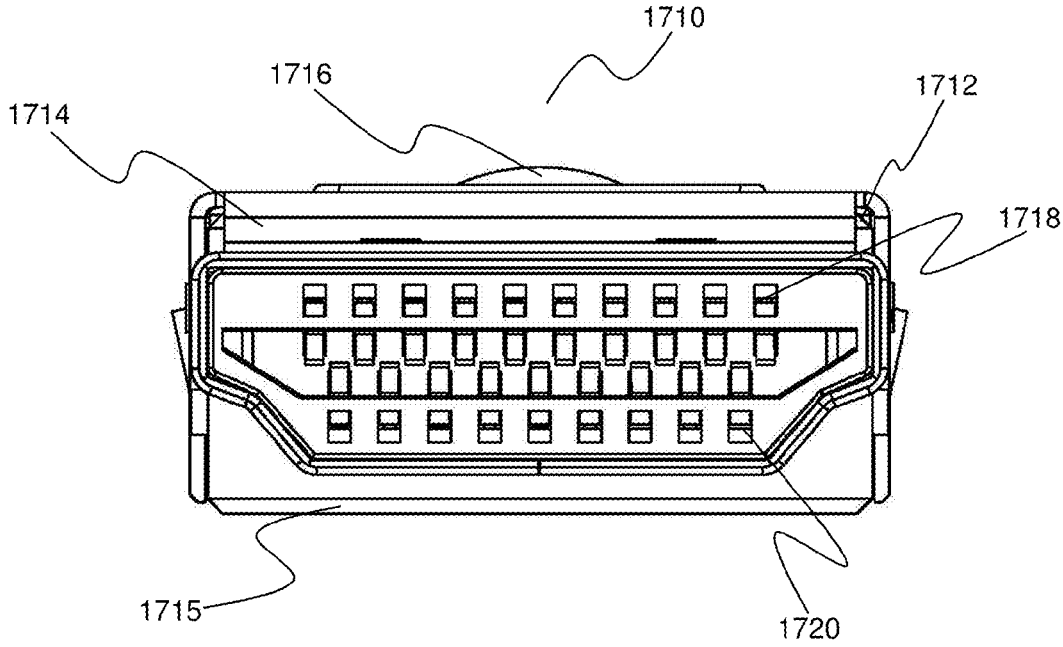
FIG. 17B schematically shows a front probe end view into an assembled connector with the internal pin terminals visible.

Referring now to FIG. 17A and FIG. 17B, shown are assembled connectors without protective outer top and bottom clam shells. In FIG. 17A the connector 1700 is shown with retention springs 1703, 1709, with the cable stain relief tabs 1705, 1707 crimped around a cable 1706 to illustrate the top and bottom shell components. The top shell 1702 is positioned inside of the bottom shell 1704 where the tabs are locked into the cognate receptacles 1708 on the bottom shell with the cable 1706 exiting the back end In FIG. 17B, a front view into the probe end of a completed connector is shown 1710 before addition of the outer protective clam shells. The strain relief tabs 1716 are crimped onto the cable (not shown) with the top shell 1712 1715 locked 1712 into place inside the bottom shell 1714. The top pins 1718 and bottom pins 1720 are shown inside the insulating probe end of the connector core subunit 1714. This completed connector can have the protective clam shells added for use in transmitting signals in the field.

Referring now to FIG. 18, 1800, a shown is a flow scheme highlighting the steps for field terminating a male connector onto a modified Ribbon HDMI cable. The initial steps are different being streamlined since the ribbon cable design greatly facilitates the threading process, but the method is otherwise similar to the remaining steps for the standard HDMI cable. In Step 1, 1802, the jacket from a modified ribbon HDMI cable is opened by cutting along the circumference of one end of the cable exposing the internal insulated top and bottom ribbon cables covered by aluminum foil and braided sleeve. The foil and braided sleeve are cut using the blade of a knife to pull these back (see FIG. 3A, 320, 322; FIG. 3C, 348, 349). The first ground wire is cut and separated from the top ribbon cable and the insulation removed for grounding with the top or bottom shell (see FIG. 5C, 404, 408).

Step 2, 1804, the top and bottom ribbon cables containing the ten and nine internal and insulated identical conducting signal wires are threaded through the slot array in each of the top and bottom wire holders (see FIG. 1, 20 21, 30 31, 44, 54; FIG. 7A. 700, 712, 726, 734). The order of threading either the top or bottom wire holder is not critical and may be reversed. In one embodiment the top and bottom ribbon cables are marked by color on the insulating jacket of the first conducting wire for each (e.g. with a red stripe running along the ribbon cable). In this embodiment the colored stripe is matched to a molded or embossed arrow (or other shape or image) on the exterior surfaces on both the top and bottom ribbon wire holders. These matched markings further increase the efficiency of the threading step by orienting the wire holder to the ribbon cable which is often a slow rate limiting step of assembly (see FIG. 5A, 312; FIG. 5C, 412; FIG. 7A, 702, 703; FIG. 7B, 730, 731).

In some embodiments the top or bottom wire holder is made of color or differing colors to easily distinguish them from each other. For example the top wire holder can be black and the bottom white or any other color.

Step 3, 1806, in series the threaded top and bottom wire holders are inserted into the first receptacle at the top left of the compression hand tool (see FIG. 13A, 1304). The hand tool is closed applying compression to pre-crimp one of the wire holders. The other wire holder is lined up to about the same position as the first wire holder and the pre-crimp step is them performed in series. Each of the top and bottom wire holders is placed in the receptacle such that the interior surface face is up so that the open groove (see FIG. 7A, 722, 716; FIG. 7B, 732, 740) is contacted by the blade mean for applying the compression from the hand tool (See FIGS. 13A and 13B, 1310). The pre-crimp step accomplishes the same two main functions (1) the internal wires are held in place to prevent sliding and (2) each wire in centered within the holes in each wire holder. Since the ribbon wires are within the insulation jacket of the wire movement is not as much of an issue, but in different embodiments the array slot is slight larger and when utilizing lower gauge wires, e.g., AWG 22-26 (e.g. note the lower the gauge the greater wire diameter) the pre-crimp step is also important for centering the wires. After the pre-crimp steps are completed excess wires are cut from each wire holder using the blade means on the hand tool (see FIG. 13A, 1324).

Step 4, 1808, is essentially the same as described for the standard HDMI cable wire holders. The ribbon type wire holders are lined up with the connector core and contain the same asymmetrical tabs (e.g. top wire holder large; bottom wire holder small) for correctly positioning each (see FIG. 7A, 718; FIG. 7B, 736). By hand each wire holder is pressed half-way into the connector core.

Step 5, 1810, is essentially the same as described for the standard HDMI cable wire holders. The connector core and ribbon wire holder subunit is inserted into the hand tool in the second receptacle for completing the crimping which connects the V-shaped metal pins with the internal wires of the top and bottom ribbon cables.

Step 6, 1812, is essentially the same as described for the standard HDMI cable wire holders. The connector core wire holder subunit is inserted into the top shell by sliding it into place until is clicks locking the tab on the top shell with the receptacle on the connector core body (see FIG. 10B, 1050; FIG. 15A, 1512; FIG. 16, 1604). This locks the connector core into the top shell together so the bottom shell can be added.

Step 7, 1814, is essentially the same as described for the standard HDMI cable wire holders. The bottom shell is then added onto the top shell containing the connector core subunit. The two tabs present on the first and second sides, for a total of four, of the top shell must be lined up to mate with the cognate receptacles on the bottom shell (see FIG. 10B, 1026; FIG. 12B, 1226). This locks the top and bottom shells together.

Referring now to FIG. 16C for reference, the connector core and wire holder subunit 1630 for modified ribbon cable embodiments is shown inserted into the top shell before the bottom shell is added. The top and bottom ribbon cables 1642, 1644 are shown connected to the pins. The probe end 1632, bottom wire holder 1636, bottom wire holder groove 1638 for receiving the hand tool member for the pre-crimp (see FIG. 18, 1806, Step 3), and set of bottom flexible buckles hooking protrusions 1640 are visible. The orientation markings for the top 1643 and bottom 1645 cable conducting wires are shown on each cable. The strain relief tabs 1646 are shown crimped around the outer cable jacket 1648.

Step 8, 1816, is essentially the same as described for the standard HDMI cable wire holders. The bottom shell is then added onto the top shell containing the connector core subunit. The two tabs present on the first and second sides, for a total of four, of the top shell must be lined up to mate with the cognate receptacles on the bottom shell (see FIG. 10B, 1026; FIG. 12B, 1226). This locks the top and bottom shells together.

Step 9, 1818, is essentially the same as described for the standard HDMI cable wire holders. The final step is to place protective outer top and bottom shells called clam shells. The male connector is terminated and functional for connecting to a female receptacle 1820.

J. Assembly for Factory Installation

The connector systems may also be utilized for factory installation to similar advantage. This system eliminates the process of separating the individual wires, trimming the insulations of all individual wires, soldering all 19 individual wires onto the connector pins one by one by hand, greatly reduces the number of process and workers needed in the production line, reduces the chance of human error, and greatly increases the productivity and the quality of the finished cable products. The only difference could be a fixed table top crimper to replace the hand held crimp tool.

K. Improved Signal Characteristics for Connector Assembly Systems

Figure 19A:
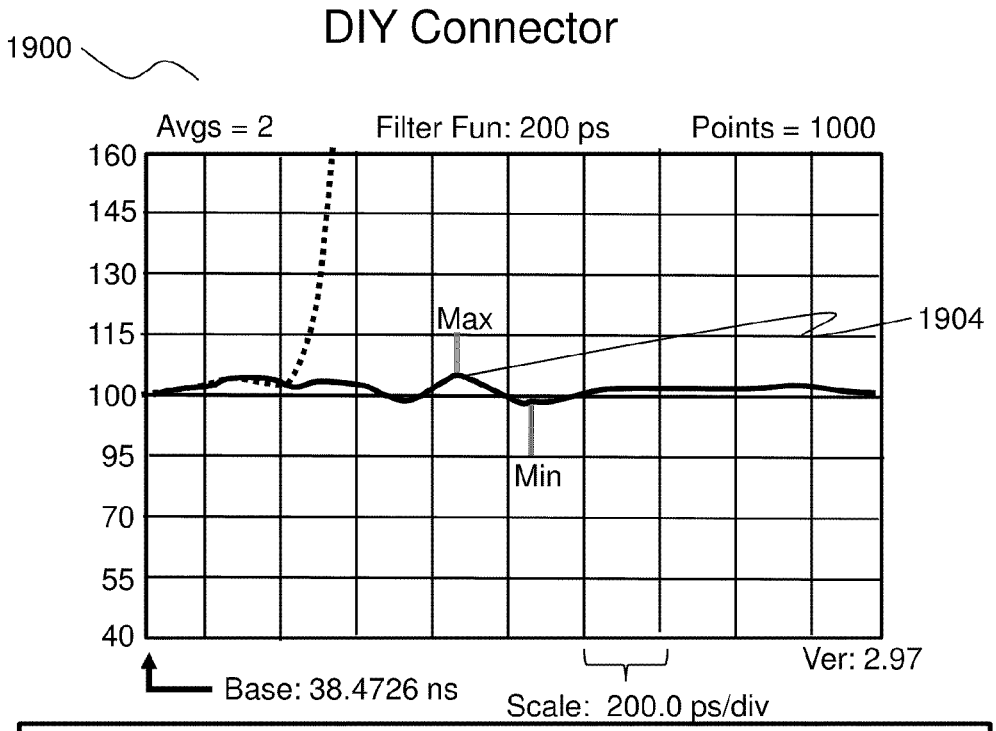
FIG. 19A schematically shows the impedance characteristics of a field terminated DIY connector.
Figure 19B:
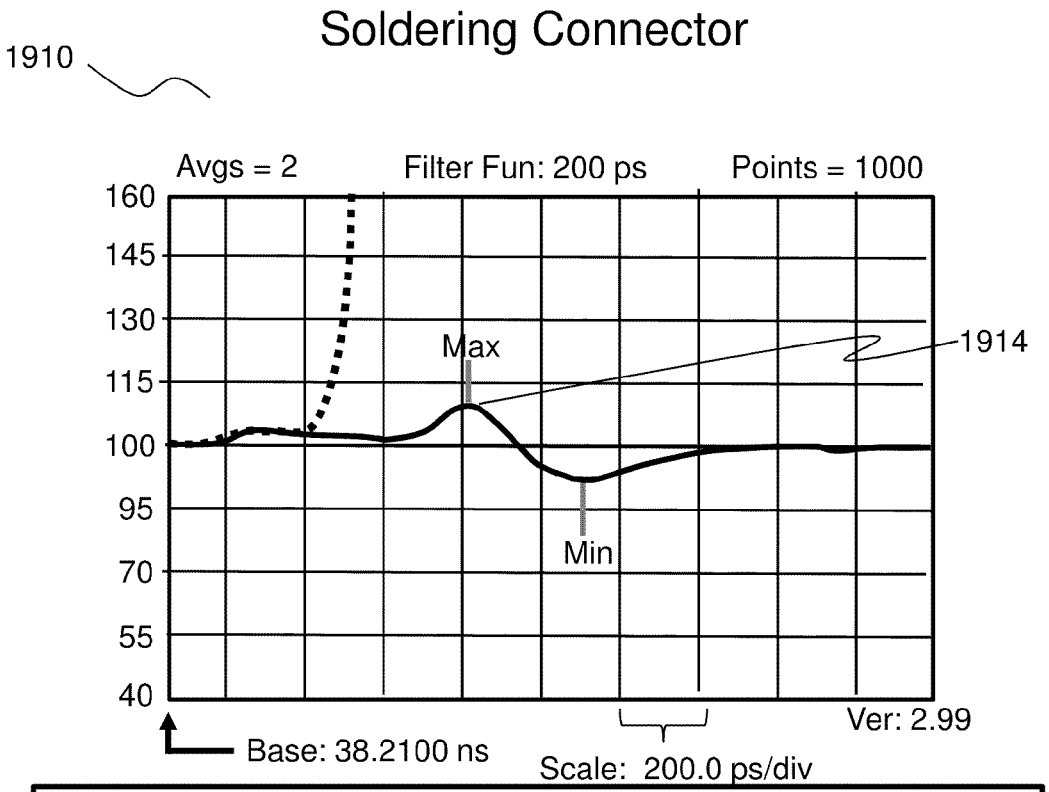
FIG. 19B schematically shows the impedance characteristics of a field terminated soldered connector.

The field terminated "Do It Yourself" (DIY) connectors also offer better performance when compared to traditional solder terminated connectors—either field or factory installed. Referring now to FIG. 19A and FIG. 19B, shown are TDR (Time Domain Reflectometer) test equipment screen captures of the impedance characteristics at the cable and connector termination section of a DIY field terminated male connector cable 1900 compared to a traditional solder factory terminated male connector cable 1910. Important is that the DIY connector 1900 shows tighter impedance 1904 at the termination point compared to the soldered connector which has greater impedance fluctuation 1914. The resulting superior performance of DIY terminated connectors adds to the improved maximum usable cable length and higher maximum usable bandwidth for both field and also for factory terminated cables over traditional solder terminated cables.

L. Field Kits for DIY Field Termination of HDMI Cables

The ability of field technicians to install the "Do It Yourself" (DIY) connector systems disclosed is facilitated by supply of the components in kit form for use in field installation. Sets of components include packs of components to field terminate cables including top metal shells with locking retention springs; bottom metal shells; top and bottom wire holders for standard HDMI cable or modified Ribbon HDMI cable; connector cores; protective outer top and bottom clam shells; a designated hand tool; knife; and instructions for installation. The packs are for field termination of cables which are also part of kits consisting of raw cable spool of standard, HDMI cable and modified ribbon HDMI cable provided in 28 AWG as 250 foot spools and 500 foot spools. Standard packaging is for set of components for making 10 connectors in PET trays including the 5 piece connector set; 2 piece clam shell; hand tool; and knife.

The invention has been described in this specification in considerable detail in order to comply with the Patent Statutes and to provide those skilled in the art with the information needed to apply the novel principles of the present invention, and to construct and use such exemplary and specialized components as are required. However, it is to be understood that the invention may be carried out by specifically different equipment to make and use the components and that various modifications, both as to the component details and methods, may be accomplished without departing from the true spirit and scope of the present invention.

Other methods and techniques for HDMI components are known in the art and are not part of the principle invention. The reader should give the terms wire holder, connector core, top shell, bottom shell, standard HDMI cable, and modified ribbon cable their broadest interpretation. The embodiments of the invention described herein are merely exemplary and should not be construed as limiting. One skilled in the art will appreciate additional embodiments and modifications upon reading the disclosure.

What is claimed is:

1. A HDMI (High Definition Multimedia Interface) DIY (Do It Yourself) field termination connector assembly system comprising:

a top shell having a male plug member and open base with an extended portion serving as strain relief tabs, the top shell having at least one tab for securing a connector core subunit within the base of the top shell by mating with at least one cognate receptacle on a connector core;

a bottom shell having an open compartment base, the open base for mating with and encasing the top shell and a connector core subunit forming a connector assembly;

an insulating connector core having a first plug end for inserting within the top shell male plug member for contacting a female receptacle and a second wire terminal end with an open body for receiving a cable and both a top and a bottom wire holder, the open body of the connector core containing an upper and lower set of flexible buckles each with a hook protrusion, wherein the angle of the hook protrusion on each buckle is configured at an angle of less than 90 degrees and is for non-reversible mating with cognate clip receptacles positioned on the top and bottom wire holders, whereby the insertion of the top and bottom wire holder into the top and bottom compartment of the connector core allows each of the flexible buckle to slip over the clips on the wire holders until the hook protrusion and clip receptacle are non-reversibly mated effectively locking the wire holders into the connector core as a subunit;

a set of top and bottom terminal pins positioned in the connector core for contacting wires in the wire holders, whereby the sets of terminal pins contact the wires when the wire holders are compressed into the connector core providing contacts for signal transmission, the connector core having at least one of receptacle for mating with the at least one of tab on the top shell for securing the connector core and wire holders as a subunit into the top shell; whereby the at least one tab of the top shell slides into and mates with the at least one receptacle on the connector core securing the connector core subunit when the connector core subunit is inserted into the top shell;

the top wire holder having an array of holes configured where holes for the drain wires are smaller diameter than holes for the twisted pair wires through the body for receiving a set of wires from a cable for contacting the top set of connector core terminal pins, the array of holes being grooved to match the outer dimensions of the wires of the cable, the top wire holder having a clip with a receptacle configured at an angle of less than 90 degrees for mating with the hook protrusion of the flexible buckle of the connector core; and the bottom wire holder having an array of holes configured where holes for the drain wires are smaller diameter than holes for the twisted pair wires for receiving wires from a cable for contacting the bottom set of connector core terminal pins, the array of holes being grooved to match the outer dimensions of the wires of the cable, the bottom wire holder having a clip with a receptacle configured at an angle of less than 90 degrees for mating with the hook protrusion of the flexible buckle of the connector core.

2. A HDMI (High Definition Multimedia Interface) DIY (Do It Yourself) field termination connector assembly system comprising:

a top shell having a male plug member and open base with an extended portion serving as strain relief tabs, the top shell having at least one tab for securing a connector core subunit within the base of the top shell by mating with at least one cognate receptacle on a connector core;

a bottom shell having an open compartment base, the open base for mating with and encasing the top shell and a connector core subunit forming a connector assembly;

an insulating connector core having a first plug end for inserting within the top shell male plug member for contacting a female receptacle and a second wire terminal end with an open body for receiving a cable and both a top and a bottom wire holder, the open body of the connector core containing an upper and lower set of flexible buckles each with a hook protrusion, wherein the angle of the hook protrusion on each buckle is configured at an angle of less than 90 degrees and is for non-reversible mating with cognate clip receptacles positioned on the top and bottom wire holders, whereby the insertion of the top and bottom wire holder into the top and bottom compartment of the connector core allows each of the flexible buckle to slip over the clips on the wire holders until the hook protrusion and clip receptacle are non-reversibly mated effectively locking the wire holders into the connector core as a subunit;

a set of top and bottom terminal pins positioned in the connector core for contacting wires in the wire holders, whereby the sets of terminal pins contact the wires when the wire holders are compressed into the connector core providing contacts for signal transmission, the connector core having at least one of receptacle for mating with the at least one of tab on the top shell for securing the connector core and wire holders as a subunit into the top shell; whereby the at least one tab of the top shell slides into and mates with the at least one receptacle on the connector core securing the connector core subunit when the connector core subunit is inserted into the top shell;

the top wire holder having an array of holes through the body configured for receiving a ribbon cable for contacting the top set of connector core terminal pins, the array of holes being grooved to match the outer dimensions of the ribbon cable, the top wire holder having a clip with a receptacle configured at an angle of less than 90 degrees for mating with the hook protrusion of the flexible buckle of the connector core; and the bottom wire holder having an array of holes for receiving configured for receiving a ribbon cable for contacting the bottom set of connector core terminal pins, the array of holes being grooved to match the outer dimensions of the ribbon cable, the bottom wire holder having a clip with a receptacle configured at an angle of less than 90 degrees for mating with the hook protrusion of the flexible buckle of the connector core.

3. A HDMI (High Definition Multimedia Interface) DIY (Do It Yourself) field termination connector assembly system comprising:

a top shell having a male plug member and open base with an extended portion serving as strain relief tabs, the top shell having at least one tab for securing a connector core subunit within the base of the top shell by mating with at least one cognate receptacle on a connector core without the need for adhesive;

a bottom shell having an open compartment base, the open base for mating with and encasing the top shell and a connector core subunit forming a connector assembly;

an insulating connector core having a first plug end for inserting within the top shell male plug member for contacting a female receptacle and a second wire terminal end with an open body for receiving a cable and both a top and a bottom wire holder, the open body of the connector core containing an upper and lower set of flexible buckles each with a hook protrusion, wherein the angle of the hook protrusion on each buckle is configured at an angle of less than 90 degrees and is for non-reversible mating with cognate clip receptacles positioned on the top and bottom wire holders, whereby the insertion of the top and bottom wire holder into the top and bottom compartment of the connector core allows each of the flexible buckle to slip over the clips on the wire holders until the hook protrusion and clip receptacle are non-reversibly mated effectively locking the wire holders into the connector core as a subunit;

a set of top and bottom terminal pins positioned in the connector core for contacting wires in the wire holders, whereby the sets of terminal pins contact the wires when the wire holders are compressed into the connector core providing contacts for signal transmission, the connector core having at least one of receptacle for mating with the at least one of tab on the top shell for securing the connector core and wire holders as a subunit into the top shell without the need for adhesive; whereby the at least one tab of the top shell slides into and mates with the at least one receptacle on the connector core securing the connector core subunit when the connector core subunit is inserted into the top shell;

the top wire holder having an array of holes through the body for receiving a set of wires from a cable for contacting the top set of connector core terminal pins, the array of holes being grooved to match the outer dimensions of the wires of the cable, the top wire holder having a clip with a receptacle configured at an angle of less than 90 degrees for mating with the hook protrusion of the flexible buckle of the connector core without the need for adhesive; and the bottom wire holder having an array of holes for receiving wires from a cable for contacting the bottom set of connector core terminal pins, the array of holes being grooved to match the outer dimensions of the wires of the cable, the bottom wire holder having a clip with a receptacle configured at an angle of less than 90 degrees for mating with the hook protrusion of the flexible buckle of the connector core without the need for adhesive.

4. The HDMI DIY field termination connector assembly system of claim 3, wherein the top shell contains two tabs positioned on each side of the top shell for mating with two cognate receptacles positioned on each side of the connector core for securing the connector core and wire holder as a subunit within the top shell.

5. The HDMI DIY field termination connector assembly system of claim 3, further comprising an HDMI cable.

6. The HDMI DIY field termination connector assembly system of claim 2 further comprising: a cable having a round outer shape for supplying internal wire sets configured as insulated ribbon cables for insertion through the top and bottom wire holders for contacting the terminal pins of the connector core for signal transmission.

7. The HDMI DIY field termination connector assembly system of claim 6, further comprising two ribbon cables, wherein one of the ribbon cables contains eleven internal conducting wires of approximately equal length with one of the wires serving as a ground wire and the other ten as signal wires, and wherein the other ribbon cable contains nine internal signal wires, and wherein the other ribbon cable contains nine internal conducting wires of approximately equal length.

8. The HDMI DIY field termination connector assembly system of claim 1, wherein the connected array of holes of the top and bottom wire holders further comprises a set of seven recessed holes into the body of the wire holders from the back wire terminal end facilitating aiming and threading of wires, and wherein two of the holes of the seven counter sunk holes are of a smaller diameter for receiving naked ground wires.

9. The HDMI DIY field termination connector assembly system of claim 8, wherein the third (810) and sixth (813) holes of the top wire holder are of the smaller diameter for two of the naked ground wires and the first (845) and fourth (848) holes of the bottom wire holder are of the smaller diameter for two of the naked ground wires.

10. The HDMI DIY field termination connector assembly system of claim 8, wherein the top wire holder further comprises three separate holes from the array of holes that have a contiguous inner circumference within and formed from the top wire holder body; and wherein the bottom wire holder further comprises two separate holes from the array of holes within and formed from the top wire holder body.

11. The HDMI DIY field termination connector assembly system of claim 9, wherein the top and bottom wire holder have holes of three different diameters.

12. The HDMI DIY field termination connector assembly system of claim 1, wherein the top wire holder has ten holes with two of the holes having a smaller diameter to receive and center uncoated ground wires and wherein the last three holes are flush with a back surface of the top wire holder and seven of the holes are recessed from the back surface, and wherein the bottom wire holder has nine holes with two of the holes having a smaller diameter to receive and center uncoated ground wires and wherein the last two holes are flush with a back surface of the bottom wire holder and seven are recessed from the back surface.

13. The HDMI DIY field termination connector assembly system of claim 2, wherein the connected array of holes of the top and bottom wire holders is flush with both the front and back surfaces of each wire holder.

14. The HDMI DIY field termination connector assembly system of claim 1, wherein the top and bottom wire holders are distinguished from each other by an identifier marking selected from the group consisting of color, texture, embossing, and molding.

15. The HDMI (High Definition Multimedia Interface) DIY (Do It Yourself) field termination connector assembly system of claim 1, 2 or 3, configured as a pigtail further comprising:

a HDMI cable;

a HDMI female receptacle for input attached onto one end of the HDMI cable;

a male HDMI connector for output attached to the other end of the HDMI cable;

an in-line cable extender that draws power from an electrical device connected to the cable and extender via the HDMI female input receptacle, whereby the extender allows the overall HDMI cable length to be longer.

16. A HDMI (High Definition Multimedia Interface) DIY (Do It Yourself) field termination connector assembly system comprising:

a top and bottom shell for encasing a connector core and wire holder subunit;

a top and bottom wire holder, each wire holder having an connected array of holes through the body for receiving the top or bottom set of wires from the cable for contacting a top and bottom set of terminal pins positioned in the top and bottom compartments of the connector core, wherein the array holes of the wire holders are grooved to match the outer dimensions of the wires of the cable;

a connector core having a male probe end and an open body on a wire terminal end with a top and bottom compartment for receiving a cable and the top and bottom wire holders, the open body of the connector core containing an upper and lower set of flexible buckles each with a hook protrusion, wherein the angle of the hook protrusion on each buckle is configured at an angle of less than 90 degrees and is for non-reversible mating with cognate clip receptacles positioned on the top and bottom wire holders;

a top and bottom set of terminal pins with a minimum pitch size of about 0.4 mm to about 2.0 mm positioned in the top and bottom compartments of the connector core for contacting wires in the wire holders, whereby the sets of terminal pins contact the wires when the wire holders are compressed into the connector core providing contacts for signal transmission;

a printed circuit board that traces the pitch size from the top and bottom sets of wires to the pitch size of the pins of 0.4 mm, 1.0 mm or 1.5 mm within the male probe of the connector core, the printed circuit board being positioned between the terminal pins of the top and bottom compartments of the connector core for contacting the wires in the top and bottom wire holders and the terminal pins of the male probe of the connector core.

17. The HDMI DIY field termination connector assembly system of claim 3, wherein the hook protrusion of the flexible buckles of the connector core and the clip receptacles of the wire holders are configured with an angle of about 70 to about 80 degrees.

18. The HDMI DIY field termination connector assembly system of claim 17, wherein the hook protrusion of the flexible buckles of the connector core and the clip receptacles of the wire holders are configured with an angle of about 75 degrees.

* * * * *